US006516169B2

(12) United States Patent
Niimi et al.

(10) Patent No.: US 6,516,169 B2
(45) Date of Patent: Feb. 4, 2003

(54) ELECTROPHOTOGRAPHIC IMAGE FORMING APPARATUS HAVING A GAP BETWEEN PHOTORECEPTOR AND CHARGER, AND PROCESS CARTRIDGE THEREFOR

(75) Inventors: Tatsuya Niimi, Shizuoka-ken (JP); Yohta Sakon, Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/942,574

(22) Filed: Aug. 31, 2001

(65) Prior Publication Data

US 2002/0051654 A1 May 2, 2002

(30) Foreign Application Priority Data

Aug. 31, 2000 (JP) ..... 2000-264720
Jul. 11, 2001 (JP) ..... 2001-211448

(51) Int. Cl.[7] ..... G03G 15/02

(52) U.S. Cl. ..... 399/159; 399/174; 399/175; 399/176

(58) Field of Search ..... 399/159, 174, 399/175, 176, 115; 361/220, 221

(56) References Cited

U.S. PATENT DOCUMENTS 5,576,805 A * 11/1996 Ishihara et al. ..... 399/175
5,845,177 A 12/1998 Choi
6,030,733 A 2/2000 Kami et al.
6,061,539 A * 5/2000 Ishiyama et al. ..... 399/175

FOREIGN PATENT DOCUMENTS

JP 02-148059 6/1990
JP 04-360167 12/1992
JP 05-107871 4/1993
JP 05-127496 5/1993
JP 05-273837 10/1993
JP 05-307279 11/1993
JP 06-308807 11/1994
JP 07-121002 5/1995
JP 07-168417 7/1995
JP 08-202126 8/1996
JP 09-171282 6/1997
JP 10-288881 10/1998
JP 11-095523 4/1999

OTHER PUBLICATIONS

Patent Abstracts of Japan, JP 7–157128, Jun. 20, 1995.
Patent Abstracts of Japan, JP 10–171239, Jun. 26, 1998.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus including a photoreceptor having an image forming portion; a charging roller having a gap forming member on both ends thereof to form a gap between the photoreceptor and the charging roller and configured to charge the photoreceptor, wherein the gap forming members do not contact the image forming portion, and wherein the relationship $t \geqq 2g$ is satisfied; a light irradiator configured to form a latent image in the image forming portion; an image developer configured to form a toner image on the photoreceptor; and an image transferer configured to transfer the toner image onto a receiving material, wherein g is the gap and t represents a distance between an inside edge of one of the gap forming members and one of the two ends of the image forming portion closer to the inside edge of the gap forming member.

60 Claims, 21 Drawing Sheets

ELECTROPHOTOGRAPHIC IMAGE FORMING APPARATUS HAVING A GAP BETWEEN PHOTORECEPTOR AND CHARGER, AND PROCESS CARTRIDGE THEREFOR

BACKGROUND OF THE INVENTION

1. Field of the Invention

The present invention relates to an electrophotographic image forming apparatus and a process cartridge therefor. In particular, the present invention relates to an electrophotographic image forming apparatus using a proximity charger which charges a photoreceptor while a narrow gap is formed between the photoreceptor and the charger, and a process cartridge therefor.

2. Discussion of the Background

Recently the growth of electrophotographic image forming apparatus using a photoreceptor, such as copiers, printers and facsimiles, is remarkable. In particular, photo-printers capable of recording digital information using light have been drastically improving in recording qualities and reliability. This digital recording technique is applied to copiers as well as photo-printers. The copiers to which the conventional analogue copying technique and this digital technique are applied have various image forming functions. Therefore it is considered that the demand for such copiers increases more and more.

In attempting to reduce the quantity of ozone and NOx generated in an electrophotographic image forming apparatus and the electric power consumption of the image forming apparatus when performing charging, charging methods using a charging roller have been proposed.

For example, Japanese Laid-Open Patent Publication No. (hereinafter referred to as JOP) 4-336556 discloses a contact charging device in which a charging roller charges a photoreceptor while contacting the photoreceptor. In the contact charging device, the surface of the charging roller is made of a dielectric material, and the rotating direction of the charging roller is the same as that of the photoreceptor (i.e., at the contact point between the charger and the photoreceptor, the moving direction of the charger is opposite to that of the photoreceptor).

In this case, even when there is a pinhole on the surface of the photoreceptor, a problem in that a charge is not formed around the pin hole does not occur. This is because the surface of the charging roller is dielectric and therefore the charges of the portion of the charging roller to be contacted with the pinhole of the photoreceptor do not decay when performing charging. In addition, even when the photoreceptor and dielectric charging roller are frictionally charged due to friction between the photoreceptor and the charging roller at the contact point thereof, a surface area of the photoreceptor to be charged can be contacted with a surface area of the charging roller having a relatively low charge potential (i.e., a surface area of the charging roller which is not a surface area having a high potential due to rubbing with the photoreceptor), and thereby the photoreceptor can be charged to a desired potential even at a relatively low applied voltage. Since the charging roller charges the photoreceptor while contacting the photoreceptor, the applied voltage is relatively low compared to non-contact chargers such as scorotrons, and therefore the quantity of the above-mentioned reactive gasses generated, such as ozone and NOx, can be reduced.

However, the contact charging devices have the following drawbacks:

(1) uneven charging (i.e., traces of a charging roller) due to uneven contact of the charging roller with the photoreceptor, etc.;
(2) large charging noise;
(3) charging ability deteriorates when toner particles, etc. present on the surface of the photoreceptor adhere on the surface of the charging roller;
(4) photosensitive properties of the photoreceptor change when one or more constituents of the charging roller adhere (migrate) to the photoreceptor; and
(5) the charging roller deforms when the photoreceptor is stopped for a long period of time, resulting in uneven charging.

The uneven charging mentioned above in item (1) is caused by adhesion of the constituents of the charging roller, which are migrated from the charging roller, on the photoreceptor when the photoreceptor is stopped. The large noise mentioned above in item (2) is caused by vibrational contact of the charging roller with the photoreceptor. The vibration of a charging roller is caused when an AC voltage is applied to the charging roller.

In attempting to solve these problems, proximity charging devices have been proposed. In the proximity charging devices, a photoreceptor is charged by applying a voltage to a charger, which is arranged such that a narrow gap of from 0.005 to 0.3 mm is formed between the charger and the photoreceptor.

The proximity charging devices do not cause the problems mentioned above in items (4) and (5) because the charger does not contact the photoreceptor. In addition, with respect to the problem mentioned above in item (3), the proximity charging devices are superior to the contact charging devices because the quantity of toner particles adhered on the charger is less than in the case of contact charging devices.

Various proximity charging methods have been disclosed in, for example, JOPs 2-148059, 5-127496, 5-273837, 5-307279, 6-308807, 8-202126, 9-171282 and 10-288881.

These publications relate to proximity charging methods and it is described therein that a photoreceptor is experimentally charged with a charger while a gap is formed therebetween to observe whether the photoreceptor is evenly charged. However, there is no description in the publications as to how the charger is set closely to the photoreceptor, namely, only ideas of construction of proximity chargers are described therein. Indeed, it is not easy to form a uniform gap not greater than hundreds of micrometers between a charger and a photoreceptor and stably maintain the gap. Namely, proximity charging methods have a big problem of how to stably maintain a gap not greater than hundreds of micrometers between a charger and a photoreceptor.

To the contrary, specific examples of how to set a charger closely to a photoreceptor are described in JOPs 5-107871, 5-273873, 7-168417 and 11-95523.

JOPs 5-107871 and 5-273873 have proposed a method in which an insulating tape whose ends are fixed by springs and which serves as a gap forming member is set between a charger and a photoreceptor, to form a gap between the charger and the photoreceptor. This method is effective in forming a gap between a photoreceptor and a charger. However, when such a gap forming member is practically set on an image forming apparatus, a tension is applied to the springs in only one direction because the photoreceptor rotates in only one direction. Therefore, the springs are easily fatigued. In addition, when such a member is set in the image forming apparatus, the construction of the resultant image forming apparatus becomes complex although this member has a simple mechanism. Therefore the maintenance of the image forming apparatus cannot be easily performed. For example, the image forming apparatus has a drawback in that when the gap forming member is changed, the photoreceptor has to be also changed.

JOP 7-168417 discloses a method in which a gap is formed between a photoreceptor and a charger by setting spacers on bearings of a charger, wherein the spacers contact the surface of the photoreceptor. In this case, the spacers have to be different from the charging portion of the charger in size and material, resulting in complication of the construction of the charger. In addition, in this case the charging roller is made of an insulating material, and therefore a voltage applying roller is needed, resulting in further complication of the construction of the charger and increase of manufacturing costs of the charger.

JOP 11-95523 discloses a method in which a gap is formed between a charger and a photoreceptor by setting a gap forming member on at least one of the charger and the photoreceptor. This apparatus has a simple consruction, but there is no description about the construction of the gap forming member and how to set the gap forming member. Therefore, it is unknown whether a gap can be stably maintained (i.e., the photoreceptor can be stably charged) for a long period of time.

JOP 4-360167 discloses a proximity charging device using a charger, on both ends of which a projected portion is formed to form a gap between the charger and a photoreceptor. By charging the photoreceptor with this charger while contacting the charger with the photoreceptor, proximity charging can be performed. However, there is no description about how to support the gap forming member and the photoreceptor and how to arrange the gap forming member and the photoreceptor. Therefore, it is unknown whether a gap can be stably maintained (i.e., the photoreceptor can be stably charged) for a long period of time.

In addition, there is no description about the measures against uneven charging around the edge portions of the photoreceptor closely to the projected portions. Further there is no description about the measures against accumulation of toner particles on the edge portions of the photoreceptor closely to the projected portions when the charger is repeatedly used. Therefore, it is unknown whether this proximity charging device can be stably used for a long period of time. Namely, the reliability of this proximity charging device is unknown in particular when the charging device is practically used repeatedly.

JOP 7-121002 discloses an image forming apparatus in which a ring-shaped spacer is set on both ends of a cylindrical photoreceptor to form a gap between the photoreceptor and a charger. Around the photoreceptor, other devices such as an image developer, an image transferer and a cleaner are set while contacting the photoreceptor or being closely to the photoreceptor. When such a ring spacer is set on both ends of the photoreceptor, such devices cannot be provided on the ring spacer. Therefore the length of the photoreceptor in the axial direction needs to be extended to secure the desired image forming portion on the photoreceptor.

In addition, in this charging method charging near the ring spacers tends to become uneven (i.e., the potential on the edge portions tends to decrease). When such a charging method is used in combination with a nega-posi developing method which is suitable for digital image writing because the image writing time can be saved, a problem such that background development is observed in these edge portions of the photoreceptor tends to occur.

Further, the spacers themselves and/or the charger tend to be contaminated. Therefore, the edge portions of the photoreceptor neat the spacers should be cleaned such that there is no residual toner particles. However, since the spacers are formed on the photoreceptor, the edge portions cannot be cleaned. Accordingly, it is considered that this charging device has poor reliability when practically used repeatedly.

Because of these reasons, a need exists for a proximity charging device which has a simple construction and in which a gap is stably maintained between the charger and a photoreceptor even when repeatedly used.

SUMMARY OF THE INVENTION

Accordingly, an object of the present invention is to provide a simple and low-cost proximity charging device in which the above-mentioned drawbacks of the contact charging methods can be remedied and which can be practically used. Specifically, a gap can be stably maintained between the charger and a photoreceptor without forming a toner film on the surface of the charger even when the charging device is repeatedly used.

Another object of the present invention is to provide a proximity charging device which does not cause uneven charging specific to proximity charging even when used for a long period of time, resulting in formation of good images for a long period of time.

Yet another object of the present invention is to provide an electrophotographic image forming apparatus and a process cartridge therefor, by which images having good image qualities can be stably produced even when repeatedly used without frequently changing the photoreceptor.

Briefly these objects and other objects of the present invention as hereinafter will become more readily apparent can be attained by an electrophotographic image forming apparatus including at least an image bearing device including a photoreceptor including an electroconductive substrate, a photosensitive layer on the substrate and optionally a protective layer on the photosensitive layer and which rotates in a direction, wherein the photoreceptor has an image forming portion having two ends substantially parallel to the rotating direction; a charging roller which has a gap forming member on both ends thereof to form a gap between the surface of the image forming portion of the photoreceptor and the periphery surface of the charging roller and which is configured to charge the photoreceptor while rotating, wherein the gap forming members do not contact the image forming portion of the photoreceptor; a light irradiator configured to irradiate the photoreceptor with light to form an electrostatic latent image in the image forming portion of the photoreceptor; an image developer configured to develop the latent image with a toner to form a toner image thereon; and an image transferer configured to transfer the toner image onto a receiving material, wherein the following relationship is satisfied:

$$t \geqq 2g$$

wherein g represents the gap and t represents a distance between the inside edge of one of the gap forming members and one of the two ends of the image forming portion of the photoreceptor, which is closer to the one of the inside edge of the one of the gap forming members.

The gap is preferably from 10 to 200 $\mu$m.

The gap forming members can be formed by coating a coating liquid; winding a tape, etc.; cutting the central portion of the surface layer of the charging roller; or the like method.

Preferably the gap forming members contact non-image portions formed on both ends of the photoreceptor, or flanges set on both ends of the photoreceptor.

Alternatively, the charger may have a projected portion on both ends thereof, which serves as the gap forming member.

The gap forming member may be a combination of the flange formed on both ends of the photoreceptor and the projected portion of the both ends of the charger.

The photoreceptor may be a belt-shaped photoreceptor which is supported and driven by at least a driving (or driven) roller. In this case, the width of the roller is longer than that of the belt photoreceptor, and the extended portions of the roller contacts the gap forming members to form a gap. In this case, the gap forming member may be a projected portion of the charger.

It is preferable that at least one of the charger and the photoreceptor (or the driving or driven roller) is pressed toward the other by a spring, etc.

In addition, it is preferable that the charging roller and the photoreceptor have a respective driving device such as gears, couplings and belts so as to be independently rotated.

In another aspect of the present invention, a process cartridge is provided which includes at least a photoreceptor including an electroconductive substrate, a photosensitive layer on the substrate and optionally a protective layer on the photosensitive layer and which rotates in a direction, wherein the photoreceptor has an image forming portion having two ends substantially parallel to the rotating direction; and a charging roller which has a gap forming member on both ends thereof to form a gap between the surface of the image forming portion of the photoreceptor and the periphery surface of the charging roller and which is configured to charge the photoreceptor while rotating, wherein the gap forming members do not contact the image forming portion of the photoreceptor; a light irradiator configured to irradiate the photoreceptor with light to form an electrostatic latent image in the image forming portion of the photoreceptor, wherein the following relationship is satisfied:

$$t \geqq 2g$$

wherein g represents the gap and t represents a distance between the inside edge of one of the gap forming members and one of the two ends of the image forming portion of the photoreceptor, which is closer to the one of the inside edge of the one of the gap forming members.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

As mentioned above, when contact charging devices are used for electrophotographic image forming apparatus, problems which occur are that a toner film is formed on the charger and a charger deforms, resulting in uneven charging or bad charging. In attempting to solve these problems, proximity charging devices have been proposed. However, there is no proximity charging device which has a low cost and a simple structure and in which a gap is stably formed between the charger and the photoreceptor and maintained even when used for a long period of time.

As a result of the present inventors' investigation, it is discovered that by providing a gap forming member on both end portions of the periphery surface of a charging roller and arranging the charging roller such that the charging roller and the image forming portion of the photoreceptor have a specific positional relationship, the above-mentioned problems can be solved.

The image forming portion of the photoreceptor means an area of the photoreceptor in which charging, imagewise irradiation, developing and transferring processes are performed. In addition, the ends of the image forming portion are defined as the outermost side edges of the image forming portion. If the outermost side edges are different for the image forming portions of the charging, imagewise light irradiation, developing and transferring processes, the ends of the image forming portion are defined as the most inside edges among the outermost edges. The photoreceptor has a drum shape or a belt shape supported by a driving and/or driven roller, and the charging, developing, and transferring processes are performed such that the ends of their image forming portions are substantially parallel to the rotating direction of the photoreceptor. In addition, imagewise light irradiation is also performed such that the side ends of the largest optical solid image are substantially parallel to the rotating direction of the photoreceptor. At this point, the term "substantially" means that the end lines are almost parallel to the rotating direction of the photoreceptor although the end lines are zigzagged due to movements of the elements such as developing roller in the direction perpendicular to the rotating direction, low-precision elemetns of the light irradiator, etc.

Figure 18:
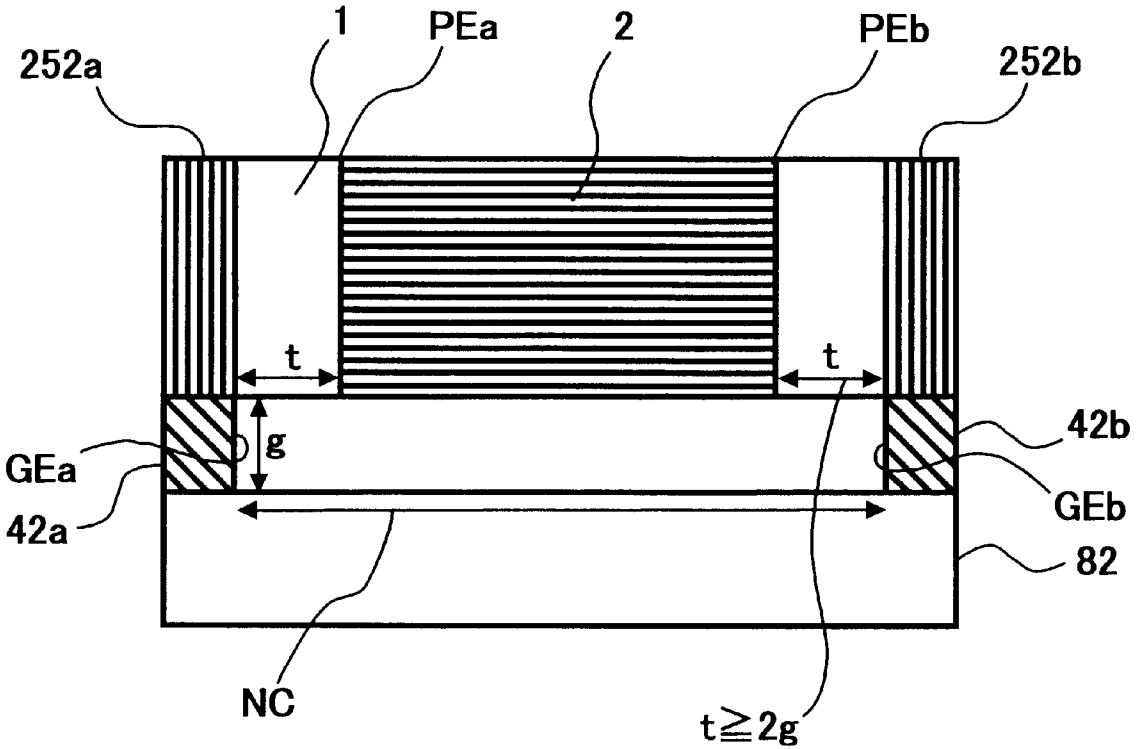
FIG. 18 is a schematic view illustrating the positional relationship between the charging roller and the photoreceptor as shown in FIG. 17.
Figure 30:
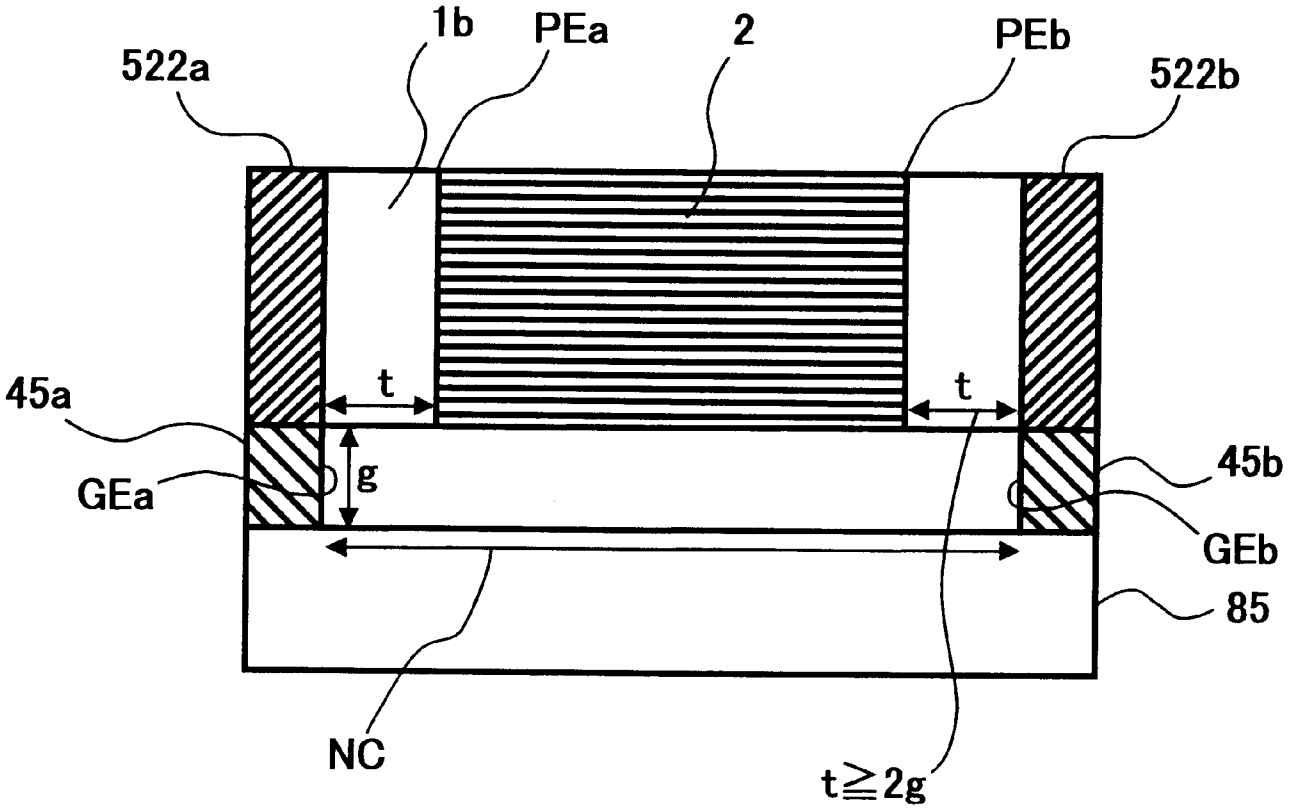
FIG. 30 is a schematic view illustrating the positional relationship between the charging roller and the photoreceptor as shown in FIG. 28.

The charging roller is arranged such that a gap is formed between the surface of the image forming portion and the surface of the charging roller. In this case, as shown in FIGS. 4, 18 and 30 it is necessary that a charge applying portion NC of the charging roller is longer than the width of the image forming portion 2 of the photoreceptor 1.

In this case, the charging roller and the photoreceptor are preferably arranged as shown in FIGS. 4, 18, 25, 27, 30 and 37. Namely, the distance t between an edge PEa (or PEb) of the image forming portion and an inside edge GEa (or GEb) of the gap forming member 41*a*, 42*a*, 43*a*, 44*a*, 45*a* or 46*a* (41*b*, 42*b*, 43*b*, 44*b*, 45*b* or 46*b*) is not less than 2 g, wherein g represents the gap.

Figure 4:
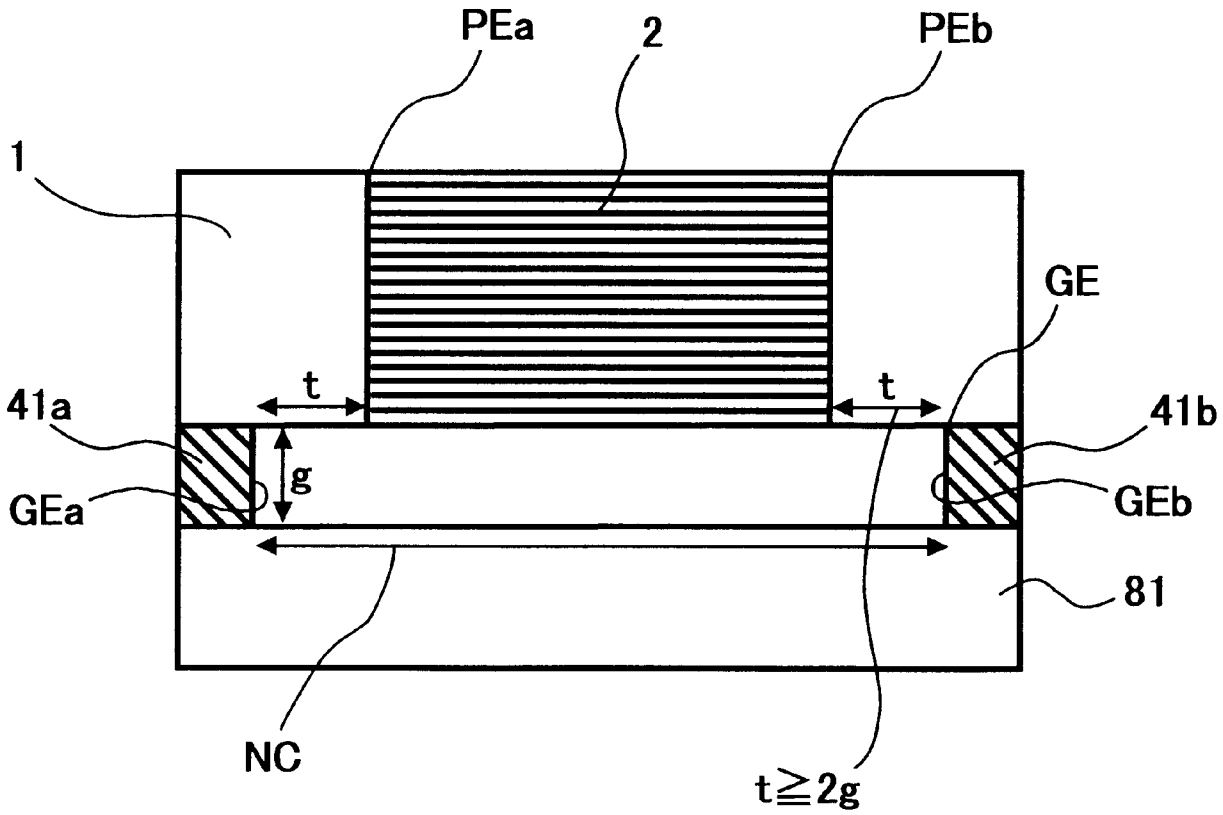
FIG. 4 is a schematic view illustrating the positional relationship between the charging roller and the photoreceptor as shown in FIG. 3.
Figure 25:
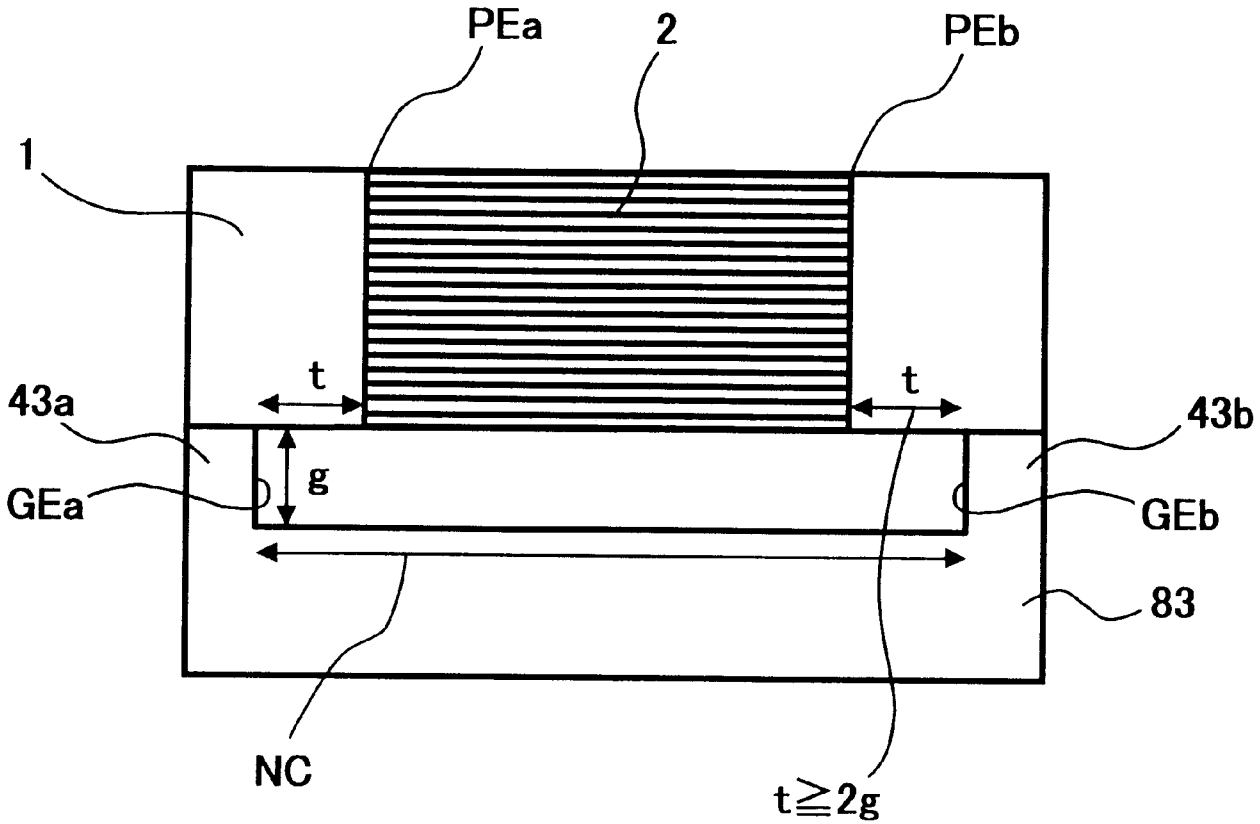
FIG. 25 is a schematic view illustrating another embodiment of the positional relationship between the charging roller and the photoreceptor.

As shown in FIG. 4, etc., the gap forming members (41*a* and 41*b*) can be formed on both end portions of the charging roller, for example, by coating a coating liquid or adhering a tape or the like material. In addition, as shown in FIG. 25, etc., the gap forming members (43*a* and 43*b*) can be formed by cutting the surface layer of the charging roller to form the charge applying portion NC.

The reasons why the distance t should be not less than 2 g are as follows:

(1) In proximity charging methods, the photoreceptor is charged due to discharging through a narrow gap between the charging roller and the photoreceptor. In this case, if charges are vertically showered on the surface of the photoreceptor, the ends PEa and PEb of the image forming portion 2 can be extended to the inside edges GEa and GEb of the gap forming members. However, all charges are not vertically showered, and charges diffuse in various directions at a certain rate. Therefore, the edge portions of the photoreceptor near the gap forming members are charged relatively unevenly compared to the central portion of the photoreceptor.

When a nega-posi developing method (i.e., a reverse developing method), which is typically used for current electrophotographic digital image forming apparatus, is used, undesired images such as black spots and background fouling are produced. In particular, in a system in which half tone images are produced by developing medium potentials formed on the photoreceptor by a multi-value image writing method, these undesired images are remarkably produced.

As a result of the present inventors' investigation, it is discovered that the width of the unevenly charged area depends on the gap between the photoreceptor and the charging roller. When the distance t is varied while the gap is kept to be constant, undesired images are not observed when the distance t is not less than a certain value. In addition, when this experiment is repeated while changing the gap to determine the relationship between the gap and the width of the unevenly charged area, it is discovered that by arranging the charging roller and the photoreceptor such that the distance t is not less than 2 g, charging can be stably performed, resulting in formation of good images.

(2) The other reason is that the charging roller can be easily cleaned. The proximity charging methods have an advantage against the contact charging methods such that the contamination of the surface of the charging roller is less than in the contact charging methods. However, the toner particles remaining on the photoreceptor even after the developing, transferring and cleaning processes tend to stay at the inside edges of the gap forming members when image forming processes are repeatedly performed, resulting in uneven charging and formation of undesired images.

This problem can also be avoided when the distance t is not less than 2 g.

The present invention will be explained referring to six embodiments to be able to be fully understood.

First Embodiment of the Image Forming Apparatus of the Present Invention

The first embodiment of the image forming apparatus of the present invention will be explained referring to drawings. At first, the charging roller (hereinafter referred to as the charger) for use in the first embodiment of the image forming apparatus will be explained.

As mentioned above, a gap forming member is formed on both end portions of the charger, which are to be contacted with non-image forming portions of both ends of a photoreceptor. In order to form a uniform gap between a charger and a photoreceptor, the following two methods can be used.

The first method is to form a gap forming layer on both ends of a charger, which contact non-image forming portions of both ends of a photoreceptor. The following is an embodiment of the charger, but the present invention is not limited thereto. Any known chargers can be used regardless of their materials and constructions if the chargers include such a gap forming layer as mentioned below.

Figure 1:
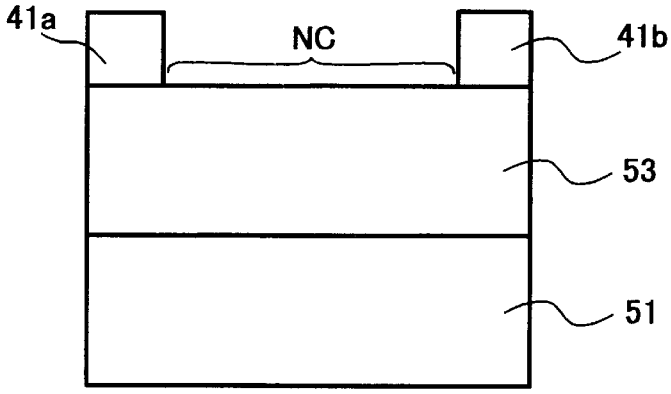
FIGS. 1 and 2 are schematic views illustrating cross-sections of embodiments of the charging roller for use in the image forming apparatus of the present invention.

FIG. 1 is a cross-section of an embodiment of the charger for use in the image forming apparatus of the present invention. In FIG. 1, an electroconductive elastic material layer 53 is formed on a rotating shaft 51, and gap forming members 41*a* and 41*b* are formed on both ends of the charger. The gap forming members 41*a* and 41*b*, which are made of an insulating material and which are to be contacted with edge portions of a photoreceptor on which images are not formed (hereinafter the edge portions are sometimes referred to as the non-image portions).

Figure 2:
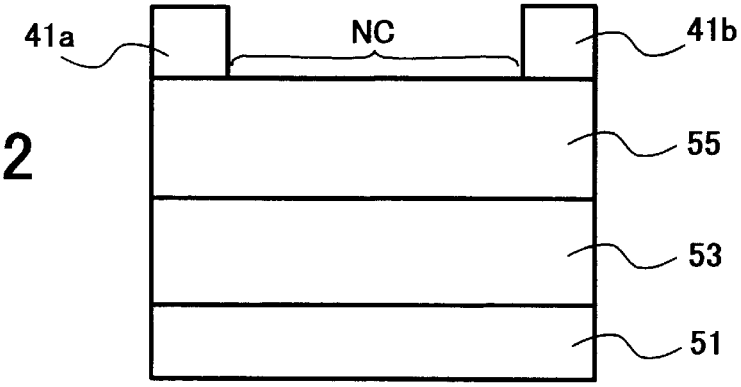

FIG. 2 is a cross-section of another embodiment of the charger. In FIG. 2, an electroconductive elastic material layer 53 and a resistance controlling layer 55 are overlaid on a rotating shaft 51. Gap forming members 41*a* and 41*b* made of an insulating material are formed on both ends of the charger.

Figure 3:
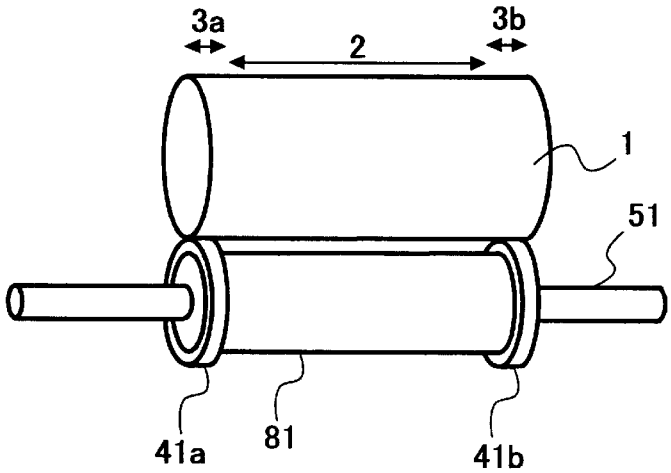
FIG. 3 is a schematic view illustrating an embodiment of configuration of the charging roller and the photoreceptor for use in the image forming apparatus of the present invention.

FIG. 3 is a schematic view illustrating an embodiment of configuration of a charger 81 and a photoreceptor 1. The gap forming members 41*a* and 41*b* formed on both ends of the charger 81 having a rotation axis 51 contact non-image portions 3*a* and 3*b* of the photoreceptor 1. Since the charging roller 81 and the photoreceptor 1 contact at the gap forming members 41*a* and 41*b*, a gap is formed therebetween. Thus, an image forming portion 2 of the photoreceptor 1 can be charged while not contacting the charging roller 81.

FIG. 4 is a schematic view illustrating the positional relationship between the image forming portion 2 of the photoreceptor 1 and the gap forming members 41*a* and 41*b* formed on the charger 81. In the present invention, the relationship is very important. Namely, it is important that as shown in FIG. 4 an inside edge GEa (or GEb) of the gap forming member 41*a* (or 41*b*) is located outside the end PE of the image forming portion 2 of the photoreceptor 1. The distance t between the inside edge GEa (or GEb) of the gap forming member 41*a* (or 41*b*) and the end PEa (PEb) of the image forming portion 2 is preferably not less than twice the gap g between the photoreceptor 1 and the charger 81. When the distance t is too short, the above-mentioned problems tend to occur. To the contrary, when the distance t is too long, the charger needs to be lengthen, and thereby the image forming apparatus becomes large in size. In addition, when the distance t is too long, large charging noise are generated. In the charging system of the present invention, charging is also performed between the end PEa (or PEb) of the image forming portion 2 and the inside edge GEa (or GEb) of the gap forming member 41*a* (or 41*b*). When a DC voltage overlapped with an AC voltage is applied to the photoreceptor 1 by the charger 81 to uniformly charge the photoreceptor 1, the shorter the distance t, the less the charging noise. Therefore, it is preferable that the distance t is not greater than 100 times the gap g or not greater than 10 mm.

Then the charger 81 having insulating gap forming members 41*a* and 41*b* will be explained in detail. In this example, the gap forming members are sometimes referred to as gap forming layers.

As the rotating shaft 51, metals such as iron, copper, brass and stainless steel can be preferably used.

As the electroconductive elastic material 53, compositions which include a synthetic rubber and an electroconductive material such as electroconductive powders and electroconductive fibers (e.g., carbon black, metal powders and carbon fibers) dispersed in the rubber, can be preferably used. When the resistance controlling layer 55 is formed as shown in FIG. 2, the resistance of the resistance controlling layer 55 is preferably from 103 to $10^8$ Ω·cm (i.e., in a semi-conductive region).

When the resistance controlling layer 55 is not formed, the resistance of the electroconductive elastic material 53 should be higher than the above-mentioned resistance and is preferably from $10^4$ to $10^{10}$ Ω·cm.

Suitable materials for use in the resistance controlling layer 55 include synthetic resins such as polyethylene, polyesters and epoxy resins; synthetic rubbers such as etylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

The gap forming layers 41*a* and 41*b* are made from insulation materials to charge only the image forming portion 2 of the photoreceptor 1. In this case, the "insulation materials" mean materials having a resistance not less than $10^{10}$ Ω·cm, i.e., a resistance greater than the resistance of the surface of the charger 81 (i.e., the resistance controlling layer 55 or the electroconductive elastic layer 53).

In addition, the gap forming layers 41*a* and 41*b* are preferably made from a material having good abrasion resistance because they are rubbed with the photoreceptor 1 when image forming operations are repeatedly preformed. Suitable materials for use in the gap forming layers 41*a* and 41*b* include engineering plastics having a good film formability and the like materials. Specific examples of such materials include polyamides, polyurethanes, epoxy resins, polyketones, polycarbonates, silicone resins, acrylic resins, polyvinyl butyrals, polyvinyl formals, polyvinyl ketones, polystyrene, polysulfones, poly-N-vinylcarbazole, polyacrylamide, polyvinyl benzal, polyesters, phenoxy resins, vinyl chloride-vinyl acetate copolymers, polyvinyl acetate, polyphenylene oxide, polyvinyl pyridine, cellulose resins, casein, polyvinyl alcohols, polyvinyl pyrrolidone, etc.

In addition, in order to reduce the friction coefficient of the gap forming layers 41*a* and 41*b*, materials in which the above-mentioned materials are modified by fluorine or silicon or materials in which a fluorine-containing resin or a silicone resin is dispersed can be preferably used. Further, a filler can be included in the gap forming layers 41*a* and 41*b* to improve the abrasion resistance thereof.

The gap forming layers 41*a* and 41*b* for use in the first embodiment can be formed by various methods. Among the methods, wet coating processes are preferably used because of being simple. The wet coating processes are broadly classified into the following two processes.

One of the processes of forming the gap forming layers 41*a* and 41*b* is to coat a coating liquid on both end portions of a charger by spray coating or nozzle coating while masking the charge applying portion NC. In addition, it is also preferable that the gap forming layers 41*a* and 41*b* can be formed one by one by a dip coating method.

The other of the methods is to coat a coating liquid on the entire surface of the charger and then cut the central portion of the coated layer to form the charge applying portion NC.

Both the methods can be used, however, the former method is preferable in view of ecology.

The thickness of the gap forming layers 41*a* and 41*b* is preferably from 10 to 200 μm, and more preferably from 20 to 100 μm. When the thickness is too thin, there is a possibility that the charger 81 contacts the photoreceptor 1. In addition, the toner remaining on the surface of the photoreceptor 1 tends to adhere to the charger 81. Therefore, it is not preferable. When the thickness is too thick, the voltage applied to the charger 81 has to be increased, resulting in increase of electric power consumption. In addition, the photoreceptor 1 tends to be unevenly charged, and therefore it is not preferable.

Then another example of the gap forming members 41*a* and 41*b* will be explained referring to drawings. In this example, gap forming materials serve as the gap forming members 41*a* and 41*b*.

Gap forming materials 41*a* and 41*b* made from an insulating material are formed on the end portions of the electroconductive elastic material 53 as shown in FIG. 1.

Alternatively, gap forming materials 41*a* and 41*b* made from an insulating material may be formed on the end portions of the resistance controlling layer 55.

Then the charger 81 having the gap forming materials 41*a* and 41*b* will be explained in detail.

The rotating shaft 51, the electroconductive elastic material 53 and the resistance controlling layer 55 are mentioned above.

The gap forming materials 41*a* and 41*b* are made of an insulating material having a resistance not less than $10^{10}$ Ω·cm to charge only the image forming portion 2 of the photoreceptor 1. In addition the material preferably has good abrasion resistance because the gap forming materials 41*a* and 41*b* are rubbed with the photoreceptor 1 when image forming operations are preformed. Suitable materials for use in the gap forming materials 41*a* and 41*b* include the engineering plastics having a good film formability and the like materials mentioned above for use in the gap forming layers. A filler can be included in the gap forming materials 41*a* and 41*b* to improve the abrasion resistance thereof. The gap forming materials 41*a* and 41*b* preferably have a shape like a tape, a label or a tube.

The gap forming materials 41*a* and 41*b* can be formed by various methods. The methods are broadly classified into the following two methods.

One of the methods of forming the gap forming materials 41*a* and 41*b* is to use a seamless material. This method is preferable when taking into consideration that the charger 81 and the photoreceptor 1 contact at the gap forming materials 41*a* and 41*b*. In order to form a seamless gap forming materials, for example, the following methods can be used:

(1) a heat shrinking tube is set on both ends of the charger and then the tube is heated so as to be shrunk, resulting in formation of gap forming materials 41*a* and 41*b*; and (2) a tube is set on each end portion of the charger 81 such that the tube covers the end portion.

Figure 5A:
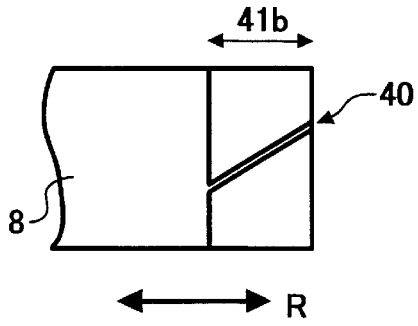
FIGS. 5A and 5B are schematic views illustrating a gap forming member having a seam for use in the charging roller.
Figure 5B:
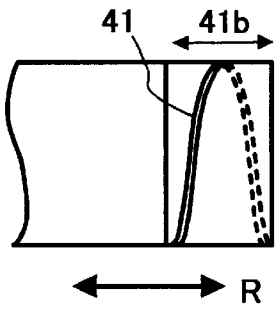

The other method of forming the gap forming materials 41*a* and 41*b* is to use a material having a seam. When using such a material, the gap has to be stably maintained even when image forming operations are repeatedly performed. In general, tapes and labels are wound around the end portions of the charger 81 to form the gap forming materials 41*a* and 41*b*. To form a gap forming material having a uniform thickness, the following methods can be used:

(1) the thickness of both end portions of a tape (or label) is decreased such that when the tape is wound around an end portion of the charger, the overlapped portion of the tape has the same thickness as the other portion in which the tape is not overlapped: and (2) both end portions of a tape is slantingly cut such that the seam is slantingly formed as shown in FIGS. 5A and 5B relative to a rotating axis direction R of the charger 81.

When a tape is wound as shown in FIGS. 5A and 5B, the ratio of the width of a seam 40 to the width of the tape is very small, and therefore the gap forming material can be used similarly to a seamless gap forming material. Accordingly this method is preferably used because of being easily prepared and exhibiting good performance.

For the same reasons as mentioned above in the case of the gap forming layers, the thickness of the gap forming materials 41*a* and 41*b* is preferably from 10 to 200 μm, and more preferably from 20 to 100 μm.

Figure 6:
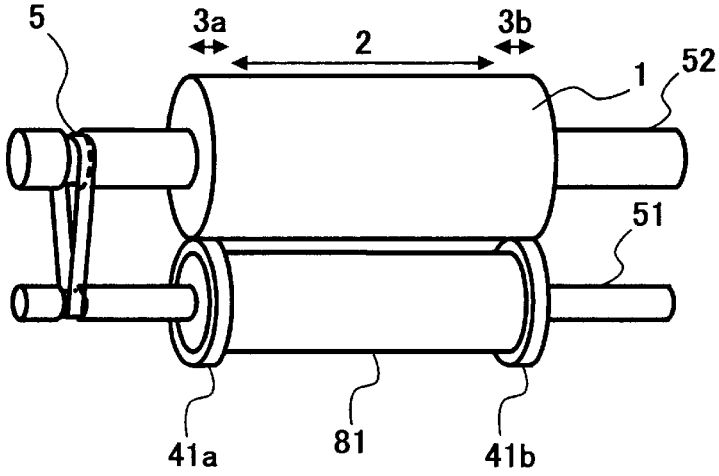
FIGS. 6 and 7 are a schematic view and a side view illustrating the charging roller and the photoreceptor, which are connected by a ring member.
Figure 7:
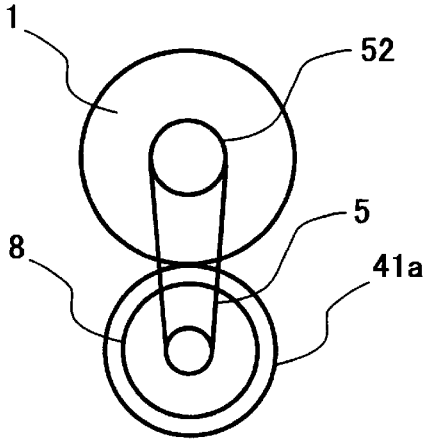

In the present invention, it is very important to control the gap g between the charger 81 and the photoreceptor 1. By using the gap forming members (i.e., the gap forming layers or the gap forming materials), the gap g can be controlled so as not become much narrower than a predetermined value. Various methods can be used for controlling the gap so as not become much wider than a predetermined value. For example, one of the methods is to regulate the distance between the charger 81 and the photoreceptor 1. Specifically, the method is to fix the charger and the photoreceptor at a state in which they contact each other via the gap forming materials. More specifically, the rotating shafts of the charger and the photoreceptor are fixed using a ring-shaped member 5 as shown in FIGS. 6 and 7. As can be understood from FIGS. 6 and 7, the gap between the charger 81 and the photoreceptor 1 is controlled so as not to become wider than a predetermined value. Suitable materials for use as the ring-shaped member 5 include rings having flexibility and belt-shaped rings. In particular, seamless metal belts and plastic films can be preferably used.

The advantages of using the ring-shaped member 5 (hereinafter referred to as the ring member 5) are as follows:

(1) Designing Flexibility can be Increased when a Photoreceptor and a Charger are Arranged.

In order to control the gap so as not to become much wider than a predetermined value, the charger is generally set at an upper position than the photoreceptor because of utilizing the gravity of the charger. Thus, the configuration of the charger and the photoreceptor is determined for only the designing reason. However, when such a ring member 5 is used, the charger 81 can be set at any position. Thus, designing flexibility can be increased, and thereby the image forming apparatus can be miniaturized.

(2) Production of Undesired Images can be Prevented.

When a photoreceptor and a charger are miniaturized in diameter and in addition they are used for fairly high speed recording, the rotation speed thereof becomes very high. In such a case, the gap between the photoreceptor and the charger tends to become wider than a predetermined value, resulting in uneven charging, and thereby an undesired image problem, a so-called "banding phenomenon", in which horizontal stripes are formed in half tone images, is caused. By using the ring member 5, the gap can be severely controlled and therefore the banding phenomenon can be avoided. This method is more effective than the pressing method using a spring mentioned below. A combination of this method and the pressing method using a spring can also be used.

(3) Charging Noises can be Decreased.

When proximity charging or contact charging is performed, a DC voltage overlapped with an AC voltage is typically used. In such a case, the photoreceptor often vibrates sympathetically to the AC voltage, resulting in generation of noises. In this case, a measure in which a stuffed photoreceptor is used to change the vibration frequency of the photoreceptor is typically used. This measure is effective but the photoreceptor has a heavy weight. Therefore, the measure produces adverse effects such that torque of the motor used for driving the photoreceptor needs to be increased and the cost of the photoreceptor increases.

When the gap is controlled using the ring member 5, the charger and the photoreceptor can be arranged while the sympathetic vibration of the photoreceptor is avoided (i.e., generation of charging noises can be avoided). In order to decrease charging noises, this method is more effective than the pressing method using a spring mentioned below. A combination of this method and the pressing method using a spring can also be used.

(4) Influence of Vibration of Driving Members can be Decreased.

In full color image forming apparatus, a tandem type image forming system using plural photoreceptors is typically used to increase the recording speed. Such image forming apparatus have various output modes. For example, the rotating speeds of the photoreceptors are changed depending on whether the priority is given to image qualities or recording speed. In addition, the rotating speeds of the photoreceptors are changed depending on whether a full color recording is performed or a black and white recording is performed. When a black and white recording is performed, there is a case in which only the black image forming unit is operated.

In these cases, the four color image forming units (i.e., four pairs of at least a photoreceptor and a charger) operate randomly and the operation speeds are often changed. In such a case, the photoreceptors are influenced by the vibration of the driving motors and drive-transmitting members, and thereby undesired images tend to be produced. In particular, when gear driving is used to perform precision driving, the influence is very large. By using the ring member 5, the gap between the photoreceptor and the charger can be severely controlled, and thereby the influence can be decreased.

Figure 8:
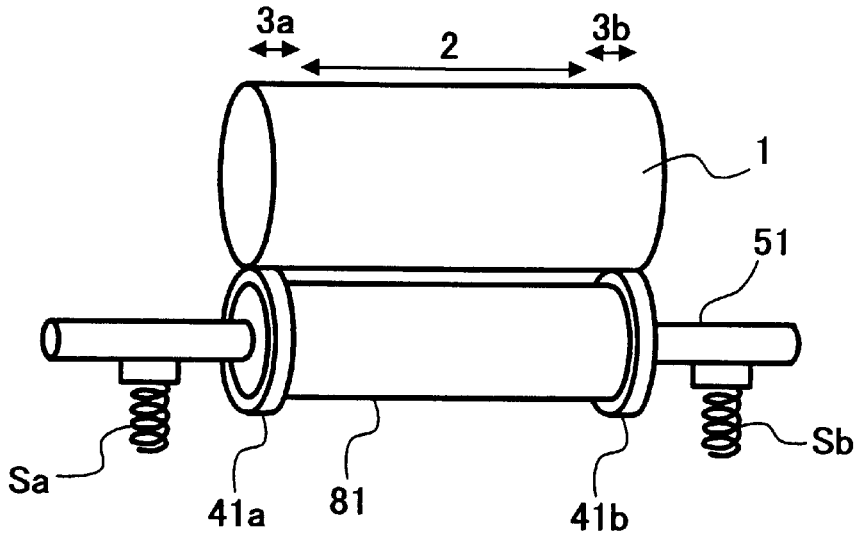
FIGS. 8 and 9 are schematic views illustrating other embodiments of configuration of the charging roller and the photoreceptor.

Another method is a pressing method in which pressure is mechanically applied to the charger using a spring or the like such that the charger is pressed toward the photoreceptor as shown in FIG. 8. In FIG. 8, springs Sa and Sb contact the rotating shaft 51 but the springs Sa and Sb may directly press the surface of the charging roller 81. In addition, it is possible to press the photoreceptor toward the charger. However, when using this method, other members contacting the photoreceptor are influenced, and therefore the former method is preferable.

Figure 9:
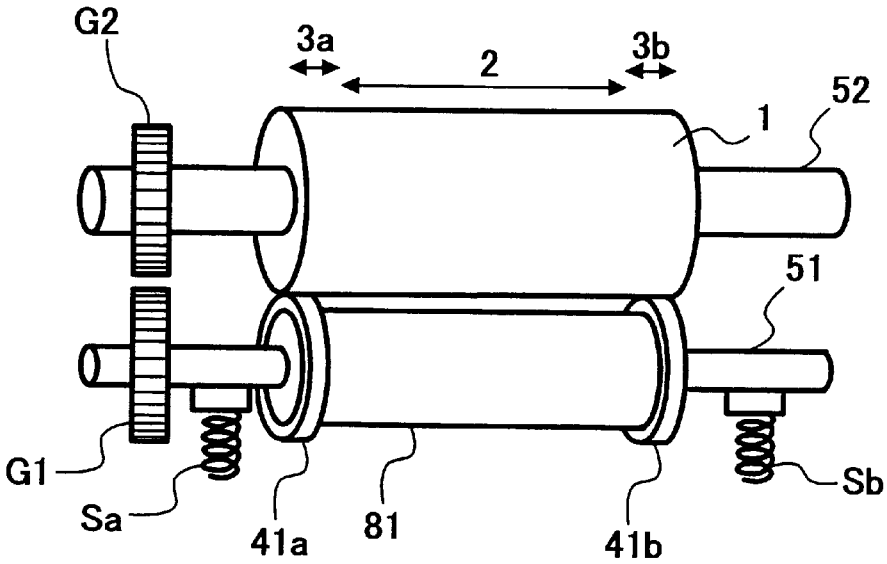

In this method, it is preferable that gears G1 and G2 (or couplings, belts or the like) are provided on the shafts of the charger and the photoreceptor as shown in FIG. 9, to independently drive the charger and the photoreceptor. It is possible that one member of the photoreceptor and the charger is driven by a driving device and the other is frictionally driven by the member using the friction between the photoreceptor and the charger. However, in this method the contact pressure of the charger with the photoreceptor has to be increased and therefore it is not satisfactory in view of durability.

The rotating speeds of the photoreceptor and the charger may be different. However, when taking into consideration of the abrasion of the gap forming members, it is preferable that the charger and the photoreceptor rotate at the same speed.

The advantages of the method using a pressing member such as springs are as follows:

(1) Designing Flexibility can be Increased when a Photoreceptor and a Charger are Arranged.

In order to control the gap so as not to become much wider than a predetermined value, the charger is generally set at an upper position than the photoreceptor because of utilizing the gravity of the charger. Thus, the configuration of the charger and the photoreceptor is determined for only the designing reason. However, when such a pressing member such as springs Sa and Sb is used, the charger 81 can be set at any position. Thus, designing flexibility can be increased, and thereby the image forming apparatus can be miniaturized.

(2) Production of Undesired Images can be Prevented.

When a photoreceptor and a charger are miniaturized in diameter and in addition they are used for fairly high speed recording, the rotation speed thereof becomes very high. In such a case, the gap between the photoreceptor and the charger tends to become wider than a predetermined value, resulting in uneven charging, and thereby an undesired image problem, the so-called "banding phenomenon" is caused. By using the pressing member such as springs Sa and Sb, the gap can be severely controlled and therefore the banding phenomenon can be avoided. In addition, by controlling the weight and elastic coefficient of the springs Sa and Sb used, problems such as production of jitter images due to vibration of the springs can be avoided.

(3) Charging Noises can be Decreased.

When proximity charging or contact charging is performed, a DC voltage overlapped with an AC voltage is typically used. In such a case, the photoreceptor often vibrates sympathetically to the AC voltage, resulting in generation of noises. In this case, a measure in which a stuffed photoreceptor is used to change the vibration frequency of the photoreceptor is typically used. This measure is effective but the photoreceptor has a heavy weight. Therefore, the measure produces adverse effects such that torque of the motor used for driving the photoreceptor needs to be increased and the cost of the photoreceptor increases.

In contrast, in the present invention by applying a pressure to one member of the charger and the photoreceptor using a pressing member such as springs to press the member to the other member while controlling the weight and elastic coefficient of the springs, the charger and the photoreceptor can be arranged without generating sympathetic vibration (i.e., without causing charging noises).

The advantage of independently driving the charger and the photoreceptor is as follows:

(1) Influences of Load Changes of one Member of a Photoreceptor and a Charger can be Decreased.

In general, one member of the photoreceptor and the charger is driven by a driving motor. The driving force is transmitted to the other member using gears provided to both the members. Thus, the other member is also rotated while driven by the member. However, if the photoreceptor or the charger has load change when repeatedly used, the other member is influenced by the member. When the photoreceptor or the charger are independently driven, such a problem does not occur, i.e., rotation of the photoreceptor or the charger can be accurately performed.

When the diameter of the photoreceptor is an integral multiple of that of the charger or vice versa, both the members can be synchronously driven. In this case, a point of the photoreceptor always contacts the same point of the charger when rotating. Therefore a uniform gap can be stably maintained. For example, by marking the side wall of one or both of the photoreceptor and the charger, timing of contact of the members can be visually observed, and therefore it can be possible to control the contact timing.

The advantages of a system in which a photoreceptor and a charger are rotated at the same speed are as follows:

(1) Stress on the Gap Forming Members can be Decreased.

When the photoreceptor has a large capacitance and the rotation speed of the charger is higher than that of the photoreceptor to increase the quantity of the charge applied from the charger to the photoreceptor, the stress on the gap forming member increases, resulting in increase of abrasion of the gap forming member, and thereby a problem occurs such that the gap cannot be stably maintained. When the photoreceptor and the charger are independently rotated and in addition the rotation speed thereof is the same, the durability of the gap forming member can be improved, and thereby the gap can be stably maintained.

(2) Atmospheric Conditions of the Gap can be Stabilized.

When the rotation speeds of the photoreceptor and the charger are different, air tends to flow randomly in the gap in proximity charging. In such a case, charging becomes unstable and thereby undesired images tend to be produced. When the photoreceptor and the charger are rotated at the same speed, airflow can be stabilized, and thereby charging can be stabilized.

In FIGS. 6–9, a rotation transmission member is provided on the shaft 52 of the cylindrical photoreceptor 1 and the shaft 51 of the charging roller. However, such a rotation transmission member can also be provided on the shafts of a charging roller and a roller supporting a belt-shaped photoreceptor.

When such a charger as mentioned above is used for charging a photoreceptor, a DC voltage overlapped with an AC voltage is preferably applied to the charger because uneven charging can be avoided.

Next, the photoreceptor for use in the first embodiment of the image forming apparatus of the present invention will be explained referring to drawings.

Figure 10:
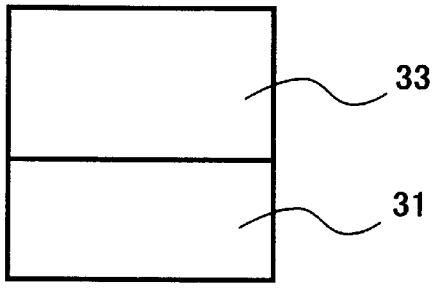
FIGS. 10–13 are schematic views illustrating the cross-sections of embodiments of the photoreceptor for use in the image forming apparatus of the present invention.

FIG. 10 is a schematic view illustrating the cross-section of an embodiment of the photoreceptor. A single-layer photosensitive layer 33 including a charge generation material and a charge transport material as main components is formed on an electroconductive substrate 31.

Figure 11:
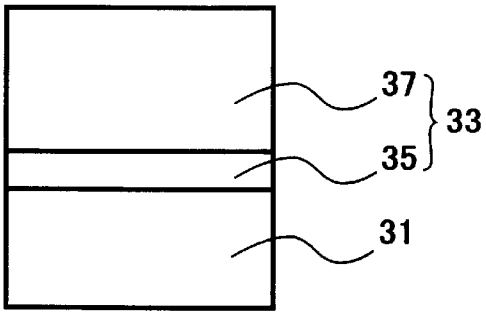
Figure 12:
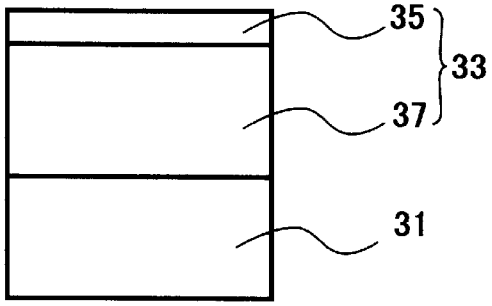

FIGS. 11 and 12 are schematic views illustrating the cross-sections of other embodiments of the photoreceptor. A charge generation layer 35 and a charge transport layer 37 are overlaid on an electroconductive substrate 31.

Figure 13:
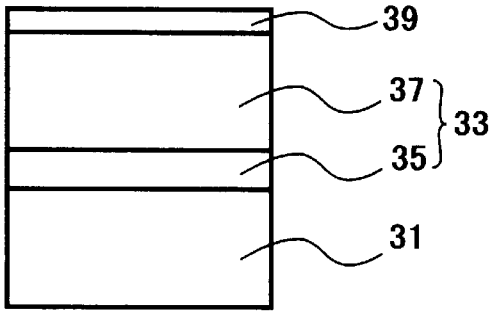

FIG. 13 is a schematic view illustrating the cross-section of another embodiment of the photoreceptor. A charge generation layer 35, a charge transport layer 37 and a protective layer 39 are overlaid on an electroconductive substrate 31 in this order.

Suitable materials for use as the electroconductive substrate 31 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like, which have been disclosed, for example, in Japanese Laid-Open Patent Publication No. 52-36016, can also be used as the substrate 31.

Furthermore, substrates, in which a coating liquid including an electroconductive powder dispersed in a binder resin is coated on the supporters mentioned above, can be used as the substrate 31. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate 31.

Next, the photosensitive layer of the photoreceptor of the present invention will be explained.

In the present invention, the photosensitive layer may be a single-layered photosensitive layer or a multi-layered photosensitive layer.

At first, the multi-layered photosensitive layer including the charge generation layer 35 and the charge transport layer 37 will be explained.

The charge generation layer 35 (hereinafter referred to as the CGL 35) includes a charge generation material as a main component, and optionally a binder resin is also used. In the CGL 35, known inorganic and organic charge generation materials can be used.

Specific examples of the inorganic charge generation materials include crystal selenium, amorphous selenium, selenium-tellurium compounds, selenium-tellurium-halogen compounds, selenium-arsenic compounds, amorphous silicon, etc. With respect to amorphous silicon, compounds in which the dangling bond is terminated with a hydrogen atom or a halogen atom or in which a boron atom or a phosphorous atom is doped can be preferably used.

Suitable organic charge generation materials include known organic charge generation materials. Specific examples of the organic charge generation materials include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like materials. These charge transport materials can be used alone or in combination.

Specific examples of the binder resin, which is optionally used in the CGL 31, include polyamide resins, poly urethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like. The addition quantity of the binder resin is from 0 to 500 parts by weight, and preferably from 10 to 300 parts by weight, per 100 parts by weight of the charge generation material included in the CGL 35.

Suitable methods for forming the CGL 35 include thin film forming methods in a vacuum, and casting methods using a coating liquid.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like methods. The CGL 35 including one or more of the above-mentioned inorganic and organic materials can be typically formed by one of these methods.

The casting methods useful for forming the CGL 35 include, for example, the following steps:

(1) preparing a coating liquid by mixing one or more inorganic and organic charge generation materials mentioned above with a solvent such as tetrahydrofuran, cyclohexanone, dioxane, dichloroethane, butanone and the like, and if necessary, together with a binder resin and an additives, and then dispersing the materials with a ball mill, an attritor, a sand mill or the like;

(2) coating on a substrate the coating liquid, which may be diluted if necessary, by a dip coating method, a spray coating method, a bead coating method, a nozzle coating method, a spinner coating method, a ring coating method or the like method; and (3) drying the coated liquid to form a charge generation layer.

The thickness of the CGL 35 is preferably from about 0.01 to about 5 $\mu$m, and more preferably from about 0.1 to about 2 $\mu$m.

The charge transport layer 37 (hereinafter referred to as a CTL 37) can be formed, for example, by the following method:

(1) a charge transport material and a binder resin are dispersed or dissolved in a proper solvent to prepare a CTL coating liquid; and (2) the coating liquid is coated on the CGL 35 and dried to form a charge transport layer.

The CTL 37 may include additives such as plasticizers, leveling agents, antioxidants and the like if desired.

Charge transport materials are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These charge transport materials can be used alone or in combination.

Specific examples of the binder resin for use in the CTL 37 include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the charge transport material in the CTL 37 is preferably from 20 to 300 parts by weight, and more preferably from 40 to 150 parts by weight, per 100 parts by weight of the binder resin included in the CTL 37. The thickness of the CTL 37 is preferably from 5 to 100 $\mu$m.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The CTL 37 preferably includes a charge transport polymer, which has both a binder resin function and a charge transport function. The CTL 37 constituted of a charge transport polymer has good abrasion resistance.

Suitable charge transport polymers include known charge transport polymers. Among these polymers, polycarbonate resins having a triarylamine group in their main chain and/or side chain are preferably used. In particular, charge transport polymers having the following formulae of from (1) to (10) are preferably used:

(1)

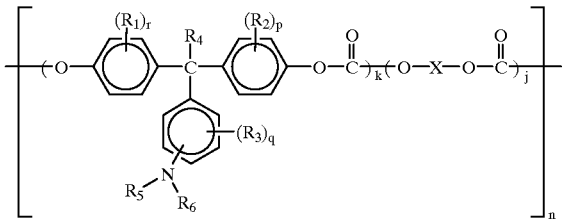

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

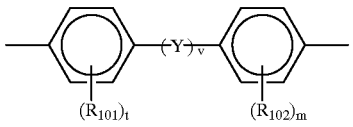

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—,—CO—

O—Z—O—CO— (Z represents a divalent aliphatic group), or a group having the following formula:

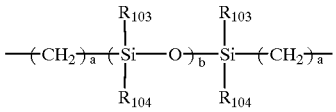

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ may be the same or different from the others.

(2)

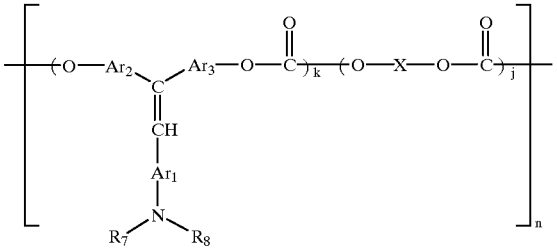

wherein $R_7$ and $R_8$ independently represent a substituted or unsubstituted aryl group; $Ar_1$, $Ar_2$ and $Ar_3$ independently represent an arylene group; and X, k, j and n are defined above in formula (1).

(3)

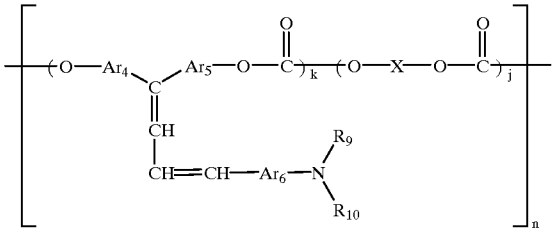

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (1).

(4)

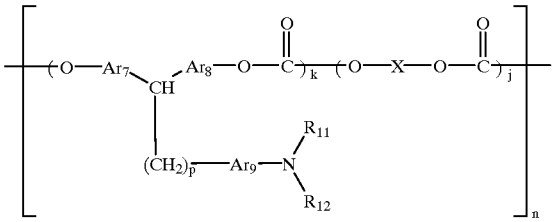

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (1).

(5)

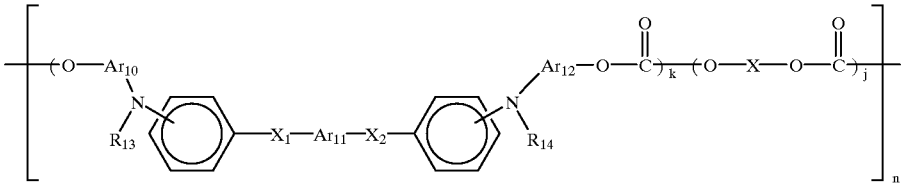

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (1).

(6)

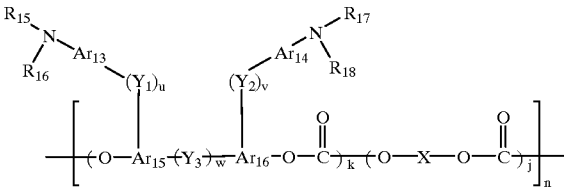

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w are independently 0 or 1; and X, k, j and n are defined above in formula (1).

(7)

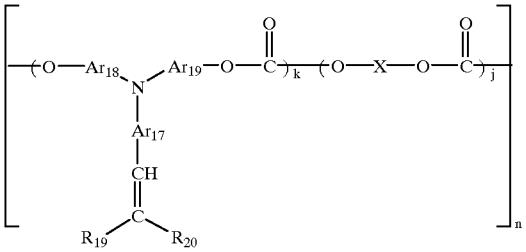

wherein $R_{19}$ and $R_{20}$ independently represent a hydrogen atom, or substituted or unsubstituted aryl group, and $R_{19}$ and $R_{20}$ may be combined to form a ring; $Ar_{17}$, $Ar_{18}$ and $Ar_{19}$ independently represent an arylene group; and X, k, j and n are defined above in formula (1).

(8)

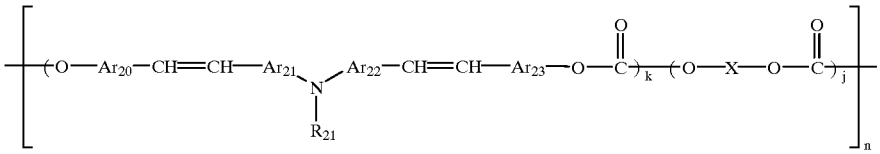

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in formula (1).

(9)

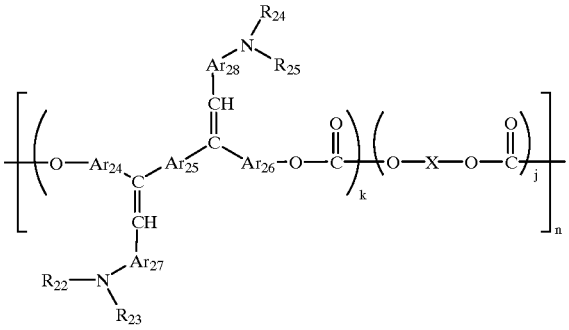

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (1).

(10)

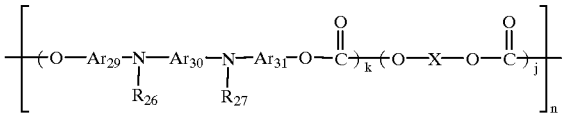

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (1).

The CTL 37 may include additives such as plasticizers and leveling agents. Specific examples of the plasticizers include known plasticizers, which are used for plasticizing resins, such as dibutyl phthalate, dioctyl phthalate and the like. The addition quantity of the plasticizer is 0 to 30% by weight of the binder resin included in the CTL 37.

Specific examples of the leveling agents include silicone oils such as dimethyl silicone oil, and methyl phenyl silicone oil; polymers or oligomers including a perfluoroalkyl group in their side chain; and the like. The addition quantity of the leveling agents is 0 to 1% by weight of the binder resin included in the CTL 37.

Next, the single-layered photosensitive layer 33 will be explained. The photosensitive layer 33 can be formed by coating a coating liquid in which a charge generation material, a charge transport material and a binder resin are dissolved or dispersed in a proper solvent, and then drying the coated liquid. In addition, the photosensitive layer 33 may include the charge transport material mentioned above to form a functionally-separated photosensitive layer. The photosensitive layer 33 may include additives such as plasticizers, leveling agents and antioxidants.

Suitable binder resins for use in the photosensitive layer 33 include the resins mentioned above for use in the CTL 37. The resins mentioned above for use in the CGL 35 can be added as a binder resin. In addition, the charge transport polymers mentioned above can also be used as a binder resin.

The content of the charge generation material is preferably from 5 to 40 parts by weight per 100 parts by weight of the binder resin included in the photosensitive layer 33. The content of the charge transport material is preferably from 0 to 190 parts, and more preferably from 50 to 150 parts by weight, per 100 parts by weight of the binder resin included in the photosensitive layer 33.

The single-layered photosensitive layer 33 can be formed by coating a coating liquid in which a charge generation material and a binder and optionally a charge transport material are dissolved or dispersed in a solvent such as tetrahydrofuran, dioxane, dichloroethane, cyclohexane, etc. by a coating method such as dip coating, spray coating, bead coating, and the like. The thickness of the photosensitive layer 33 is preferably from 5 to 100 $\mu$m.

In the photoreceptor for use in the present invention, an undercoat layer may be formed between the substrate 31 and the photosensitive layer (i.e., the photosensitive layer 33 in FIG. 10, the CGL 35 in FIGS. 11 and 13, and the CTL 37 in FIG. 12).

The undercoat layer includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method mentioned above for use in the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer. Other known undercoat layers can also be used.

The thickness of the undercoat layer is preferably 0 to 5 $\mu$m.

As shown in FIG. 13, in the photoreceptor for use in the present invention a protective layer 39 is optionally formed overlying the photosensitive layer (i.e., the photosensitive layer 33 in FIG. 10, the CTL 37 in FIG. 11 and the CGL 35 in FIG. 12) to protect the photosensitive layer.

Suitable materials for use in the protective layer 39 include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like.

In addition, a filler can be included in the protective layer 39 to improve the abrasion resistance of the protective layer 39. Specific examples of the fillers include fluorine-containing resins such as polytetrafluoroethylene, silicone resins, and complex fillers in which an inorganic filler such as titanium oxide, tin oxide, potassium titanate and silica or an organic filler is dispersed in a fluorine-containing resin or a silicone resin.

The protective layer 39 may include a charge transport material. This is effective for preventing increase of residual potential of the photoreceptor caused by forming a protective layer. Suitable charge transport materials include the materials mentioned above for use in the CTL 37. It is preferable that a positive hole transport material or an electron transport material is used depending on the charge polarity of the charger used in the image forming apparatus for which the photoreceptor is used, and the layer construction of the photoreceptor.

In addition, a charge transport polymer can be preferably used in the protective layer 39. The protective layer constituted of a charge transport polymer has good abrasion resistance and hole transportability. As the charge transport polymer, known charge transport polymers can be used. Particularly, the charge transport polymers having one of formulae (1)–(10) mentioned above are preferably used.

The protective layer 39 can be formed by any known coating method. The thickness of the protective layer is preferably from 0.1 to 10 $\mu$m. In addition, a layer of amorphous carbon or amorphous silicon carbide which is formed by a vacuum evaporation method can also be used as the protective layer. The above-mentioned additives such as plasticizers, leveling agents, antioxidants, etc. can also be used in the protective layer.

The advantages of a photoreceptor using a charge transport material and having good abrasion resistance are as follows:

(1) The Surface of the Photoreceptor Becomes Harder, and Therefore a Uniform Gap can be Maintained Even in Repeated use.

In the proximity charging device of the present invention, a gap is formed between the surface of the photoreceptor and the charger by contacting the gap forming member on the charger with the non-image portion of the photoreceptor. As mentioned above, it is preferable that one of the charger and the photoreceptor is pressed to the other using a mechanical force.

In this case, if the photoreceptor has a photosensitive layer such that a low molecular weight charge transport material (i.e., a non-polymer material) is dispersed in a binder resin, the surface of the photoreceptor deforms due to the large pressure applied to the photoreceptor by the gap forming members, and thereby there is a case in that the gap cannot be stably maintained. To the contrary, when a photoreceptor having a surface layer such as a CTL including a charge transport polymer a protective layer harder than the CTL or a protective layer including a filler is used, the surface of the photoreceptor can endure the pressure, and therefore the gap can be maintained more stably in repeated use.

(2) The Mechanical Durability of the Photoreceptor is Enhanced and Therefore a Uniform Gap can be Stably Maintained.

In the proximity charging device of the present invention, a gap is formed between the surface of the photoreceptor and the charger by contacting the gap forming member of the charger with the non-image portion of the photoreceptor. When the surface of the photoreceptor is subjected to a cleaning process, it is preferable that the non-image end portion is cleaned as well as the image forming portion. The reason is that as mentioned above residual toner particles tend to remain at the inside edges of the gap forming member in repeated use. In addition, when only the image forming portion is cleaned, only the image forming portion is abraded, resulting in widening of the gap.

In this case, if the photoreceptor has a surface having good abrasion resistance (for example, the photoreceptor has a surface layer such as a CTL including a charge transport polymer and a protective layer having a higher mechanical durability than the CTL is used), the photoreceptor can endure the stress applied by the cleaner and therefore a uniform gap can be stably maintained. In addition, to include a filler in the protective layer is advantageous because the mechanical durability of the photoreceptor can be further enhanced. When a filler is included in the protective layer, the charge transportability of the protective layer often deteriorates. This problem can be solved by including a charge transport material in the protective layer.

In the proximity charging device of the present invention, to apply a DC voltage overlapped with an AC voltage is very advantageous because charging can be stably performed. However, when a DC voltage overlapped with an AC voltage is showered on a photoreceptor, the photoreceptor tends to be jeopardized, resulting in increase of abrasion quantity of the photoreceptor compared to the case in which only a DC voltage is used. Accordingly, the life of the photoreceptor shortens although charging can be stably performed, resulting in trade-off between life and stable charging. When such a photoreceptor as mentioned above is used, such trade-off can be dissolved.

(3) The Durability of the Charger can be Improved.

As mentioned above, there is a limit for miniaturization in diameter of the photoreceptor because the life of the photoreceptor cannot be prolonged (in particular, the mechanical durability of the photoreceptor cannot be enhanced). Therefore there is a limit for miniaturization of the charger and image forming apparatus.

As a result of the investigation of the material and construction of the charger to enhance the durability thereof, the charger is typically constituted of an elastic rubber now. By using the proximity charging device of the present invention, the abrasion and the residual-toner-induced contamination of the charger in repeated use can be dramatically improved. Therefore the life of a charger does not depend on the abrasion and contamination now.

However, the deterioration of the materials used for chargers due to repeated charging is hardly improved. One of the reasons is that the diameter of the photoreceptor is much larger than that of the charger. For example, the diameters of a photoreceptor and a charger, which are typically used currently, are about 30 mm and 10 mm, respectively, to miniaturize the image forming apparatus and process cartridge. Currently, in order to effectively perform maintenance work, a charger and a photoreceptor are replaced with new ones at the same time. Therefore, the durability of the charger has to be three times that of the photoreceptor.

When the durability of the photoreceptor can be improved, the diameter of the photoreceptor can be shortened. Therefore, the ratio of the diameter of the photoreceptor to that of the charger decreases. When the diameter of the photoreceptor decreases, "charging area" can be reduced as mentioned below. When the charging area is reduced, deterioration of the charger due to discharging can be controlled. Therefore, it is possible to provide further miniaturized image forming apparatus and process cartridges.

In the proximity charging device of the present invention, discharging between the charger and the photoreceptor substantially accords with Paschen's law. Namely, when the rotating photoreceptor and charger approach or separate from each other, discharging occurs therebetween if the distance thereof is in a certain range. When the area of the charger (or the photoreceptor) in which discharging is performed at a time is referred to as "charging area", the larger the curvature of the charger (or the photoreceptor), i.e., the smaller the diameter of the charger, the less the charging area.

As a result of the present inventors' investigation, it is found that even when the diameter of the charger (or the photoreceptor) becomes small, the relationship between the applied voltage and the resultant potential of the photoreceptor is not changed although the quantity of generated reaction gasses such as ozone and NOx can be reduced. Namely, it is found that by decreasing the charging area, the quantity of generated reaction gasses can be reduced without deteriorating charging efficiency. Thus, by improving the abrasion resistance of a photoreceptor, the diameter of the photoreceptor can be decreased, and thereby the quantity of generated reaction gasses can be reduced. When the quantity of generated reaction gasses is reduced, deterioration of the charger and photoreceptor due to such reaction gasses can be improved, resulting in dramatically increase of the durability of the charger and the photoreceptor.

As mentioned above, to miniaturize a photoreceptor is advantageous in view of generation of reaction gasses and manufacturing costs. However, other members arranged around the photoreceptor have to be taken into consideration. For example, when such a small photoreceptor is used for very high speed image forming system, it should be considered whether the developing and transfer processes can be properly performed. Namely, in the developing section and the transfer section a certain region (i.e., nip width) at which the photoreceptor contacts the developing roller or transfer roller is needed. When the diameter of a photoreceptor becomes too small, a developing region and a transfer region having a desired width cannot be secured. Therefore, the diameter of the photoreceptor is preferably 10 to 40 mm, and more preferably from 15 to 30 mm.

According to Paschen's law, if the composition of the photosensitive layer of a photoreceptor is constant, the thinner the photosensitive layer, the more easily the photoreceptor can be charged. When a photoreceptor having good abrasion resistance is used, the photosensitive layer can be thinned and therefore the applied voltage can be decreased. Therefore, the stress to a charger can be reduced in repeated use, thereby decreasing chemical deterioration of the charger, resulting in improvement of durability of the charger. In addition, the voltage applied to a charger can be reduced, the quantity of generated reaction gasses such as ozone and NOx can be decreased, resulting in prevention of deterioration of the charger and the photoreceptor, and thereby the durability thereof can be improved.

(4) Image Qualities can be Improved.

When the abrasion resistance of a photoreceptor is improved, the photosensitive layer can be thinned. Therefore, the moving distance of the photo-carriers generated at the bottom of the photosensitive layer and moving toward the surface of the photosensitive layer can be decreased. Therefore, the possibility of diffusion of the photo-carriers decreases, and thereby an electrostatic latent image close to the light image can be formed. Namely, high resolution image can be formed.

In addition, as mentioned above, the quantity of reaction gasses can be reduced, and therefore the quantity of low resistance materials, which are formed on or adsorbed by the surface of a photoreceptor and which cause blurred images, can be reduced. Therefore, production of blurred images can be avoided. Therefore limitations to the image forming apparatus concerning operating environmental conditions considerably raised. In addition, it is unnecessary to use a drum heater for heating the photoreceptor. Therefore low-cost, compact and resource-saving image forming apparatus (i.e., office-environment-friendly image forming apparatus) can be provided.

In the photoreceptor for use in the first embodiment of the image forming apparatus of the present invention, an intermediate layer may be formed between the photosensitive layer (e.g., the CTL 37 in FIG. 13) and the protective layer 39. The intermediate layer is mainly constituted of a binder resin. Specific examples of such a binder resin include polyamides, alcohol-soluble nylons, water-soluble polyvinyl butyrals, polyvinyl butyrals, polyvinyl alcohols, etc. The intermediate layer can be formed by any known coating method. The thickness of the intermediate layer is preferably from 0.05 to 2 $\mu$m.

In order to improve the stability to withstand environmental conditions, in particular, to prevent deterioration of photosensitivity and increase of residual potential of the photoreceptor for use in the first embodiment of the image forming apparatus, antioxidants, plasticizers, lubricants, ultraviolet absorbents, low molecular weight charge transport materials and leveling agents may be included in each layer of the photoreceptor.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3', 5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3', 5'-di-t-butyl-4'-hydroxyphenyl)propionate]methane, bis[3, 3'-bis(4'-hydroxy-3'-t-butylphenyl) butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-containing Compounds dilauryl-3,3'-thiodipropionate, distearyl-3,3'-thiodipropionate, ditetradecyl-3,3'-thiodipropionate, and the like.

(e) Organic Phosphorus-containing Compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

In the photoreceptor for use in the first embodiment of the image forming apparatus of the present invention, the photosensitive layer (including the undercoat layer, intermediate layer and protective layer, if these layers are formed) is formed even on the non-image portions 3*a* and 3*b* as shown in FIG. 3. Namely, it is preferable that the gap forming members 41*a* and 41*b* contact the photosensitive layer (or protective layer).

The reason is that if there is no photosensitive layer, an electric leakage occurs between the gap forming members 41*a* and 41*b* and the electroconductive substrate 31, and therefore a large amount of toner adheres on the area, resulting in formation of background fouling at the edge portions of the photoreceptor. By forming photosensitive layer on these areas, this problem can be prevented.

The first embodiment of the image forming apparatus of the present invention will be explained in detail referring to drawings.

Figure 14:
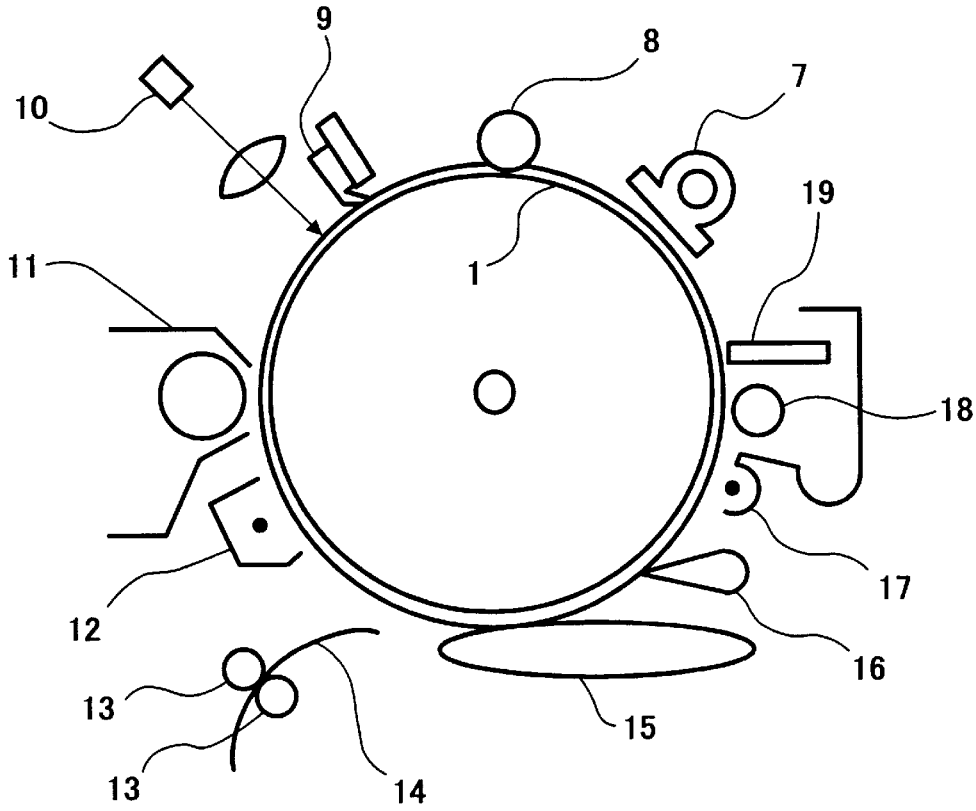
FIGS. 14 and 15 are schematic views illustrating embodiments of the image forming apparatus of the present invention.

FIG. 14 is a schematic view for explaining the first embodiment of the image forming apparatus of the present invention. The modified embodiments mentioned below are also included in the present invention.

In FIG. 14, a photoreceptor 1 includes at least a photosensitive layer formed on an electroconductive substrate. In this case, the photoreceptor 1 serves as an image bearing device. The photoreceptor 1 has a drum shape, but sheet photoreceptors or endless belt photoreceptors can also be used as mentioned below. A charging roller 8 is used for charging the photoreceptor 1. The structure of the charging roller 8 and the configuration of the charging roller 8 and the photoreceptor 1 are those as shown in FIGS. 1–4. When charging the photoreceptor 1, it is preferable that a DC voltage overlapped with an AC voltage is applied to the photoreceptor 1 by the charging roller 8, to uniformly charge the photoreceptor 1.

Around the photoreceptor 1, a discharger 7, the charging roller 8, an eraser 9, an imagewise light irradiator 10, a developing device 11, a pre-transfer charger 12, a transfer belt 15, a separation pick 16, and a cleaning unit including a pre-cleaning charger 17, a cleaning brush 18 and a cleaning blade 19 are arranged while contacting or being set closely to the photoreceptor. The toner image formed on the photoreceptor 1 is transferred onto a receiving paper 14 fed by a pair of registration rollers 13 at the transfer belt 15. The receiving paper 14 having the toner image thereon is separated from the photoreceptor 1 by the separating pick 12.

In the image forming apparatus of the present invention, known charging devices such as corotrons, scorotrons, solid state chargers and charging rollers are used for the pre-transfer charger 12, and the pre-cleaning charger 17.

As the transfer device, the above-mentioned chargers can be used. The transfer method using a transfer belt as shown in FIG. 14 can also preferably used.

Suitable light sources for use in the imagewise light irradiating device 10 and the discharger 7 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The above-mentioned lamps can be used for not only the processes mentioned above and illustrated in FIG. 14, but also other processes using light irradiation, such as a transfer process including light irradiation, a discharging process, a cleaning process including light irradiation and a pre-exposure process.

When the toner image formed on the photoreceptor 1 by the developing unit 11 is transferred onto the receiving paper 14, all of the toner image are not transferred on the receiving paper 14, and residual toner particles remain on the surface of the photoreceptor 1. The residual toner is removed from the photoreceptor 1 by the fur blush 18 and the cleaning blade 19. The residual toner remaining on the photoreceptor 1 can be removed by only a cleaning brush. Suitable cleaning blushes include known cleaning blushes such as fur blushes and mag-fur blushes.

When the photoreceptor 1 which is previously charged positively (or negatively) is exposed to imagewise light, an electrostatic latent image having a positive or negative charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

As the developing device 11, known developing devices can be used. In addition, as the discharger 7, known discharging devices can also be used.

Figure 15:
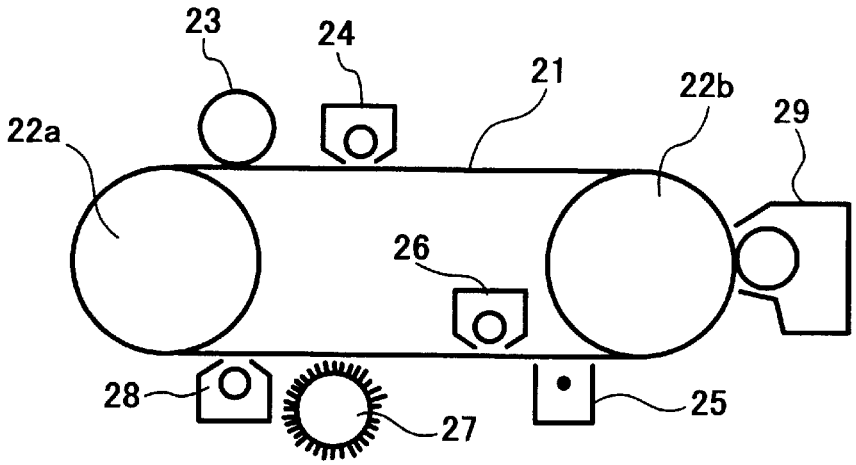

FIG. 15 is a schematic view illustrating another example of the first embodiment of the image forming apparatus of the present invention. A photoreceptor 21 includes at least an electroconductive substrate and a photosensitive layer formed thereon. The photoreceptor 21 has such a structure as shown in FIGS. 10–13. The photoreceptor 21 is rotated by driving and driven rollers 22*a* and 22*b*, and repeatedly subjected to a charging process using a charging roller, an imagewise irradiation process using a light source 24, a developing process using an image developer 29, a transfer process using a charger 25, and a pre-cleaning irradiation using a light source 28. In this case, the photoreceptor 21, the driving and driven rollers 22*a* and 22*b* serves as the image bearing device. In FIG. 15, imagewise irradiation is performed to the photoreceptor 21 from the substrate side thereof. In this case, the substrate is light transmissive.

The above-mentioned image forming apparatus is an example of the first embodiment of the image forming apparatus of the present invention. The first image forming apparatus of the present invention is not limited to the image forming apparatus as shown in FIG. 15. For example, although the pre-cleaning light irradiating operation can be performed from the substrate side of the photoreceptor 21 in FIG. 15, the operation may performed from the photosensitive layer side of the photoreceptor 21. In addition, the light irradiation in the imagewise irradiation process and the discharging process may be performed from the substrate side of the photoreceptor 21.

As the light irradiation processes, the imagewise irradiation process, pre-cleaning irradiation process, and discharging process are illustrated in FIG. 15. In addition, the photoreceptor 21 may also be subjected to a pre-transfer light irradiation process, which is performed before the transferring of the toner image, and a preliminary light irradiation process, which is performed before the imagewise irradiation process, and other light irradiation processes.

The above-mentioned image forming unit may be fixedly set in a copier, a facsimile or a printer. However, the image forming unit may be set therein as a process cartridge. The process cartridge is an image forming unit (or device) which includes a photoreceptor, a housing and at least one of a charger, an imagewise light irradiator, an image developer, an image transferer, a cleaner, and a discharger. The process cartridge of the present invention includes at least a photoreceptor, and a charger.

Figure 16:
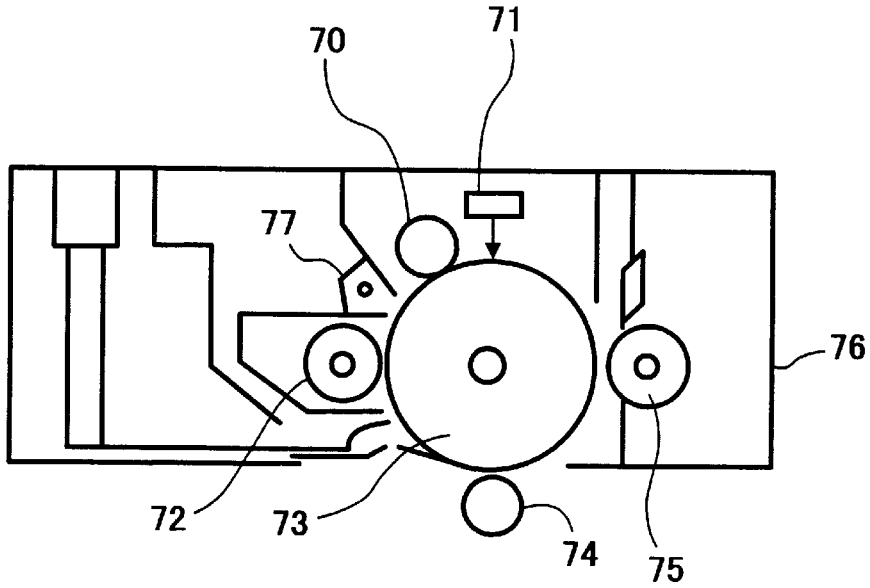
FIG. 16 is a schematic view illustrating an embodiment of the process cartridge of the present invention.

Various process cartridges can be used in the present invention. FIG. 16 is a schematic view illustrating an embodiment of the process cartridge of the present invention. In FIG. 16, the process cartridge includes a photoreceptor 73, and a charger 70, an imagewise light irradiator 71, a developing roller 75, a transfer roller 74, and a cleaning brush 72, which are arranged around the photoreceptor 73. Numerals 76 and 77 denote a housing and a discharger. In this case, the photoreceptor 73 serves as the image bearing device. The photoreceptor 73 has at least a photosensitive layer formed on an electroconductive substrate.

Second Embodiment of the Image Forming Apparatus of the Present Invention

Next, the second embodiment of the image forming apparatus of the present invention will be explained in detail referring to drawings.

As the charger for use in the second image forming apparatus, chargers similar to those (as shown in FIGS. 1 and 2) mentioned above for use in the first image forming apparatus of the present invention can be used. A gap forming member is provided on each end of the charger, which contacts a flange provided on each end of the photoreceptor. As the gap forming member, for example, gap forming members mentioned above for use in the first embodiment (i.e., the gap forming layers and gap forming materials) can be used.

Figure 17:
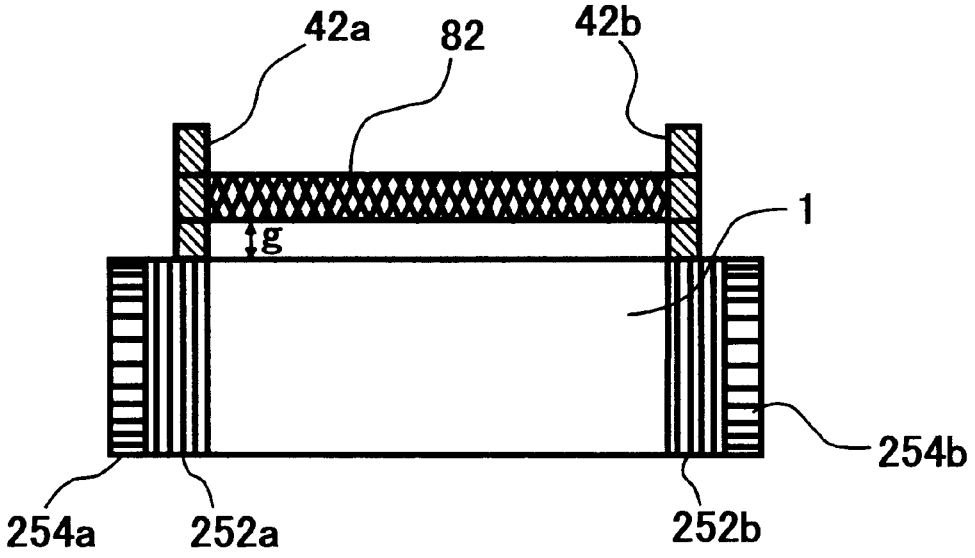
FIG. 17 is a schematic view illustrating another embodiment of configuration of the charger and the photoreceptor.

FIG. 17 illustrates the positional relationship between the photoreceptor and the charger. As illustrated in FIG. 17, gap forming layers 42*a* and 42*b* contact flanges 252*a* and 252*b* provided on the each end of the photoreceptor 1, respectively. Since a photoreceptor 1 and a charger 82 contact at these end portions, a gap is formed therebetween. Therefore the charger 82 charges photoreceptor 1 while not contacting the photoreceptor 1. Needless to say, the charger is longer than the image forming portion of the photoreceptor 1. Numerals 254*a* and 254*b* denote flange gears.

FIG. 18 illustrates the positional relationship between the image forming portion of the photoreceptor and the gap forming member of the charger. In this embodiment, this positional relationship is very important.

Namely, it is important that as shown in FIG. 18 an inside edge GEa (or GEb) of the gap forming member 42*a* (or 42*b*) is located outside of an end PEa (or PEb) of the image forming portion 2 of the photoreceptor 1. The distance t between the inside edge GEa (or GEb) of the gap forming member 42*a* (or 42*b*) and the end PEa (or PEb) of the image forming portion 2 is preferably not less than twice the gap g formed between the photoreceptor 1 and the charger 82. When the distance t is too short, the above-mentioned problems tend to occur. To the contrary, when the distance t is too long, the charger needs to be lengthen, and thereby the image forming apparatus becomes large in size. In addition, when the distance t is too long, large charging noise are generated. When a DC voltage overlapped with an AC voltage is applied to the photoreceptor 1 by the charger 82 to stably perform charging, the shorter the distance t, the less the charging noise. Therefore, it is preferable that the distance t is not greater than 100 times the gap g or not greater than 10 mm.

Suitable materials for use as the rotating shaft, the electroconductive elastic material and the resistance controlling layer of the charger 82 includes the materials mentioned above for use in the charger 81 for use in the first embodiment.

In the second embodiment, the gap forming layers or gap forming materials mentioned above for use in the first embodiment can be used as the gap forming members 42*a* and 42*b*.

The material of the gap forming layers 42*a* and 42*b* is not particularly limited, but the gap forming layers 261*a* and 261*b* are preferably made from a material having good abrasion resistance because they are rubbed with the flanges when image forming operations are preformed. Therefore, materials having a good film formability, such as engineering plastics are preferably used. Specific examples of such materials include polyamides, polyurethanes, epoxy resins, polyketones, polycarbonates, silicone resins, acrylic resins, polyvinyl butyrals, polyvinyl formals, polyvinyl ketones, polystyrene, polysulfones, poly-N-vinylcarbazole, polyacrylamide, polyvinyl benzal, polyesters, phenoxy resins, vinyl chloride-vinyl acetate copolymers, polyvinyl acetate, polyphenylene oxide, polyvinyl pyridine, cellulose resins, casein, polyvinyl alcohols, polyvinyl pyrrolidone, etc.

In addition, in order to reduce the friction coefficient of the gap forming layers 42*a* and 42*b*, materials in which the above-mentioned materials are modified by fluorine or silicon or materials in which a fluorine-containing resin or a silicone resin is dispersed can be preferably used. Further, a filler can be included in the gap forming layers 42*a* and 42*b* to improve the abrasion resistance thereof.

In order to stably charge only the image forming portion of the photoreceptor 1, at least one member of the gap forming layer and the flange is preferably made of an insulating material. In this case, the insulating material is defined as a material having a resistance higher than the surface of the charger 82, i.e., a resistance higher than $10^{10}$ Ω·cm.

The gap forming layers 42*a* and 42*b* for use in the second embodiment can be formed by any one of the methods mentioned above for use in the first embodiment.

Similarly to the first embodiment, the gap forming members 42*a* and 42*b* may be constituted of an insulating gap forming material.

Then the insulating gap forming materials 42*a* and 42*b* will be explained briefly.

The material of the gap forming materials 42*a* and 42*b* is not particularly limited, but the gap forming materials 42*a* and 42*b* are preferably made from a material having good abrasion resistance because they are rubbed with the flanges when image forming operations are preformed. Therefore, materials having a good film formability, such as engineering plastics mentioned above are preferably used.

In addition, in order to reduce the friction coefficient of the gap forming materials 42*a* and 42*b*, materials in which the above-mentioned materials are modified by fluorine or silicon or materials in which a fluorine-containing resin or a silicone resin is dispersed can be preferably used. Further, a filler can be included in the gap forming layers 42*a* and 42*b* to improve the abrasion resistance thereof.

In order to stably charge only the image forming portion of the photoreceptor 1, at least one member of the gap forming material and the flange is preferably made of an insulating material. In this case, the insulating material is defined as a material having a resistance higher than the surface of the charger 82, i.e., a resistance higher than $10^{10}$ Ω·cm.

As the gap forming materials 42*a* and 42*b*, any materials having a gap maintaining function can be used. As the gap forming method, the methods mentioned above for use in the first embodiment of the image forming apparatus can be used.

In this embodiment, when gap forming materials 42*a*n and 42*b* have a seam, the gap forming material having a seam 40 as shown in FIGS. 5A and 5B are preferably used similarly to the first embodiment.

For the reasons mentioned above in the case of the gap forming layers 41*a* and 41*b*, the thickness of the gap forming materials 42*a* and 42*b* is preferably from 10 to 200 μm in the second embodiment.

In the present invention, it is very important to control the gap g between the charger 82 and the photoreceptor 1. By using the gap forming layers or the gap forming materials, the gap g can be controlled so as not become narrower than a predetermined value. Various methods can be used for controlling the gap so as not become wider than a predetermined value.

Figure 19:
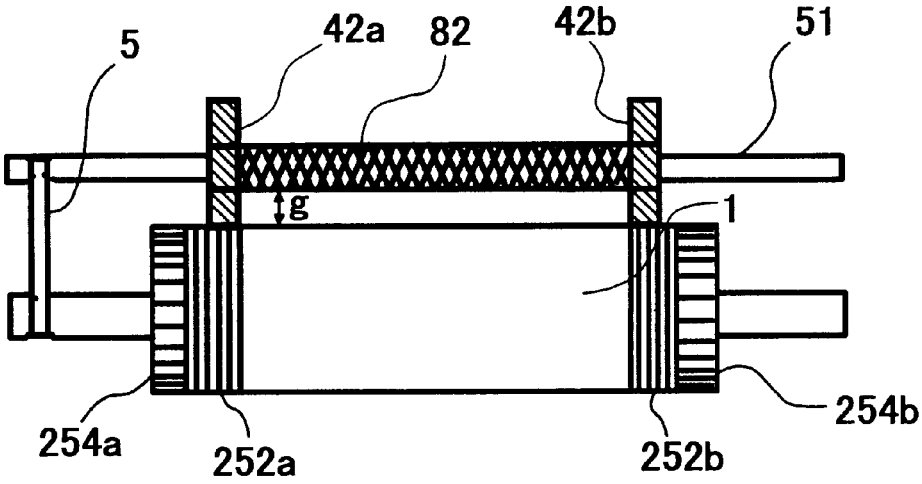
FIGS. 19 and 20 are a schematic view and a side view illustrating another embodiment of configuration of the charging roller and the photoreceptor.
Figure 20:
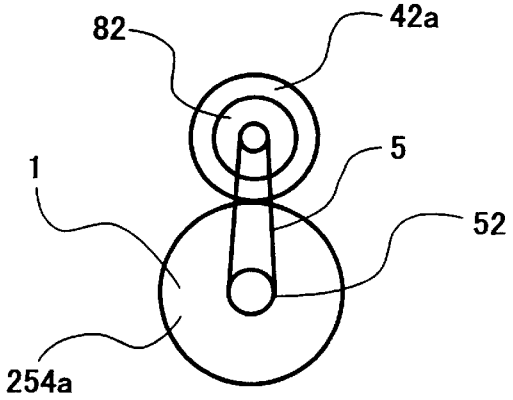
Figure 21:
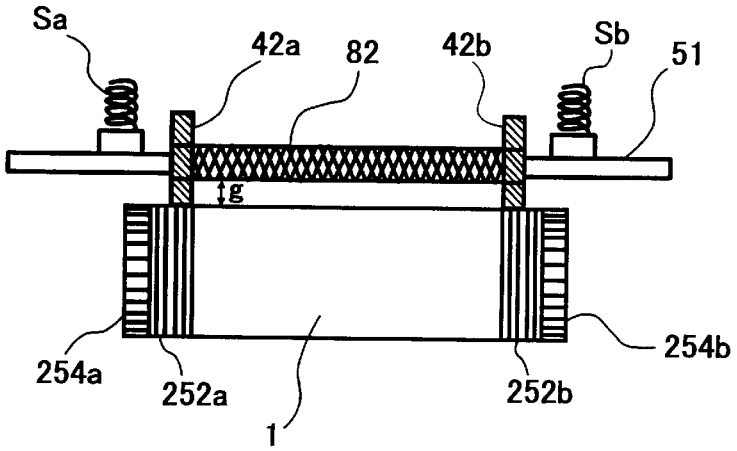
FIGS. 21 and 22 are schematic views illustrating other embodiments of configuration of the charging roller and the photoreceptor.
Figure 22:
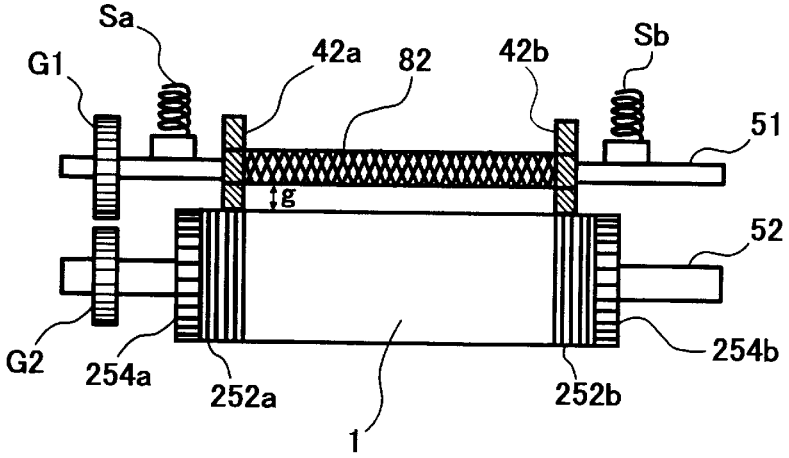

In the second embodiment, the rotating shafts of the charger and the photoreceptor can be fixed using a ring member 5 as shown in FIGS. 19 and 20. In addition, as shown in FIG. 21, a method in which the charger is pressed toward the photoreceptor 1 by applying a pressure to the rotating shaft 51 of the charger 82 using springs Sa and Sb. Further, as shown in FIG. 22, it is preferable that the charger and the photoreceptor are independently rotated by arranging, for example, gears G1 and G2, couplings and a belt on the shafts 51 and 52 of the charger and the photoreceptor.

As the photoreceptor for use in the second embodiment of the image forming apparatus of the present invention, the photoreceptors mentioned above for use in the first embodiment can also be used. Namely, the photoreceptors having constructions as shown in FIGS. 10–13 can be used.

In addition, the image forming apparatus mentioned above in the first embodiment of the present invention can also be used in the second embodiment. Similarly to the first embodiment, the image forming apparatus can be fixed in a copier, a facsimile machine or a printer, or may be incorporated as a process cartridge.

As the flanges 252*a* and 252*b* for use in the second embodiment, known flanges can be used. The material and shape of the flanges are not particularly limited if the flanges have the function of the flanges 252*a* and 252*b*. Specific examples of the material for use as the flanges 252*a* and 252*b* include metal flanges and plastic flanges. Specific examples of the plastics for use in the plastic flanges include polyvinyl acetate, ABS (acrylonitrile-butadiene-styrene) resins, polycarbonate resins, etc. Any known additives can be included in the plastic flanges if the additives do not adversely affect the image forming operations of the image forming apparatus. Suitable additives for use in the plastic flanges include releasing agents, antioxidants, colorants, etc.

Third Embodiment of the Image Forming Apparatus of the Present Invention

Next, the third embodiment of the image forming apparatus of the present invention will be explained referring to drawings.

The charger for use in the third embodiment is similar to those mentioned above for use in the first and second embodiments except that the gap forming members are part of the surface layer of the charger. Namely, a charger having a gap forming members, which are part of the surface layer of the charger and which are to be contacted with non-image portions of a photoreceptor or flanges provided on both end portions of a photoreceptor, is used.

Figure 23:
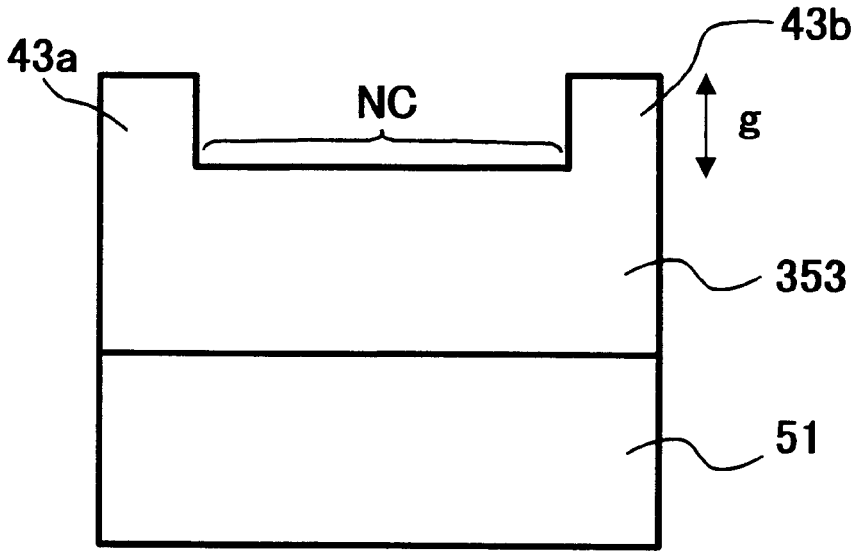
FIGS. 23 and 24 are schematic views illustrating cross-sections of other embodiments of the charging rolelr for use in the image forming apparatus of the present invention.

FIG. 23 illustrates the cross-section of an example of the charger for use in the third embodiment of the image forming apparatus. In FIG. 23, an electroconductive elastic material 353 is formed on a rotating shaft 51 (e.g., a metal shaft), and projected portions 43*a* and 43*b*, which serve as the gap forming member, are formed on both end portions of the electroconductive elastic material 353. The gap forming portions 43*a* and 43*b* are to be contacted with the non-image portions of a photoreceptor to form a gap between the charger and the photoreceptor.

Figure 24:
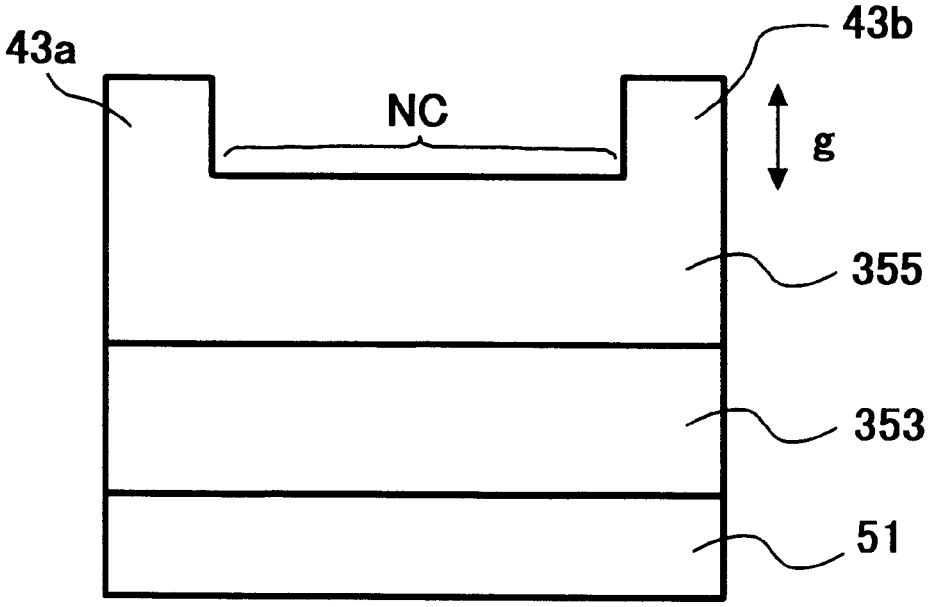

FIG. 24 illustrates the cross-section of another example of the charger for use in the third embodiment of the image forming apparatus. In FIG. 24, an electroconductive elastic material 353 and a resistance controlling layer 355 are formed on a rotating shaft 51 in this order, and projected portions 43*a* and 43*b*, which serve as the gap forming member, are formed on both end portions of the resistance controlling layer 355. The gap forming portions 43*a* and 43*b* are to be contacted with the non-image portions of a photoreceptor to form a gap between the charger and the photoreceptor.

FIG. 25 illustrates the positional relationship between the image forming portion of the photoreceptor and the gap forming members of the charger in the third embodiment. In the present invention, this positional relationship is very important.

Namely, it is important that as shown in FIG. 25 an inside edge GEa (GEb) of the gap forming portion 43*a* (43*b*) is located outside an end PEa (PEb) of the image forming portion 2 of the photoreceptor 1. The distance t between the inside edge GEa (GEb) of the gap forming portion 43*a* (43*b*) and the end PEa (PEb) of the image forming portion 2 is preferably not less than twice the gap g formed between the photoreceptor 1 and the charger 83. It is preferable that the distance t is not greater than 100 times the gap g or not greater than 10 mm for the reasons mentioned above in the first embodiments. Character NC denotes a non-contacting portion of the charger which charges the photoreceptor 1 while not contacting the photoreceptor 1.

Suitable materials for use as the rotating shaft 51 include metals such as iron, copper, brass and stainless steals. Suitable materials for use as the electroconductive elastic materials 353 include compositions in which an electroconductive powder or an electroconductive fiber (e.g., carbon black, metal powders, carbon fibers, etc.) is dispersed in a synthetic rubber. When a resistance controlling layer is formed on the surface of the charger 83, the resistance controlling layer 355 preferably has a resistance of from $10^5$ to $10^7$ Ω·cm. When the resistance controlling layer 355 is not formed, the resistance of the electroconductive elastic materials 353 (i.e., the surface layer) preferably has a resistance of from about $10^9$ to about $10^{10}$ Ω·cm.

Suitable materials for use in the resistance controlling layer 355 include synthetic resins such as polyethylene, polyesters and epoxy resins; synthetic rubbers such as etylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

Then the surface of the thus prepared charger is mechanically cut such that the gap forming portions 43*a* and 43*b* and the non-contacting portion NC are formed. By using this charging roller 83, a gap can be formed between the charger 83 and the photoreceptor 1 as shown in FIG. 25. Suitable methods for forming the non-contacting portion NC include known methods such as cutting methods using a bite; polishing methods using a grinder, an emery paper or the like; surface polishing methods using an abrasive; etc.

In the present invention, it is very important to control the gap g between the charger 83 and the photoreceptor 1 such that the gap does not so widen. Similarly to the first embodiment, it is preferable that the rotating shafts of the charger and the photoreceptor are fixed while they contact each other. Specifically, the charger 83 and the photoreceptor 1 are fixed using a ring member 5 as shown in FIGS. 6 and 7. In addition, as shown in FIG. 8, a method in which the charger is pressed toward the photoreceptor 1 by applying a pressure to the rotating shaft of the charger 83 using springs Sa and Sb. Further, as shown in FIG. 9, it is preferable that the charger 83 and the photoreceptor 1 are independently rotated by arranging, for example, gears G1 and G2, couplings or belts on the shafts of the charger 83 and the photoreceptor 1.

Similarly to the first and second embodiments, when charging the photoreceptor, a DC voltage overlapped with an AC voltage is preferably applied to the charger to avoid uneven charging.

As the photoreceptor for use in the third embodiment of the image forming apparatus of the present invention, the photoreceptors mentioned above for use in the first and second embodiments can also be used. Namely, the photoreceptors having constructions as shown in FIGS. 10–13 can be used.

In addition, the image forming apparatus mentioned above for use in the first and second embodiments of the present invention can also be used in the third embodiment. Similarly to the first and second embodiments, the image forming apparatus can be fixed in a copier, a facsimile machine or a printer, or may be incorporated as a process cartridge.

Fourth Embodiment of the Image Forming Apparatus of the Present Invention

The fourth embodiment of the image forming apparatus of the present invention will be explained in detail referring to drawings.

As the charger for use in the fourth embodiment, chargers similar to that mentioned above for use in the third embodiment can be used. Namely, a charger having gap forming members, which are part of the surface layer of the charger and which are to be contacted with flanges provided on both end portions of a photoreceptor, is used.

The charger for use in the fourth embodiment has a construction as shown in FIGS. 23 and 24. Namely, an electroconductive elastic material is formed on a rotating shaft (e.g., a metal shaft), and projected portions serving as the gap forming members (hereinafter referred to as gap forming portions), are formed on both end portions of the electroconductive elastic material as part of the elastic layer. The gap forming portions are to be contacted with the non-image end portions of a photoreceptor to form a gap between the charger and the photoreceptor.

Alternatively, the charger has an electroconductive elastic material and a resistance controlling layer formed on a rotating shaft in this order, and projected portions (hereinafter referred to as gap forming portions) formed on both end portions of the resistance controlling layer as part of the resistance controlling layer.

Figure 26:
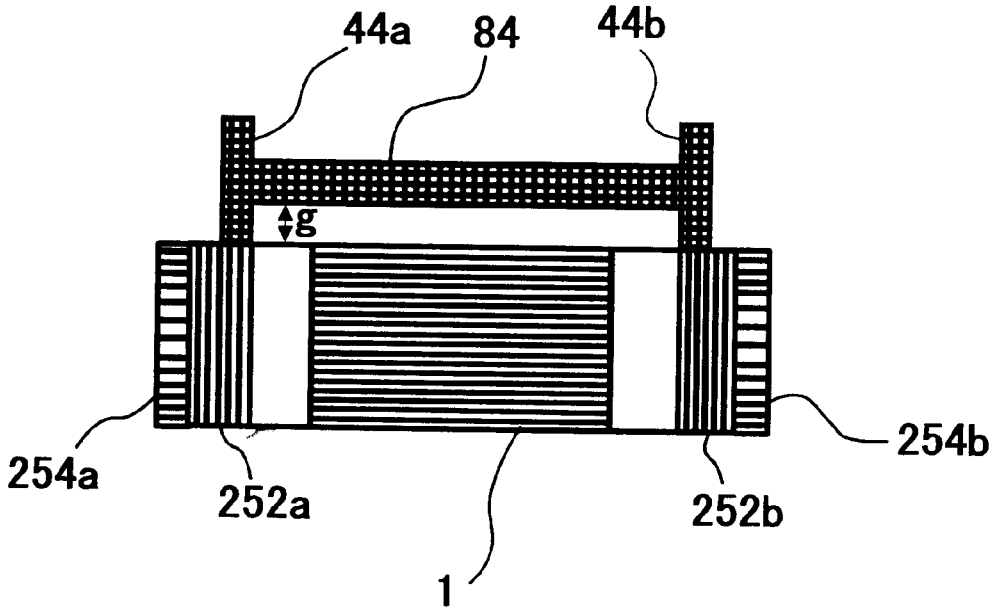
FIG. 26 is a schematic view illustrating another embodiment of configuration of the charging roller and the photoreceptor.

FIG. 26 illustrates the positional relationship between the charger 84 and the photoreceptor 1. As shown in FIG. 26, the gap forming portions 44*a* and 44*b* of the charger 84 contact flanges 252*a* and 252*b* provided on both ends of the photoreceptor 1. Numerals 254*a* and 254*b* denote flange gears. Since the photoreceptor 1 and the charger 84 contact only at the contact points between the flanges 252*a* and 252*b* with the gap forming portions 44*a* and 44*b*, a gap is formed between the surface of the charger 84 and the surface of the photoreceptor 1. Therefore, the charger 84 charges the photoreceptor 1 while not contacting the photoreceptor 1.

Figure 27:
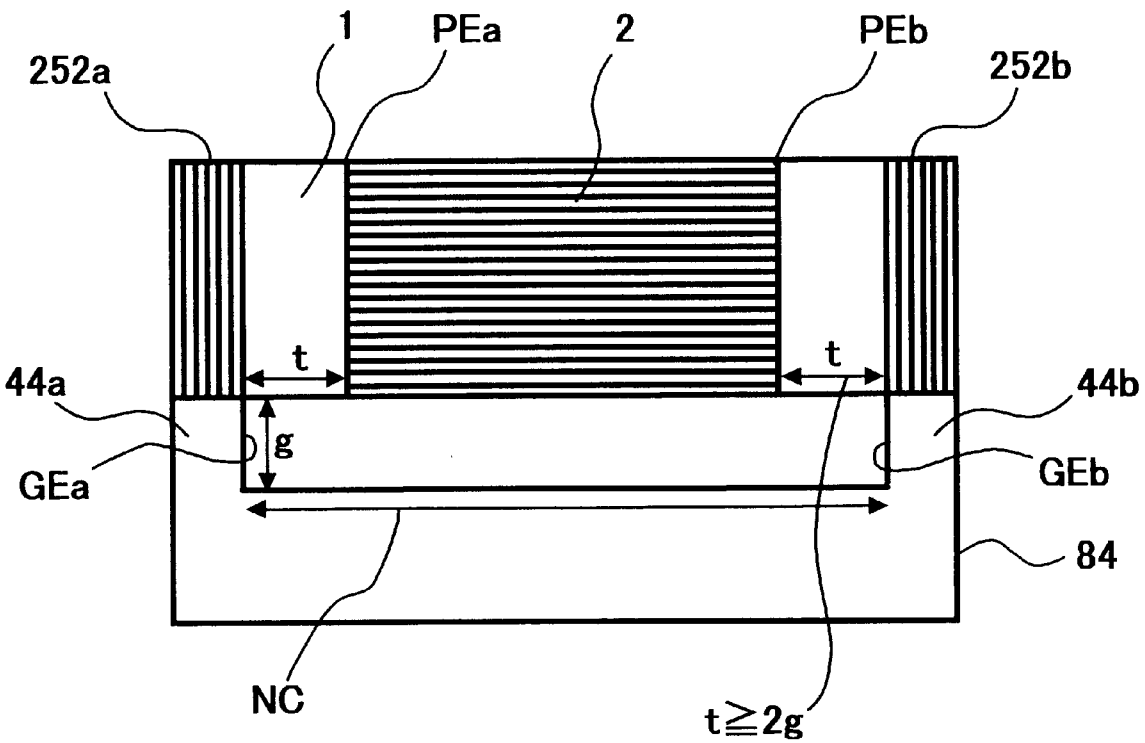
FIG. 27 is a schematic view illustrating another embodiment of the positional relationship between the charging roller and the photoreceptor.

FIG. 27 illustrates the positional relationship between the image forming portion of the photoreceptor and the gap forming members of the charger in the fourth embodiment. In the present invention, this positional relationship is very important.

Namely, it is important that as shown in FIG. 27 an inside end GEa (GEb) of the gap forming portion 44*a* (44*b*) is located outside an end PEa (PEb) of the image forming portion 2 of the photoreceptor 1. The distance t between the inside edge GEa (GEb) of the gap forming portion 44*a* (44*b*) and the end PEa (PEb) of the image forming portion 2 is preferably not less than twice the gap g formed between the photoreceptor 1 and the charger 84. It is preferable that the distance t is not greater than 100 times the gap g or not greater than 10 mm for the reasons mentioned above in the first embodiment. Character NC denotes a non-contacting portion of the charger 84 which charges the photoreceptor 1 while not contacting the photoreceptor 1.

Suitable materials for use as the rotating shaft of the charger include metals such as iron, copper, brass and stainless steals. Suitable materials for use as the electroconductive elastic materials of the charger 84 include compositions in which an electroconductive powder or an electroconductive fiber (e.g., carbon black, metal powders, carbon fibers, etc.) is dispersed in a synthetic rubber. When a resistance controlling layer is formed on the surface of the charger 84 as shown in FIG. 24, the resistance controlling layer preferably has a resistance of from $10^3$ to $10^8$ Ω·cm. When the resistance controlling layer is not formed, the resistance of the electroconductive elastic material (i.e., the surface layer) preferably has a resistance of from about $10^4$ to about $10^{10}$ Ω·cm.

Suitable materials for use in the resistance controlling layer include synthetic resins such as polyethylene, polyesters and epoxy resins; synthetic rubbers such as etylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

Suitable methods for forming the gap forming portions 44*a* and 44*b* include any known methods. For example, methods in which the surface layer of the charger is formed so as to be slightly thick by the thickness corresponding to the thickness of the gap forming portions (i.e., by the gap g), and then the non-contacting portion NC of the surface layer is cut or polished can be typically used.

For the reasons mentioned above in the first embodiment, the thickness of the gap forming portions 44*a* and 44*b* is preferably from 10 to 200 μm in this embodiment, and more preferably from 20 to 100 μm.

In the present invention, it is very important to control the gap g between the charger 84 and the photoreceptor 1. Similarly to the first embodiment, it is preferable that the rotating shafts of the charger and the photoreceptor are fixed while they contact each other. Specifically, the charger 84 and the photoreceptor 1 are fixed using a ring member 5. In addition, similarly to the third embodiment, a method in which the charger is pressed toward the photoreceptor 1 by applying a pressure to the rotating shaft of the charger using springs can be used. Further, it is preferable that the charger and the photoreceptor are independently rotated by arranging, for example, gears, couplings or belts on the shafts of the charger and the photoreceptor.

Similarly to the first to third embodiments, when charging the photoreceptor, a DC voltage overlapped with an AC voltage is preferably applied to the charger to avoid uneven charging.

As the flanges 252*a* and 252*b*, known flanges can be used. The material and shape of the flanges are not particularly limited if the flanges have the function of the flanges 252*a* and 252*b*. Specific examples of the material for use as the flanges 252*a* and 252*b* are mentioned above in the second embodiment. In addition, any known additives can be included in the plastic flanges if the additives do not adversely affect the image forming operations of the image forming apparatus. Suitable additives for use in the plastic flanges include releasing agents, antioxidants, colorants, etc.

When the resistance of the flanges 252*a* and 252*b* is too low, a problem tends to occur in that an electric leakage occurs between the charger and the photoreceptor. Therefore, the flanges 252*a* and 252*b* are preferably made of an insulating material having a resistance not lower than $10^{10}$ Ω·cm. In this case, the flanges 252*a* and 252*b* may have a construction such that only the areas thereof, which contact the gap forming member of the charger, may be formed of an insulating material.

As the photoreceptor for use in the fourth embodiment of the image forming apparatus of the present invention, the photoreceptors mentioned above for use in the first, second and third embodiments can also be used. Namely, the photoreceptors having constructions as shown in FIGS. 10–13 can be used.

In addition, the image forming apparatus mentioned above for use in the first to third embodiments of the present invention can also be used in the fourth embodiment. Similarly to the first to third embodiments, the image forming apparatus can be fixed in a copier, a facsimile machine or a printer, or may be incorporated as a process cartridge.

Fifth Embodiment of the Image Forming Apparatus of the Present Invention

The charger for use in the fifth embodiment of the image forming apparatus of the invention will be explained referring to drawings, but the construction of the charger is not limited thereto and known chargers can be used if the chargers have the function of the charger for use in the present invention.

The charger for use in the fifth embodiment has a construction as shown in FIG. 1 or 2.

Figure 28:
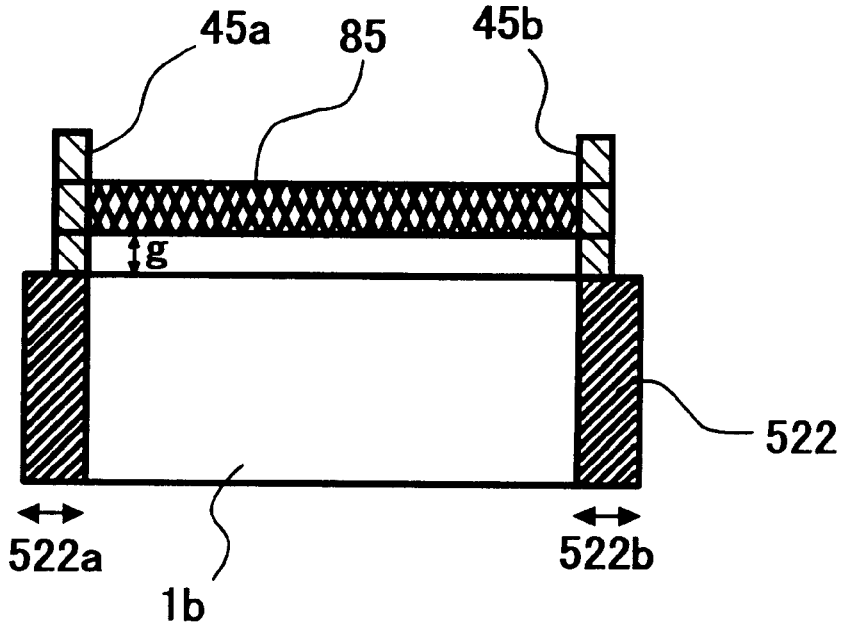
FIGS. 28 and 29 are a schematic view and a side view illustrating another embodiment of configuration of the charging roller and the photoreceptor.
Figure 29:
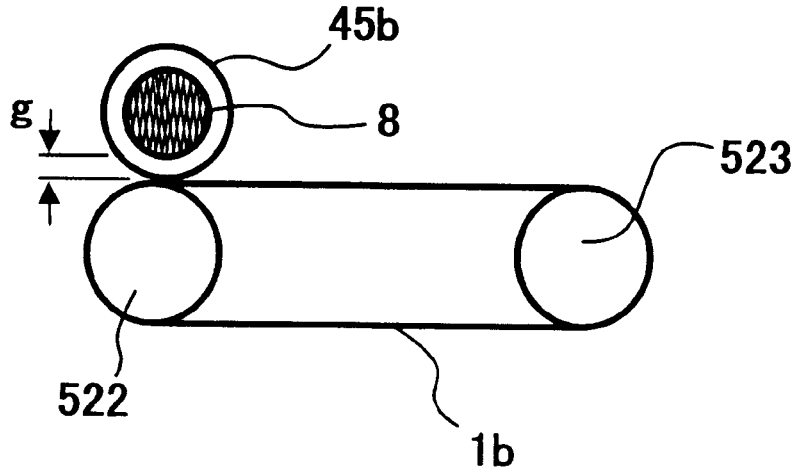

FIGS. 28 and 29 illustrate the positional relationship between the charger and the photoreceptor. As shown in FIGS. 28 and 29, the gap forming members 45*a* and 45*b* of the charger 85 contact extended portions 522*a* and 522*b* of a driving roller (or a driven roller) 522 which supports and drives a belt-shaped photoreceptor 1*b*. Since the charger 85 contacts only at the contact points between the gap forming members 45*a* and 45*b* and the extended portions 522*a* and 522*b* of the driving (or driven) roller 522, a gap is formed between the surface of the charger 85 and the surface of the photoreceptor 1*b*. Therefore, the charger 85 charges the photoreceptor 1*b* while not contacting the photoreceptor 1*b*. In this case, the non-contacting portion of the charger is longer than the width of the photoreceptor 1*b*.

FIG. 30 illustrates the positional relationship between the image forming portion of the belt-shaped photoreceptor and the gap forming members of the charger in the fifth embodiment. In the present invention, this positional relationship is very important.

Namely, it is important that as shown in FIG. 30 an inside end GEa (GEb) of a gap forming layer 45*a* (45*b*) serving as the gap forming member is located outside an end PEa (PEb) of the image forming portion 2 of the photoreceptor 1*b*. The distance t between the inside edge GEa (GEb) of the gap forming layer 45*a* (45*b*) and the end PEa (PEb) of the image forming portion 2 is preferably not less than twice the gap g formed between the photoreceptor 1*b* and the charger 85. It is preferable that the distance t is not greater than 100 times the gap g or not greater than 10 mm for the reasons mentioned above in the first embodiment. A character NC denotes a non-contacting portion of the charger 85 which charges the photoreceptor 1*b* while not contacting the photoreceptor 1*b*.

Suitable materials for use as the rotating shaft of the charger 85 include metals such as iron, copper, brass and stainless steals. Suitable materials for use as the electroconductive elastic materials of the charger 85 include compositions in which an electroconductive powder or an electroconductive fiber (e.g., carbon black, metal powders, carbon fibers, etc.) is dispersed in a synthetic rubber. When a resistance controlling layer is formed on the surface of the charger 85, the resistance controlling layer 555 preferably has a resistance of from $10^3$ to $10^8$ Ω·cm. When the resistance controlling layer is not formed, the resistance of the electroconductive elastic material (i.e., the surface layer) preferably has a resistance of from about $1^4$ to about $10^{10}$ Ω·cm.

Suitable materials for use in the resistance controlling layer of the charger 85 include synthetic resins such as polyethylene, polyesters and epoxy resins; synthetic rubbers such as etylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

The gap forming layers mentioned above for use in the first embodiment can be used as the gap forming members in the fifth embodiment. Hereinafter the gap forming members 45*a* and 45*b* are sometimes referred to as gap forming layers.

The material of the gap forming layers 45*a* and 45*b* is not particularly limited, but the gap forming layers 45*a* and 45*b* are preferably made from a material having good abrasion resistance because they are rubbed with the driving roller (or the driven roller) 522 when image forming operations are preformed. Therefore, materials having a good film formability, such as engineering plastics mentioned above for use in the gap forming layers 41*a* and 41*b*.

In addition, in order to reduce the friction coefficient of the gap forming layers 45*a* and 45*b*, materials in which the above-mentioned materials are modified by fluorine or silicon or materials in which a fluorine-containing resin or a silicone resin is dispersed can be preferably used. Further, a filler can be included in the gap forming layers 45*a* and 45*b* to improve the abrasion resistance thereof.

In order to stably charge only the image forming portion of the photoreceptor 1*b*, at least one member of the gap forming member (i.e., the gap forming layers 45*a* and 45*b*) and the driving roller (or driven roller) 522 is preferably made of an insulating material having a resistance higher than $10^{10}$ Ω·cm.

The gap forming layers 45*a* and 45*b* for use in the fifth embodiment can be formed by any one of the methods mentioned above for use in the first embodiment.

In the fifth embodiment, the gap forming materials for use in the first embodiment can also be formed on the charger 85 as the gap forming members 45*a* and 45*b*. Hereinafter the gap forming members 45*a* and 45*b* are sometimes referred to as gap forming materials.

The material of the gap forming materials 45*a* and 45*b* is not particularly limited, but the gap forming materials 45*a* and 45*b* are preferably made from a material having good abrasion resistance because they are rubbed with the driving roller 522 (or the driven roller 522) when image forming operations are preformed. Therefore, materials having a good film formability, such as engineering plastics mentioned above for use in the gap forming materials 41*a* and 41*b* in the first embodiment.

In addition, in order to reduce the friction coefficient of the gap forming materials 45*a* and 45*b*, materials in which the above-mentioned materials are modified by fluorine or silicon or materials in which a fluorine-containing resin or a silicone resin is dispersed can be preferably used. Further, a filler can be included in the gap forming materials 45*a* and 45*b* to improve the abrasion resistance thereof.

In order to stably charge only the image forming portion of the photoreceptor 1*b*, at least one member of the gap forming member (i.e., the gap forming materials 45*a* and 45*b*) and the driving roller (or driven roller) 522 is preferably made of an insulating material having a resistance higher than $10^{10}$ Ω·cm.

The gap forming materials 45*a* and 45*b* for use in the fifth embodiment can be formed by any one of the methods mentioned above for use in the first embodiment. In addition, as the gap forming materials 45*a* and 45*b*, any materials having a gap maintaining function can be used.

In the fifth embodiment, when the gap forming materials 45*a* and 45*b* have a seam, the gap forming materials having a seam 40 as shown in FIGS. 5A and 5B are preferably used similarly to the first embodiment.

For the reasons mentioned above in the first embodiment (the gap forming layers 41*a* and 41*b*), the thickness of the gap forming layers or the gap forming materials is preferably from 10 to 200 μm, and preferably from 20 to 100 μm, in the fifth embodiment.

Similarly to the first to fourth embodiment, when charging the photoreceptor, a DC voltage overlapped with an AC voltage is preferably applied to the charger to avoid uneven charging in the fifth embodiment.

As the driving (or driven) roller 522 for use in the fifth embodiment, known rollers can be used regardless of the materials and shapes thereof if the rollers satisfy the requirements for the roller 522. Suitable rollers for use as the roller 522 include metal rollers and plastic rollers. When the roller 522 needs to be insulating, metal rollers coated with an insulating material, or metal rollers in which the portions to be contacted with the gap forming members are made of a plastic can be preferably used.

Figure 31:
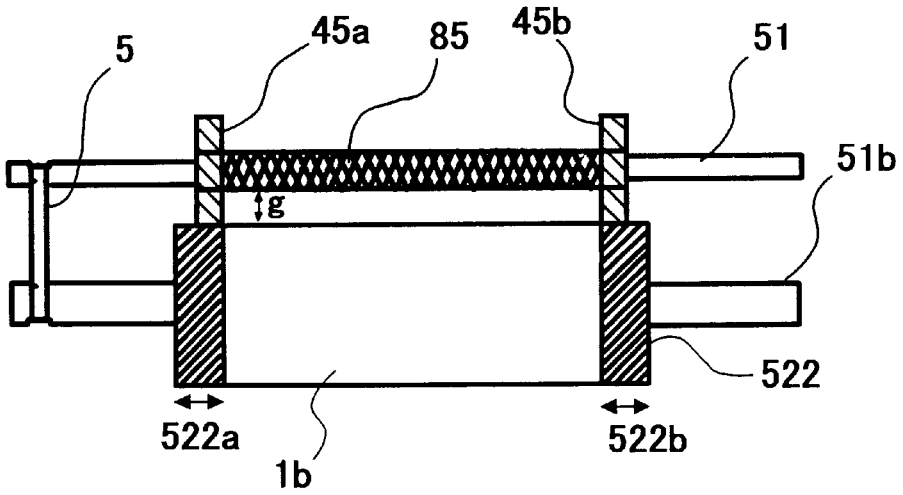
FIGS. 31 and 32 are a schematic view and a side view illustrating another embodiment of configuration of the charging roller and the photoreceptor.
Figure 32:
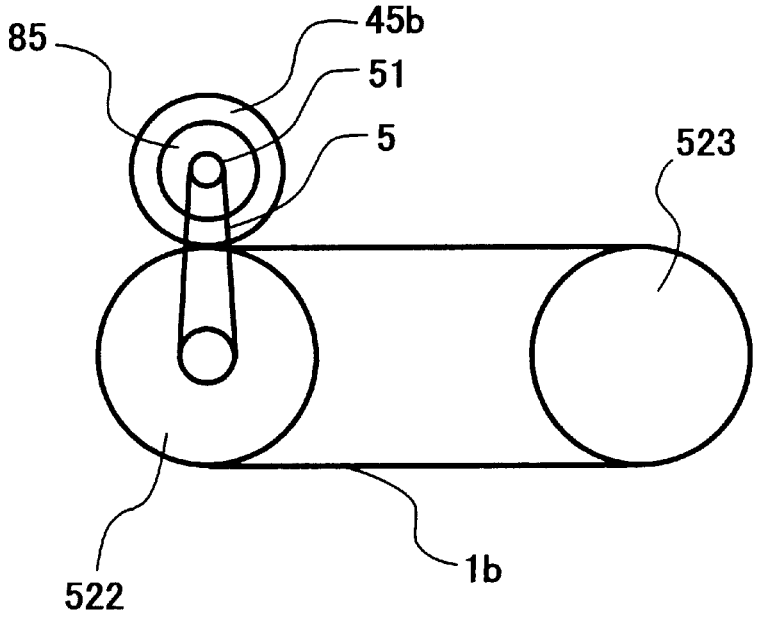
Figure 33:
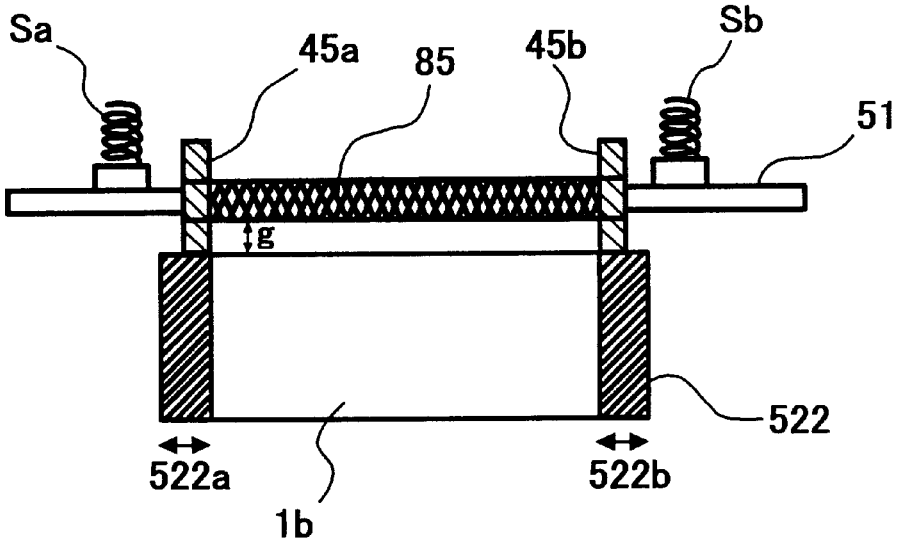
FIGS. 33 and 34 are schematic views illustrating other embodiments of configuration of the charging roller and the photoreceptor.
Figure 34:
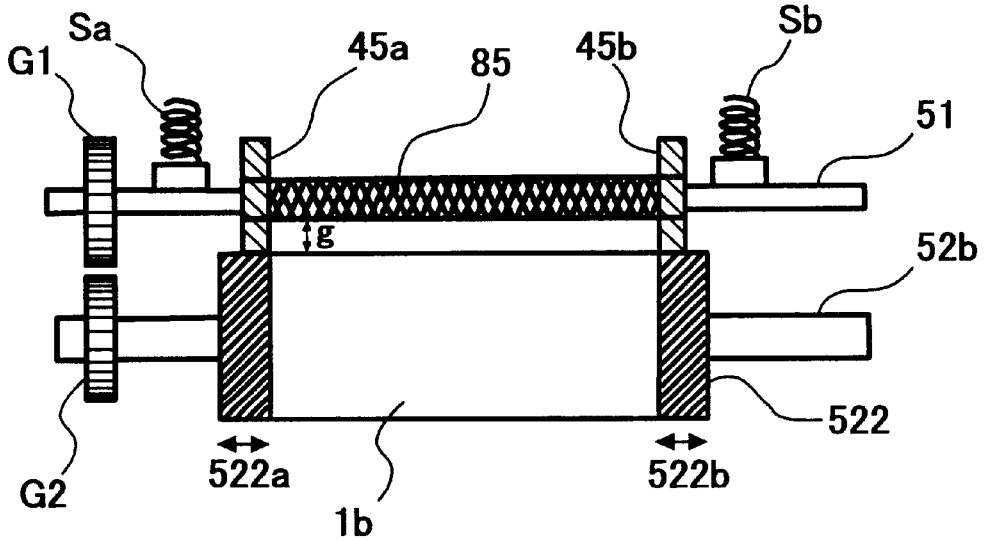

In the present invention, it is very important to control the gap g between the charger 85 and the photoreceptor 1*b*. Similarly to the first embodiment, it is preferable that the rotating shafts of the charger and the photoreceptor are fixed while they contact each other. Specifically, the charger 85 and the driving (or driven) roller 522 supporting the photoreceptor 1*b* are fixed using a ring member 5 as shown in FIGS. 31 and 32. In addition, as shown in FIG. 33, a method in which the charger 85 is pressed toward the photoreceptor 1*b* by applying a pressure to the rotating shaft 51 of the charger 85 using springs Sa and Sb. Further, as shown in FIG. 34, it is preferable that the charger 85 and the photoreceptor 1*b* are independently rotated by arranging, for example, gears G1 and G2, couplings or a belt to the rotating shafts 51 of the charger 85 and a rotating shaft 52*b* of the roller 522.

Next, the photoreceptor for use in the fifth embodiment of the image forming apparatus of the present invention will be explained. In the fifth embodiment, the photoreceptor having a construction as shown in FIGS. 10, 11, 12 or 13 can also be used.

Suitable materials for use as the electroconductive substrate of the belt-shaped photoreceptor include materials having a volume resistance not greater than $10^{10}$ Ω·cm. Specific examples of such materials include plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, endless belts of a metal such as nickel, stainless steel and the like, which have been disclosed, for example, in Japanese Laid-Open Patent Publication No. 52-36016, can also be used as the substrate.

Furthermore, substrates, in which a coating liquid including an electroconductive powder dispersed in a binder resin is coated on the supporters mentioned above, can be used as the substrate. Specific examples of such an electroconductive powder and the binder resin include the materials mentioned above for use in the electroconductive substrate 31 mentioned above in the first embodiment.

Such an electroconductive layer can be also formed by the coating method mentioned above for use in formation of the electroconductive substrate.

In addition, belt-shaped substrates, in which an electroconductive resin film is formed on a surface of a belt substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate of the photoreceptor.

Next, the photosensitive layer of the photoreceptor for use in the fifth embodiment will be explained. The photosensitive layer may be a single-layered photosensitive layer or a multi-layered photosensitive layer.

At first, the multi-layered photosensitive layer including a charge generation layer and the charge transport layer will be explained.

The charge generation layer (hereinafter referred to as the CGL) includes a charge generation material as a main component, and optionally a binder resin is also used. In the CGL, known inorganic and organic charge generation materials can be used.

Specific examples of the inorganic and organic charge generation materials include the inorganic and organic charge generation materials mentioned above for use in the photoreceptor of the first embodiment.

These charge transport materials can be used alone or in combination.

Specific examples of the binder resin, which is optionally used in the CGL, include the resins mentioned above for use in the CGL for use in the photoreceptor of the first embodiment. The addition quantity of the binder resin is from 0 to 500 parts by weight, and preferably from 10 to 300 parts by weight, per 100 parts by weight of the charge generation material included in the CGL.

Suitable methods for forming the CGL include the thin film forming methods in a vacuum and the casting methods using a coating liquid for use in the photoreceptor in the first embodiment.

The thickness of the CGL is preferably from about 0.01 to about 5 $\mu$m, and more preferably from about 0.1 to about 2 $\mu$m.

The charge transport layer (hereinafter referred to as the CTL) can be formed, for example, by the method method mentioned above for use in the formation of the CTL 37 for use in the photoreceptor of the first embodiment.

The CTL may include additives such as plasticizers, leveling agents, antioxidants and the like if desired.

Suitable charge transport materials include the electron transport materials and positive-hole transport materials for use in the CTL 37 mentioned above.

These charge transport materials can be used alone or in combination.

Specific examples of the binder resin for use in the CTL include the resins for use in the CTL 37 mentioned above.

The content of the charge transport material in the CTL is preferably from 20 to 300 parts by weight, and more preferably from 40 to 150 parts by weight, per 100 parts by weight of the binder resin included in the CTL. The thickness of the CTL is preferably from 5 to 100 $\mu$m.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The CTL preferably includes a charge transport polymer, which has both a binder resin function and a charge transport function. The CTL constituted of a charge transport polymer has good abrasion resistance.

Suitable charge transport polymers include known charge transport polymers. Among these polymers, polycarbonate resins having a triarylamine group in their main chain and/or side chain are preferably used. In particular, the charge transport polymers having one of formulae (1) to (10) mentioned above are preferably used.

The CTL may include additives such as plasticizers and leveling agents. Specific examples of the plasticizers and the leveling agents include the plasticizers and the leveling agents mentioned above for use in the CTL 37. The addition quantity of the plasticizer is 0 to 30% by weight of the binder resin included in the CTL. The addition quantity of the leveling agents is 0 to 1% by weight of the binder resin included in the CTL.

Next, the single-layered photosensitive layer will be explained. Similarly to the photosensitive layer 33, the photosensitive layer can be formed by coating a coating liquid in which a charge generation material, a charge transport material and a binder resin are dissolved or dispersed in a proper solvent, and then drying the coated liquid. In addition, the photosensitive layer may include the charge transport material mentioned above to form a functionally-separated photosensitive layer. The photosensitive layer may include additives such as plasticizers, leveling agents and antioxidants.

Suitable binder resins for use in the photosensitive layer include the resins mentioned above for use in the CTL 37. The resins mentioned above for use in the CGL 35 can be added as a binder resin. In addition, the charge transport polymers mentioned above can also be used as a binder resin.

The content of the charge generation material in the photosensitive layer is preferably from 5 to 40 parts by weight per 100 parts by weight of the binder resin included in the photosensitive layer. The content of the charge transport material in the photosensitive layer is preferably from 0 to 190 parts, and more preferably from 50 to 150 parts by weight, per 100 parts by weight of the binder resin included in the photosensitive layer.

The single-layered photosensitive layer can be formed by the method for use in the formation of the photosensitive layer 33. The thickness of the photosensitive layer is preferably from 5 to 100 $\mu$m.

Similarly to the photoreceptor for use in the first embodiment, the photoreceptor for use in the fifth embodiment may include an undercoat layer between the substrate and the photosensitive layer.

The undercoat layer can be formed by using one of the methods and materials mentioned above for use in the undercoat layer of the photoreceptor in the first embodiment.

In the photoreceptor for use in the fifth embodiment, a protective layer 39 is optionally formed on the photosensitive layer to protect the photosensitive layer.

The protective layer 39 can be formed by using the methods and materials mentioned above for use in the protective layer 39 mentioned above in the first embodiment.

When a charge transport polymer is used in the CTL and/or the protective layer in the fifth embodiment, the resultant photoreceptor has the following advantages.

(1) The surface of the photoreceptor becomes harder, and therefore a uniform gap can be maintained even in repeated use.

This is mentioned above in detail in the first embodiment.

(2) The mechanical durability of the photoreceptor is enhanced and therefore a uniform gap can be stably Maintained.

This is also mentioned in detail in the first embodiment.

(3') The ratio (Dp/Dc) of the diameter (Dp) of the endless belt photoreceptor to the diameter (Dc) of the charger can be decreased.

As mentioned above, there is a limit for miniaturization in diameter of the photoreceptor because the life of the photoreceptor cannot be prolonged (in particular, the mechanical durability of the photoreceptor cannot be enhanced). Therefore there is a limit for miniaturization of the charger and image forming apparatus.

Although the material and construction of the charger have been investigated to enhance the durability thereof, the charger is typically constituted of an elastic rubber now. By using the proximity charging device of the present invention, the abrasion and the residual-toner-induced contamination of the charger in repeated use can be dramatically improved. Therefore the life of a charger does not depend on the abrasion and contamination now.

However, the deterioration of the materials used for chargers due to repeated charging is hardly improved. One of the reasons is that the diameter of the photoreceptor is much larger than that of the charger. For example, the diameters of a belt-shaped photoreceptor and a charger, which are typically used currently, are about 100 mm and from about 10 to 20 mm, respectively, to miniaturize the image forming apparatus and process cartridge. In order to effectively perform maintenance work, a charger and a photoreceptor are replaced with new ones now at the same time. Therefore, the durability of the charger has to be 5 to 10 times that of the photoreceptor.

When the durability of the belt-shaped photoreceptor can be improved, the diameter (i.e., the length) of the photoreceptor can be decreased. Therefore, the ratio of the diameter of the photoreceptor to that of the charger decreases. As mentioned above, when the diameter of the photoreceptor decreases, the charging area decreases as mentioned below, and thereby deterioration of the charger due to discharging can be controlled. Therefore, it is possible to provide further miniaturized image forming apparatus and process cartridges.

In the proximity charging device of the present invention, discharging between the charger and the photoreceptor substantially accords with Paschen's law. Namely, when the rotating photoreceptor and charger approach or separate from each other, discharging occurs therebetween if the distance thereof is in a certain range. When the area of the charger (or the photoreceptor) in which discharging is performed at a time is referred to as "charging area", the larger the curvature of the charger (or the photoreceptor), i.e., the smaller the diameter of the charger, the less the charging area.

As a result of the present inventors' investigation, it is found that even when the diameter of the charger (or the photoreceptor) becomes small, the relationship between the applied voltage and the resultant potential of the photoreceptor is not changed although the quantity of generated reaction gasses such as ozone and NOx can be reduced. Namely, it is found that by decreasing the charging area, the quantity of generated reaction gasses can be reduced without deteriorating charging efficiency. Thus, by improving the abrasion resistance of a photoreceptor, the diameter of the driving roller (or the driven roller) can be decreased, and thereby the quantity of generated reaction gasses can be reduced. When the quantity of generated reaction gasses is reduced, deterioration of the charger and photoreceptor due to such reaction gasses can be improved, resulting in dramatically increase of the durability of the charger and the photoreceptor.

According to Paschen's law, if the composition of the photosensitive layer of a photoreceptor is constant, the thinner the photosensitive layer, the more easily the photoreceptor can be charged. When a photoreceptor having good abrasion resistance is used, the photosensitive layer can be thinned and therefore the applied voltage can be decreased. Therefore, the stress to a charger can be reduced in repeated use, thereby decreasing chemical deterioration of the charger, resulting in improvement of durability of the charger. In addition, the voltage applied to a charger can be reduced, the quantity of generated reaction gasses such as ozone and NOx can be decreased, resulting in prevention of deterioration of the charger and the photoreceptor, and thereby the durability thereof can be improved.

(4) Image Qualities can be Improved.

This is also mentioned above in detail in the first embodiment.

The photoreceptor for use in the fifth embodiment may include an intermediate layer between the photosensitive layer and the protective layer. The intermediate layer can be formed by using such materials and methods mentioned above for use in the photoreceptor for use in the first embodiment. The thickness of the intermediate layer is preferably from 0.05 to 2 $\mu$m.

The image forming apparatus of the fifth embodiment is explained referring to drawings.

FIG. 15 is a schematic view illustrating an example of the fifth embodiment of the image forming apparatus of the present invention. Since the image forming apparatus are mentioned above in detail in the first embodiment, the image forming apparatus is not explained in this embodiment.

The image forming unit as shown in FIG. 15 may be fixedly set in a copier, a facsimile or a printer. However, the image forming unit may be set therein as a process cartridge. The process cartridge is an image forming unit (or device) which includes at least a photoreceptor, and a charger. In addition, the process cartridge may include an imagewise light irradiator, an image developer, an image transferer, a cleaner, and/or a discharger.

Figure 35:
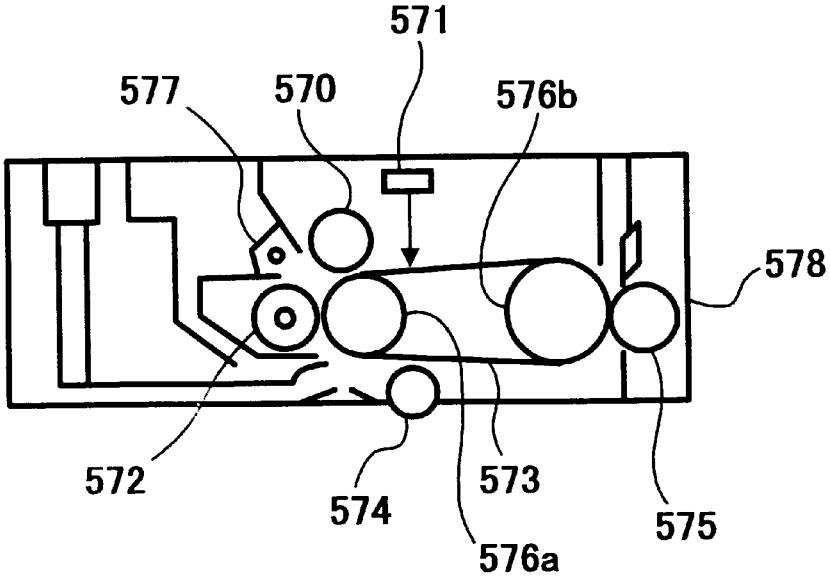
FIG. 35 is a schematic view illustrating a cross-section of another embodiment of the process cartridge of the present invention.

Various process cartridges can be used in the present invention. FIG. 35 is a schematic view illustrating an embodiment of the process cartridge of the present invention. In FIG. 35, the process cartridge includes a photoreceptor 573 supported and driven by driving and driven rollers 576*a* and 576*b*, and a charger 570, an imagewise light irradiator 571, a developing roller 575, a transfer roller 574, and a cleaning brush 572, which are arranged around the photoreceptor 573. Numerals 577 and 578 denote a discharger and a housing. In this case, the photoreceptor 573 and the driving and driven rollers 576*a* and 576*b* serve as the image bearing device. The photoreceptor 573 has at least a photosensitive layer formed on an electroconductive substrate as mentioned above.

Sixth embodiment of the image forming apparatus of the invention

The charger for use in the sixth embodiment of the image forming apparatus of the present invention will be explained referring to drawings, but the construction of the charger is not limited thereto and known chargers can be used if the chargers have the function of the charger for use in the present invention.

The charger for use in the sixth embodiment has a construction as shown in FIG. 23 or 24.

Namely, the charger has an electroconductive elastic material formed on a rotating shaft, and projected portions formed on both end portions of the electroconductive elastic material.

Alternatively, the charger has an electroconductive elastic material and a resistance controlling layer formed on a rotating shaft in this order, and projected portions formed on both end portions of the resistance controlling layer. The gap forming portions serving as the gap forming members contact the extended portions of a driving roller (or a driven roller), which supports a photoreceptor, to form a gap between the charger and the photoreceptor.

Figure 36:
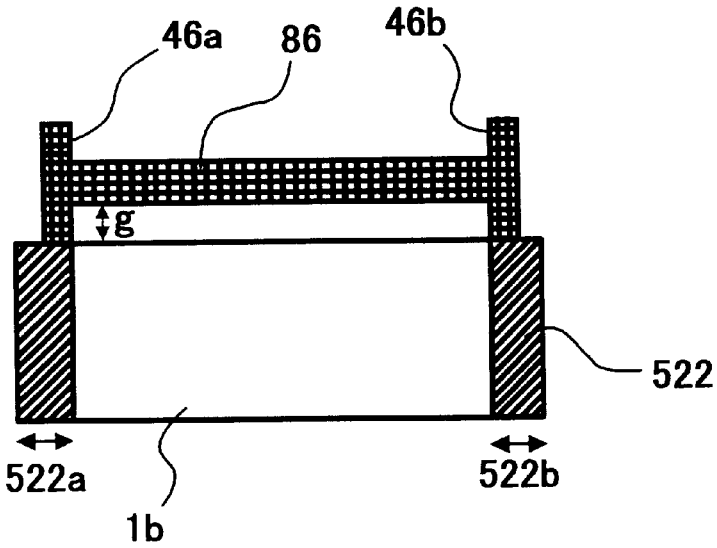
FIG. 36 is a schematic view illustrating another embodiment of configuration of the charging roller and the photoreceptor.

FIG. 36 illustrates the positional relationship between the charger and the photoreceptor in the sixth embodiment of the image forming apparatus of the present invention. As shown in FIG. 36, gap forming portions 46*a* and 46*b* of the charger 86 contact extended portions 522*a* and 522*b* of a driving roller 522 (or a driven roller 522) which supports a belt-shaped photoreceptor 1*b*. Since the charger 86 contacts only at the extended portions 522*a* and 522*b* of the driving (or driven) roller 522, a gap is formed between the surface of the charger 86 and the surface of the photoreceptor 1*b*. Therefore, the charger 86 charges the photoreceptor 1*b* while not contacting the photoreceptor 1*b*. In this case, the non-contacting portion NC of the charger is longer than the width of the photoreceptor 1*b*.

Suitable materials for use as the rotating shaft 651 include metals such as iron, copper, brass and stainless steals. Suitable materials for use as the electroconductive elastic materials include compositions in which an electroconductive powder or an electroconductive fiber (e.g., carbon black, metal powders, carbon fibers, etc.) is dispersed in a synthetic rubber. When a resistance controlling layer is formed on the surface of the charger 86, the resistance controlling layer preferably has a resistance of from $10^3$ to $10^8$ Ω·cm. When the resistance controlling layer is not formed, the resistance of the electroconductive elastic material (i.e., the surface layer) preferably has a resistance of from about $10^4$ to about $10^{10}$ Ω·cm.

Suitable materials for use in the resistance controlling layer include synthetic resins such as polyethylene, polyesters and epoxy resins; synthetic rubbers such as etylene-propylene rubbers, styrene-butadiene rubbers and chlorinated polyethylene rubbers; epichlorohydrin-ethyleneoxide copolymeric rubbers, mixtures of an epichlorohydrin rubber and a fluorine-containing resin, etc.

Figure 37:
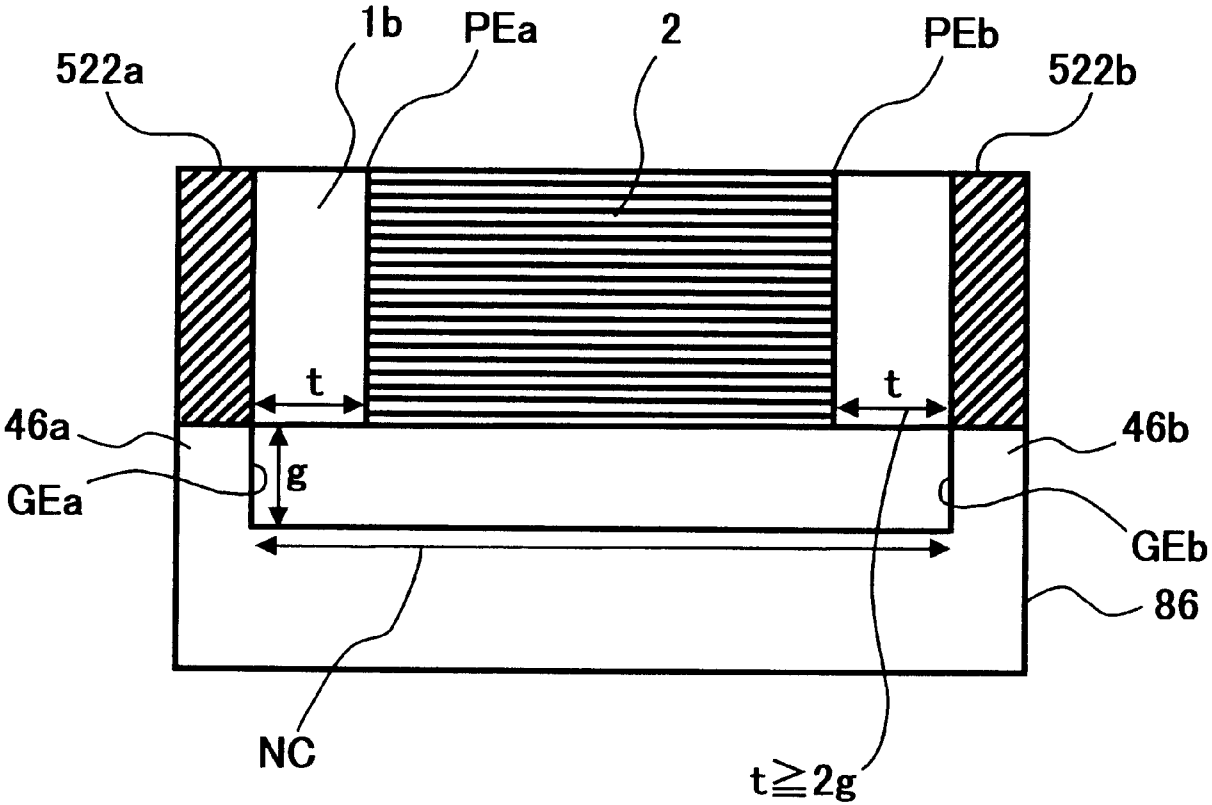
FIG. 37 is a schematic view illustrating the positional relationship between the charging roller and the photoreceptor.

FIG. 37 illustrates the positional relationship between the image forming portion of the photoreceptor and the gap forming members of the charger. In the present invention, this positional relationship is very important.

Namely, it is important that as shown in FIG. 37 an inside edge GEa (GEb) of the gap forming portions 86*a* (86*b*) is located outside an end PEa (PEb) of the image forming portion 2 of the photoreceptor 1*b*. The distance t between the inside end GEa (GEb) of the gap forming portions 46*a* (46*b*) and the end PEa (PEb) of the image forming portion 2 is preferably not less than twice the gap g formed between the photoreceptor 1*b* and the charger 86. It is preferable that the distance t is not greater than 100 times the gap g or not greater than 10 mm for the same reasons as mentioned above in the first embodiments. A character NC denotes a non-contacting portion of the charger which charges the photoreceptor 1*b* while not contacting the photoreceptor 1*b*.

Suitable methods for forming the gap forming portions 46*a* and 46*b* include any known methods. For example, methods in which the surface layer of the charger is formed such that the layer is slightly thick by the thickness corresponding to the thickness of the gap forming portions (i.e., the gap g), and then the non-contacting portion NC of the surface layer is cut or polished can be typically used.

For the reasons mentioned above in the case of the gap forming layers 41*a* and 41*b* in the first embodiment, the thickness of the gap forming portions 46*a* and 46*b* is preferably from 10 to 200 μm in this embodiment, and more preferably from 20 to 100 μm.

In the present invention, it is very important to control the gap g between the charger 86 and the photoreceptor 1*b*. Similarly to the first embodiment, it is preferable that the rotating shafts of the charger and the driving roller are fixed while the charger 86 contacts the driving roller 522. Specifically, the charger 86 and the roller 522 are fixed using a ring member 5 similarly to FIG. 31. In addition, similarly to the first to fifth embodiments, the charger may be pressed toward the photoreceptor 1*b* by applying a pressure to the rotating shaft of the charger using springs. Further, similarly to the first to fifth embodiments, it is preferable that the charger and the photoreceptor are independently rotated by arranging, for example, gears, couplings or belts on the rotating shafts of the charger and the driving roller.

As mentioned above, when charging the photoreceptor, a DC voltage overlapped with an AC voltage is preferably applied to the charger to avoid uneven charging. Similarly to the fifth embodiment, photoreceptors having constructions as shown in FIGS. 10 to 13 can be used. In addition, image forming apparatus and process cartridges similarly to those mentioned in the fifth embodiment can also be used in the sixth embodiment.

As the driving (or driven) roller 522 for use in the sixth embodiment, known rollers can be used regardless of the materials and shapes thereof if the rollers satisfy the requirements for the roller 522. Suitable rollers for use as the roller 522 include metal rollers and plastic rollers. When the roller 522 needs to be insulating, metal rollers coated with an insulating material, and metal rollers in which the portions to be contacted with the gap forming members of the charger are made of a plastic can be preferably used.

With respect to the rotating shaft, the electroconductive elastic material and the resistance controlling layer, the materials mentioned above for use in the fifth embodiment can also be used in the sixth embodiment.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples of the First Embodiment

Example 1

Preparation of Charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 50 μm was formed thereon. On the both end portions of the charging roller, a gap forming layer having a thickness of 50 μm to be contacted with the non-image end portion of the photoreceptor mentioned below was formed by coating a polyester resin solution using a spray coating liquid and drying the resin solution. Thus, a charging roller having gap forming layers of 50 μm thick and a construction as shown in FIG. 2 was prepared.

Preparation of Photoreceptor A

The following charge generation layer coating liquid and charge transport layer coating liquid were coated on an aluminum layer deposited on a polyethylene terephthalate film (hereinafter referred to as a PET film) and then dried to overlay a charge generation layer having a thickness of 0.3 μm and a charge transport layer having a thickness of 25 μm on the PET film. Even on the both edge portions of the PET film, on which electrostatic latent images are not formed and with which the gap forming layers of the charger are to be contacted, these layers were formed. Thus, a photoreceptor A was prepared.

Charge Generation Layer Coating Liquid

Titanyl phthalocyanine

3

Polyvinyl butyral

2 n-butyl acetate

100

Charge Transport Layer Coating Liquid

A-form polycarbonate

10

Charge transport material having the following formula (a)

8

(a)

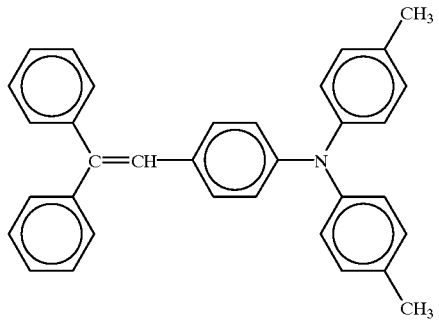

Methylene chloride

80

Example 2

The procedures for preparation of the charger and the photoreceptor in Example 1 were repeated except that the thickness of the gap forming layers was 100 μm.

Example 3

The procedures for preparation of the charger and the photoreceptor in Example 1 were repeated except that the thickness of the gap forming layers was 150 μm.

Example 4

The procedures for preparation of the charger and the photoreceptor in Example 1 were repeated except that the thickness of the gap forming layers was 250 μm.

Example 5

The procedures for preparation of the charger and the photoreceptor in Example 1 were repeated except that the composition of the gap forming layers was changed to a polyester resin in which an electroconductive carbon black is dispersed and which has a resistivity of $2\times10^3$ Ω·cm.

Comparative Example 1

The procedures for preparation of the charger and the photoreceptor in Example 1 were repeated except that the gap forming layers was not formed.

Evaluation Method

Each combination of the charger and the photoreceptor in Examples 1 to 5 and Comparative Example 1 was evaluated as follows.

The both ends of the photoreceptor were joined to form an endless belt photoreceptor to be mounted in an image forming apparatus having a construction as shown in FIG. 15. Then, as shown in FIG. 32, the rotating shaft of a driving roller supporting and driving the endless belt photoreceptor and the rotating shaft of a charger were fixed using a ring member. The endless belt photoreceptor and the gap forming layers of the charger of Examples 1, 2, 3, 4 or 5 contacted only at the non-image end portions of the photoreceptor as shown in FIG. 6.

In this case, the photoreceptor and the charger were set such that as shown in FIG. 4 the inside end GEa (GEb) of the gap forming layer 41*a* (41*b*) is located outside the end PEa (PEb) of the image forming portion 2 of the photoreceptor 1. The distance t between the inside end GEa (GEb) of the gap forming layer 41*a* (41*b*) and the end PEa (PEb) of the image forming portion 2 was 1 mm, which is greater than twice the gap g (i.e., the gap is from 50 to 250 μm in these examples) formed between the photoreceptor and the charger.

With respect to the charger of Comparative Example 1, the entire peripheral surface of the charger contacted the endless belt photoreceptor.

A running test in which 30,000 copies were continuously produced was performed using a laser diode emitting light having a wavelength of 780 nm and a polygon mirror. The charging conditions are as follows.

DC bias: −900V

AC bias: 2.0 kV (peak to peak voltage)

1.8 kHz (frequency)

The results are shown in Table 1.

Example 6

The procedures for preparation and evaluation of the charger and photoreceptor in Example 1 were repeated except that the rotating shafts of the charger and the driving roller were not fixed by the ring member.

Comparative Example 2

The procedures for preparation and evaluation of the charger and the photoreceptor in Example 2 were repeated except that the distance t between the inside edge GEa (GEb) of the gap forming layer 41*a* (41*b*) and the end PEa (PEb) of the image forming portion 2 was 0 mm.

Example 7

The procedures for preparation and evaluation of the charger and the photoreceptor in Example 2 were repeated except that the distance t between the inside edge GEa (GEb) of the gap forming layer 41*a* (41*b*) and the end PEa (PEb) of the image forming portion 2 was 0.3 mm.

Example 8

The procedures for preparation and evaluation of the charger and photoreceptor in Example 2 were repeated except that the distance t between the inside edge GEa (GEb) of the gap forming layer 41*a* (41*b*) and the end PEa (PEb) of the image forming portion 2 was 0.5 mm.

Examples 9–13 and Comparative Example 3

The procedures for preparation and evaluation of the chargers and the photoreceptors in Examples 1 to 5 and Comparative Example 1 were repeated except that the photoreceptor A was replaced with the following photoreceptor B.

Preparation of Photoreceptor B

The procedure for preparation of the photoreceptor A was repeated except that a seamless nickel belt was used as the electroconductive substrate and an undercoat layer having a thickness of 3.5 μm was formed between the substrate and the charge generation layer by coating and drying the following undercoat layer coating liquid.

Undercoat Layer Coating Liquid

Titanium oxide powder

400

Melamine resin

65

Alkyd resin

120

2-butanone

400

The procedure for evaluation in Example 1 was repeated to evaluate the combination of the charger and the photoreceptor of each of Examples 9 to 13 and Comparative Example 3.

The results are also shown in Table 1.

Example 14

The procedures for preparation and evaluation of the charger and the photoreceptor in Example 9 were repeated except that the ring member was not used in the image forming apparatus.

The results are also shown in Table 1.

TABLE 1

| | Image qualities of the first image | Image qualities of the 30,000th image |
|---|---|---|
| Ex. 1 | Good | Good |
| Ex. 2 | Good | Good |
| Ex. 3 | Good | Good |
| Ex. 4 | Good | Slightly uneven density image was formed |
| Ex. 5 | Good | Faint undesired image was formed due to abnormal discharging |
| Ex. 6 | Good | Uneven density image was formed due to partially uneven discharging |
| Comp. Ex. 1 | Good | Undesired images were formed due to toner filming on the charger |
| Comp. Ex. 2 | Good | Uneven images were formed on both sides of the copy sheet. In addition, background fouling was observed. |
| Ex. 7 | Good | Good |
| Ex. 8 | Good | Good |
| Ex. 9 | Good | Good |
| Ex. 10 | Good | Good |
| Ex. 11 | Good | Good |
| Ex. 12 | Good | Slightly uneven density image was formed |
| Ex. 13 | Good | Faint undesired image was formed due to abnormal discharging |
| Ex. 14 | Good | Uneven density image was formed due to partially uneven discharging |
| Comp. Ex. 3 | Good | Undesired images were formed due to toner filming on the charger |

Example 15

The procedures for preparation and evaluation of the charger and the photoreceptor in Example 1 were repeated except that the AC bias was not applied in the image forming operation.

As a result of the running test, the 30,000th image was good. However, when half tone images were reproduced after the running test, the half tone images had slightly uneven image density due to uneven charging although the half tone images were still acceptable.

Example 16

Preparation of Charger

An electroconductive roller was prepared by the following method mentioned in Japanese Patent No. 2,632,578.

The following components were mixed to prepare a rubber composition having a hardness of 20 Hs for use as the electroconductive elastic layer.

Polynorbornene rubber

100

Ketjen Black

50

Naphthenic oil

400

The following components were mixed to prepare a composition for use as a migration preventing layer.

N-methoxymethylated nylon

100

Carbon black

15

The following components were mixed to prepare a composition for use as a resistance controlling layer.

Epichlorohydrin-ethyleneoxide rubber

100

$Pb_3O_4$

5

Ethylene urea 1.2

Additive

1

Hard clay

40

The composition was kneaded using a roll mill, and then dissolved in a mixture solvent of methyl ethyl ketone and methyl isobutyl ketone (the mixing ratio is 3:1) to prepare a resistance controlling layer coating liquid. The viscosity of the coating liquid was 300 cps.

On a periphery surface of a metal shaft having a diameter of 8 mm, an adhesive was coated and then an electroconductive elastic layer was formed using a molding method. In this case, the electroconductive elastic layer was vulcanized. The diameter of the shaft having the electroconductive elastic layer was 15 mm.

Then a coating liquid including the migration preventing layer composition was coated thereon by a spray coating method and then dried to form a migration preventing layer having a thickness of from 6 to 10 μm.

Next, the above-prepared resistance controlling layer coating liquid was dip-coated thereon to form a resistance controlling layer and then dried. The resistance controlling layer was then heated so as to be crosslinked.

Thus, an electroconductive roller was prepared.

Then the polyester resin layer, which is made of the same resin as that used as the gap forming layers in Example 1 and which has a thickness of 80 μm, was formed on the entire periphery of the electroconductive roller. Then the polyester resin layer was cut by a cutting tool such that a gap forming layer is formed on both end portions of the electroconductive roller. In this case, the distance t was 1 mm.

Thus a charger having gap forming layer having a thickness of 80 μm was prepared.

Preparation of Photoreceptor C

On an aluminum cylinder, the following undercoat layer coating liquid, charge generation layer coating liquid and charge transport layer coating liquid were coated and dried one by one to form an undercoat layer having a thickness of 4.0 μm, a charge generation layer having a thickness of 0.2 μm and a charge transport layer having a thickness of 27 μm on the aluminum cylinder.

Thus, a photoreceptor C was prepared. In this case, these three layers were formed on the non-image portions of the photoreceptor C to be contacted with the gap forming portions of the charger.

Undercoat Layer Coating Liquid

Titanium oxide powder

400

Melamine resin

65

Alkyd resin

120

2-butanone

400

Charge Generation Layer Coating Liquid

Trisazo pigment having the following formula (b)

10

(b)

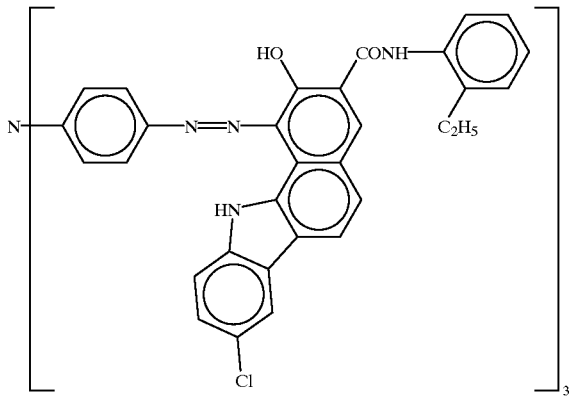

Polyvinyl butyral

4

2-butanone

200

Cyclohexanone

400

Charge Transport Layer Coating Liquid

Polycarbonate

10

Charge transport material having the following formula (c)

8

(c)

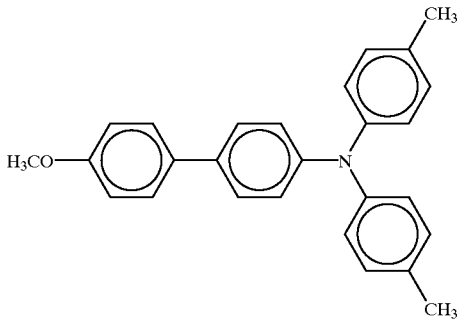

Methylene chloride

80

Example 17

The procedures for preparation of the charger and the photoreceptor in Example 16 were repeated except that the charge transport layer coating liquid was changed to the following.

Charge Transport Layer Coating Liquid

Charge transport polymer having the following formula (d)

8

(d)

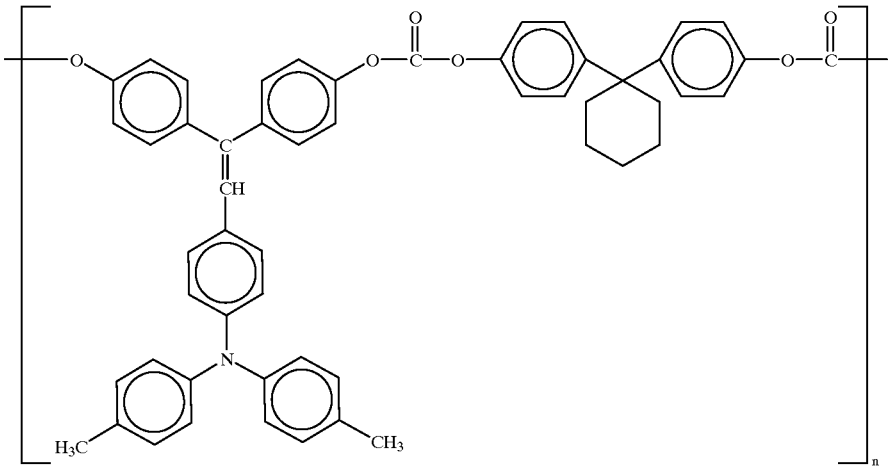

Methylene chloride
80

Example 18

The procedures for preparation of the charger and the photoreceptor in Example 16 were repeated except that the following protective layer coating liquid was coated on the charge transport layer and dried to form a charge transport layer having a thickness of 2 μm.

Protective Layer Coating Liquid

Charge transport polymer having formula (d)
4

Z-form polycarbonate
4

Methylene chloride
80

Example 19

The procedures for preparation of the charger and the photoreceptor C in Example 16 were repeated except that the following protective layer coating liquid was coated on the charge transport layer and dried to form a charge transport layer having a thickness of 2 μm.

Protective Layer Coating Liquid

Charge transport polymer having formula (d)
4

Z-form polycarbonate
4

Titanium oxide
1

Methylene chloride
80

Comparative Example 4

The procedures for preparation of the charger and the photoreceptor in Example 16 were repeated except that the gap forming layers were not formed on the charger.

Comparative Example 5

The procedures for preparation of the charger and the photoreceptor in Example 17 were repeated except that the gap forming layers were not formed on the charger.

Comparative Example 6

The procedures for preparation of the charger and the photoreceptor in Example 18 were repeated except that the gap forming layers were not formed on the charger.

Comparative Example 7

The procedures for preparation of the charger and the photoreceptor in Example 19 were repeated except that the gap forming layers were not formed on the charger.

Evaluation Method

Each combination of the charger and the photoreceptor in Examples 16 to 19 and Comparative Examples 4 to 7 was evaluated using an image forming apparatus having a construction as shown in FIG. 14, in which as shown in FIG. 9 gears were arranged on the rotating shafts of the cylindrical photoreceptor and the charger to rotate the charger and the photoreceptor at the same speed and springs were provided on the rotating shaft of the charger to press the charger toward the photoreceptor.

In this case, the photoreceptor and the charger were set such that as shown in FIG. 4 the inside edge GEa (GEb) of the gap forming layer 41*a* (41*b*) is located outside the end PEa (PEb) of the image forming portion 2 of the photoreceptor. The distance t between the inside end GEa (GEb) of the gap forming layer 41*a* (41*b*) and the end PEa (PEb) of the image forming portion 2 was 1 mm, which is greater than twice the gap g (i.e., 80 μm) formed between the photoreceptor and the charger.

With respect to the chargers of Comparative Examples 4 to 7, the entire peripheral surface of the chargers contacted the photoreceptor.

A running test in which 50,000 copies were continuously produced was performed using a laser diode emitting light having a wavelength of 780 nm and a polygon mirror. The image qualities of the first and 50,000$^{th}$ images were evaluated. In addition, the abrasion quantity of the surface of the photoreceptor was also measured. The charging conditions are as follows.

DC bias: −850V

AC bias: 1.8 kV (peak to peak voltage)
2.2 kHz (frequency)

The results are shown in Table 2.

Example 20

The procedures for preparation and evaluation of the charger and the photoreceptor in Example 16 were repeated except that the springs pressing the charger were not used.

The results are shown in Table 2.

Example 21

The procedures for preparation and evaluation of the charger and the photoreceptor in Example 16 were repeated except that as shown in FIG. 8 the photoreceptor was frictionally driven by the charger without using the gears.

The results are shown in Table 2.

Example 22

The procedures for preparation and evaluation of the charger and the photoreceptor in Example 16 were repeated except that the charger rotated faster than the photoreceptor.

The results are shown in Table 2.

Examples 23 to 26 and Comparative Examples 8 to 11

The procedures for preparation of the photoreceptors and the chargers in Examples 16 to 19 and Comparative Examples 4 to 7 were repeated except that the substrate was changed from the aluminum cylinder to a nickel seamless belt to prepare endless photoreceptors of Examples 23 to 26 and Comparative Examples 8 to 11.

Each combination of the charging roller and the photoreceptor was set in an image forming apparatus having a construction as shown in FIG. 15, in which gears were provided on the rotating shafts of the driving roller supporting the endless photoreceptor and the charger to rotate the charger and the photoreceptor at the same speed and springs were provided on the rotating shaft of the charger to press the charger toward the photoreceptor.

In this case, the photoreceptor and the charger were set such that as shown in FIG. 4 the inside edge GEa (GEb) of the gap forming layer 41*a* (41*b*) is located outside the end PEa (PEb) of the image forming portion 2 of the photoreceptor. The distance t between the inside end GEa (GEb) of the gap forming layer 41*a* (41*b*) and the end PEa (PEb) of the image forming portion 2 was 1 mm, which is greater than twice the gap g (i.e., the gap is 80 μm in these examples) formed between the photoreceptor and the charger.

With respect to the chargers of Comparative Examples 8 to 11, the entire peripheral surface of the chargers contacted the endless photoreceptor.

A running test in which 50,000 copies were continuously produced was performed using a laser diode emitting light having a wavelength of 780 nm and a polygon mirror. The image qualities of the first and 50,000$^{th}$ images were evaluated. In addition, the abrasion quantity of the surface of the photoreceptor was also measured. The charging conditions are mentioned below.

DC bias: −850V

AC bias: 1.8 kV (peak to peak voltage)
2.2 kHz (frequency)

The results are also shown in Table 2.

Example 27

The procedures for preparation and evaluation of the charger and the photoreceptor in Example 23 were repeated except that the springs pressing the charger were not used.

The results are shown in Table 2.

Example 28

The procedures for preparation and evaluation of the charger and the photoreceptor in Example 23 were repeated except that the photoreceptor was frictionally driven by the charger without using gears.

The results are shown in Table 2.

Example 29

The procedures for preparation and evaluation of the charger and the photoreceptor in Example 23 were repeated except that the charger rotated faster than the photoreceptor.

The results are shown in Table 2.

TABLE 2

| | Image qualities of the first image | Image qualities of the 50,000$^{th}$ image | Abrasion quantity (μm) |
|---|---|---|---|
| Ex. 16 | Good | Faint black streaks were formed but the image was still acceptable. | 4.3 |
| Ex. 17 | Good | Good | 1.8 |
| Ex. 18 | Good | Good | 1.4 |
| Ex. 19 | Good | Good | 0.6 |
| Ex. 20 | Good | Slightly uneven density image was formed due to partially uneven charging | 4.0 |
| Ex. 21 | Good | Good. Since it was needed to enlarge the pressure applied to the charger, the abrasion quantity of the gap layers was large. | 4.8 |
| Ex. 22 | Good | Good. The abrasion quantity of the gap layers was large. | 5.2 |
| Comp. Ex. 4 | Good | Undesired images were produced due to toner filming on the charger. | 4.1 |
| Comp. Ex. 5 | Good | Undesired images were produced due to toner filming on the charger. | 1.7 |
| Comp. Ex. 6 | Good | Undesired images were produced due to toner filming on the charger. | 1.3 |
| Comp. Ex. 7 | Good | Undesired images were produced due to toner filming on the charger. | 0.5 |
| Ex. 23 | Good | Faint black streaks were formed but the image was still acceptable. | 1.7 |
| Ex. 24 | Good | Good | 0.7 |
| Ex. 25 | Good | Good | 0.6 |
| Ex. 26 | Good | Good | 0.2 |
| Ex. 27 | Good | Slightly uneven density image was formed due to partially uneven charging | 1.6 |
| Ex. 28 | Good | Good. Since it was needed to enlarge the pressure applied to the charger, the abrasion quantity of the gap layers was large. | 2.0 |
| Ex. 29 | Good | Good. The abrasion quantity of the gap layers was large. | 2.2 |
| Comp. Ex. 8 | Good | Undesired images were produced due to toner filming on the charger. | 1.6 |
| Comp. Ex. 9 | Good | Undesired images were produced due to toner filming on the charger. | 0.7 |
| Comp. Ex. 10 | Good | Undesired images were produced due to toner filming on the charger. | 0.5 |
| Comp. Ex. 11 | Good | Undesired images were produced due to toner filming on the charger. | 0.2 |

Example 30

The procedures for preparation and evaluation of the charger and the photoreceptor in Example 16 were repeated except that the AC bias was not applied in the image forming operation.

As a result of the running test, the 50,000$^{th}$ image was good. However, when half tone images were reproduced after the running test, the half tone images had slightly uneven image density due to uneven charging although the images were still acceptable.

Example 31

Preparation of Charger

An electroconductive roller was prepared by the following method mentioned in Example 4 of Japanese Laid-Open Patent Publication No. 5-341627.

A urethane rubber layer was formed on a shaft having a diameter of 6 mm to form a roller having an elastic layer and a diameter of 12 mm. The resistance of the elastic layer was $8\times10^9$ Ω·cm.

Then the following resistance controlling layer coating liquid was coated thereon and then dried to form a resistance controlling layer having a thickness of 40 μm and a resistance of $2\times10^9$ Ω·cm.

Urethane rubber solution

100

(solid content of 2.5% by weight)

Silicone resin solution

50

(solid content of 7.5% by weight)

Carbon black

2

Thus an electroconductive roller was prepared.

A high density polyethylene film having a thickness of 60 μm was adhered on the edge portions of the electroconductive roller using an adhesive. The thickness of the overlapped portions of the polyethylene film was decreased to form a gap forming material having an even thickness.

Thus a charger having gap forming materials having a thickness of 60 μm was prepared.

Preparation of Photoreceptor D

The surface of an aluminum cylinder was anodized and then sealed. On the thus anodized aluminum cylinder, the following charge generation layer coating liquid and charge transport layer coating liquid were coated and dried one by one to form a charge generation layer having a thickness of 0.2 μm and a charge transport layer having a thickness of 23 μm.

Charge Generation Layer Coating Liquid

Charge generation material having the following formula (e)

1

(e)

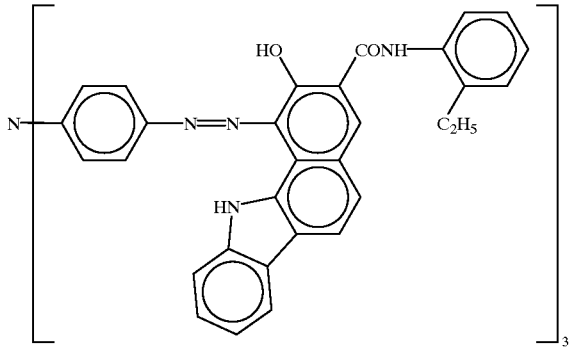

Charge generation material having the following formula (f)

1

(f)

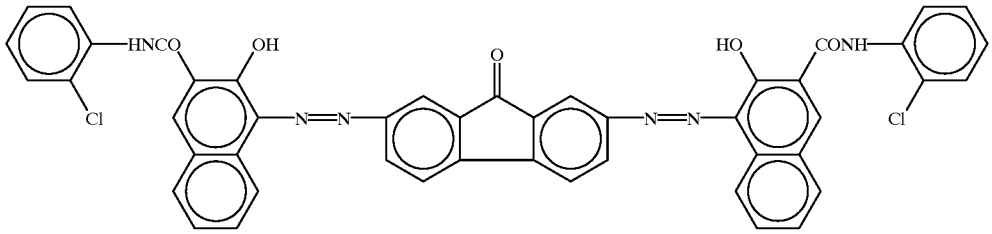

Polyvinyl butyral

1

Cyclohexanone

70

Cyclohexane

30

Charge Transport Layer Coating Liquid

Charge transport material having the following formula (g)

7

(g)

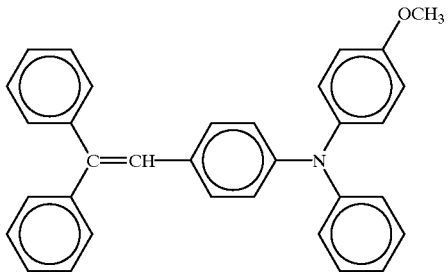

Polycarbonate

10

Tetrahydrofuran

100

Example 32

The procedures for preparation of the charger and the photoreceptor in Example 31 were repeated except that the seam of the gap forming materials made of the high molecular weight polyethylene film was changed to the gap forming materials having a slant seam as illustrated in FIG. 5A.

Example 33

The procedures for preparation of the charger and the photoreceptor in Example 31 were repeated except that the gap forming materials were changed to gap forming materials which was prepared by winding a nylon fishing gut including a fluorine-containing resin and having a diameter of 100 μm around both the edge portions of the roller such that the gut was not overlapped, and then fixing the wound gut with an adhesive.

Example 34

The procedures for preparation of the charger and the photoreceptor in Example 31 were repeated except that the gap forming materials were formed by winding a seamless nickel belt.

Comparative Example 12

The procedures for preparation of the charger and the photoreceptor in Example 31 were repeated except that the gap forming materials were not formed.

Evaluation Method

Each combination of the photoreceptor and the charger in Example 31 to 34 and Comparative Example 12 was set in a process cartridge having a construction as shown in FIG. 16 such that gears were provided on the rotating shaft of the photoreceptor and the charger to rotate the charger and the photoreceptor at the same speed and springs were provided on the rotating shaft of the charger to press the charger toward the photoreceptor.

In this case, the photoreceptor and the charger were set such that as shown in FIG. 4 the inside edge GEa (GEb) of the gap forming material 41*a* (41*b*) is located outside the end PEa (PEb) of the image forming portion 2 of the photoreceptor. The distance t between the inside edge GEa (GEb) of the gap forming layer 41*a* (41*b*) and the end PEa (PEb) of the image forming portion 2 was 2 mm, which is greater than twice the gap g (i.e., 60–100 μm) formed between the photoreceptor and the charger.

With respect to the chargers of Comparative Example 12, the entire peripheral surface of the chargers contacted the photoreceptor.

A running test in which 20,000 copies were continuously produced was performed using a laser diode emitting light having a wavelength of 780 nm and a polygon mirror. The potential of a non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: −850V

AC bias: 1.8 kV (peak to peak voltage)
2.2 kHz (frequency)

The results are also shown in Table 3.

Example 35

The procedures for preparation and evaluation of the charger and the photoreceptor in Example 31 were repeated except that the springs pressing the rotating shaft of the charger were not used.

The results are also shown in Table 3.

Example 36

The procedures for preparation and evaluation of the charger and the photoreceptor in Example 31 were repeated except that the photoreceptor was frictionally driven by the charger without using the gears.

The results are also shown in Table 3.

Example 37

The procedures for preparation and evaluation of the charger and the photoreceptor in Example 31 were repeated except that the charger rotated faster than the photoreceptor.

The results are also shown in Table 3.

TABLE 3

| | Potential (At the beginning) (V) | Potential (At the end) (V) | Image qualities of the half tone images |
|---|---|---|---|
| Ex. 31 | −852 | −847 | Good |
| Ex. 32 | −848 | −845 | Good |
| Ex. 33 | −850 | −840 | Good |
| Ex. 34 | −828 | −813 | Slightly undesired images were produced due to slightly abnormal charging. |
| Ex. 35 | −849 | −838 | Slightly uneven density image was formed. |
| Ex. 36 | −850 | −840 | Slightly uneven density image was formed. |
| Ex. 37 | −850 | −842 | Good. The abrasion quantity of the gap forming materials was large. |
| Comp. Ex. 12 | −828 | −808 | Uneven density image was formed. |

Example 38

The procedures for preparation and evaluation of the charger and the photoreceptor in Example 31 was repeated except that the AC bias was not applied.

As a result of the running test, the 20,000$^{th}$ image was good. When half tone images were produced after the running test, the half tone images had slightly uneven density due to uneven charging although the half tone images were still acceptable.

Examples of the Second Embodiment

Example 39

Preparation of Charger

An electroconductive roller was prepared according to the method mentioned in Example 4 of Japanese Laid-Open Patent Publication No. 5-341627. A polycarbonate resin solution including a silica was coated on both end portions of the roller by a spray coating method and dried to form gap forming layers having a thickness of 30 μm.

Preparation of Photoreceptor E

On the surface of an aluminum cylinder, the following undercoat layer coating liquid, charge generation layer coating liquid and charge transport layer coating liquid were coated and dried one by one to form an undercoat layer having a thickness of 3.5 μm, a charge generation layer having a thickness of 0.2 μm and a charge transport layer having a thickness of 28 μm.

| Undercoat layer coating liquid | | |
|---|---|---|
| Titanium 400 | dioxide | powder |
| Melamine 65 | | resin |
| Alkyd 120 | | resin |
| 2-butanone 400 | | |

Charge Generation Layer Coating Liquid

Trisazo pigment having formula (b)

10

Polyvinyl butyral

4

2-butanone

200

Cyclohexanone

400

Charge Transport Layer Coating Liquid

Polycarbonate

10

Charge transport material having the following formula (h)

8

(h)

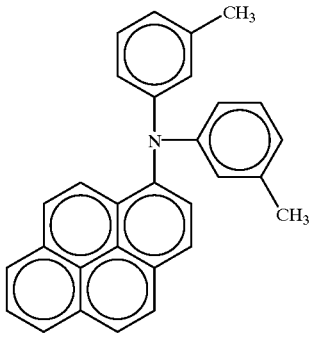

Methylene chloride

80

Example 40

The procedures for preparation of the charger and the photoreceptor in Example 39 were repeated except that the thickness of the gap forming layers was changed to 70 $\mu$m.

Example 41

The procedures for preparation of the charger and the photoreceptor in Example 39 were repeated except that the thickness of the gap forming layers was changed to 120 $\mu$m.

Example 42

The procedures for preparation of the charger and the photoreceptor in Example 39 were repeated except that the thickness of the gap forming layers was changed to 230 $\mu$m.

Comparative Example 13

The procedures for preparation of the charger and the photoreceptor in Example 39 were repeated except that the gap forming layers were not formed.

Evaluation Method

On both ends of each of the photoreceptors of Examples 39 to 42 and Comparative Example 13, a flange made of an ABS resin and having the same diameter as the photoreceptor was provided. The combination of the charger and the photoreceptor in Examples 39 to 42 and Comparative Example 13 was set in a process cartridge having a construction as shown in FIG. 16 such that as shown in FIG. 22 gears were provided on the rotating shafts of the photoreceptor and the charger to rotate the charger and the photoreceptor at the same speed and springs were provided on the rotating shaft of the charger to press the charger toward the photoreceptor.

In this case, the photoreceptor and the charger were set such that as shown in FIG. 18 the inside edge GEa (GEb) of the gap forming layer 42*a* (42*b*) is located outside the end PEa (PEb) of the image forming portion 2 of the photoreceptor. The distance t between the inside edge GEa (GEb) of the gap forming layer 42*a* (42*b*) and the end PEa (PEb) of the image forming portion 2 was 1 mm, which is greater than twice the gap g (i.e., the gap was 30–230 $\mu$m in these examples) formed between the photoreceptor and the charger.

With respect to the charger of Comparative Example 13, the entire peripheral surface thereof contacted the photoreceptor.

A running test in which 22,000 copies were continuously produced was performed using a laser diode emitting light having a wavelength of 780 nm and a polygon mirror. The image qualities were checked at the beginning and end of the running test. In addition, abrasion quantity of the photosensitive layer was also measured. The charging conditions are as follows.

DC bias: −870V

AC bias: 2.0 kV (peak to peak voltage)

2 kHz (frequency)

The results are also shown in Table 4.

Comparative Example 14

The procedures for preparation and evaluation of the charger and the photoreceptor in Example 39 were repeated except that the distance t was 0 mm.

The results are also shown in Table 4.

Example 43

The procedures for preparation and evaluation of the charger and the photoreceptor in Example 39 were repeated except that the distance t was 0.3 mm.

The results are also shown in Table 4.

Example 44

The procedures for preparation and evaluation of the charger and the photoreceptor in Example 39 were repeated except that the distance t was 0.5 mm.

The results are also shown in Table 4.

Example 45

The procedures for preparation and evaluation of the charger and the photoreceptor in Example 39 were repeated except that the springs pressing the charger were not used when the running test was performed.

The results are also shown in Table 4.

Example 46

The procedures for preparation and evaluation of the charger and the photoreceptor in Example 39 were repeated except that the photoreceptor was frictionally driven by the charger without using the gears when the running test was performed.

The results are also shown in Table 4.

Example 47

The procedures for preparation and evaluation of the charger and the photoreceptor in Example 39 were repeated except that the charger rotated faster than the photoreceptor when the running test was performed.

The results are also shown in Table 4.

TABLE 4

| | Image qualities (at the beginning) | Image qualities (at the end) |
|---|---|---|
| Ex. 39 | Good | Good |
| Ex. 40 | Good | Good |
| Ex. 41 | Good | Good |
| Ex. 42 | Good | Slightly uneven density image was formed due to bad charging. |
| Comp. Ex. 13 | Good | Undesired images were produced due to formation of toner film on the charger. |
| Comp. Ex. 14 | Good | Uneven images were observed at both edges of the copy. In addition, background fouling was observed. |
| Ex. 43 | Good | Good |
| Ex. 44 | Good | Good |
| Ex. 45 | Good | Slightly uneven density image was formed due to bad charging |
| Ex. 46 | Good | It was needed to increase the pressure of the charger, and the abrasion quantity of the gap forming layers was large. |
| Ex. 47 | Good | Good. However, the abrasion quantity of the gap forming layers was large. |

Combinations of the charger and the photoreceptor in Examples 39 to 47 and Comparative Examples 12 and 13 were explained while applying them to the process cartridge, however, the combinations can also be used for electrophotographic image forming apparatus other than the process cartridge.

Example 48

The procedures for preparation and evaluation of the charger and the photoreceptor in Example 39 were repeated except that the gap forming layers were made of a polycarbonate resin in which an electroconductive carbon black was dispersed, and the flange was made of a polycarbonate resin in which an electroconductive carbon black was dispersed.

As the result of the 22,000-sheet running test, the initial image was good, but the image at the end of the running test had faint undesired images due to bad charging.

Example 49

The procedures for preparation and evaluation of the charger and the photoreceptor in Example 39 were repeated except that the AC bias was not applied.

As the result of the 22,000-sheet running test, the image qualities were good at the beginning and end of the running test. However, when half tone images were produced after the running test, the image density of the half tone images was slightly uneven, which was due to uneven charging, although the images were still acceptable.

Example 50

The procedures for preparation of the charger and the photoreceptor in Example 39 were repeated except that the charge transport layer coating liquid was changed to the following.

Charge Transport Layer Coating Liquid

Charge transport polymer having the following formula (i)

8

(i)

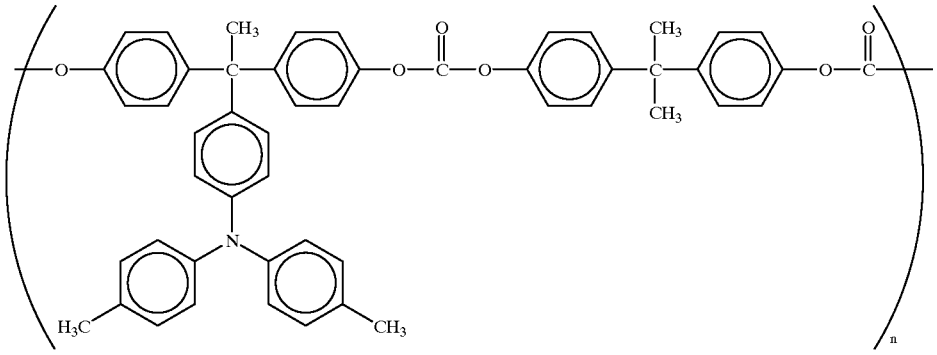

Methylene chloride

80

Example 51

The procedures for preparation of the charger and the photoreceptor in Example 39 were repeated except that the charge transport layer coating liquid was changed to the following.

Charge Transport Layer Coating Liquid

Charge transport polymer having the following formula (j)

8

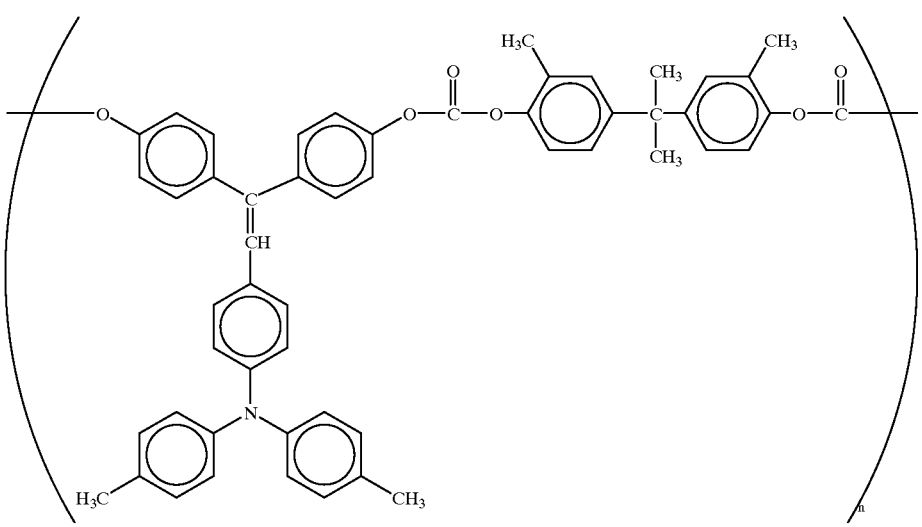

(j)

Methylene chloride

80

Example 52

The procedures for preparation of the charger and the photoreceptor in Example 39 were repeated except that a protective layer having a thickness of 3 $\mu$m was formed on the charge transport layer by coating and drying the following protective layer coating liquid.

Protective Layer Coating Liquid

Charge transport material having the following formula (k)

2

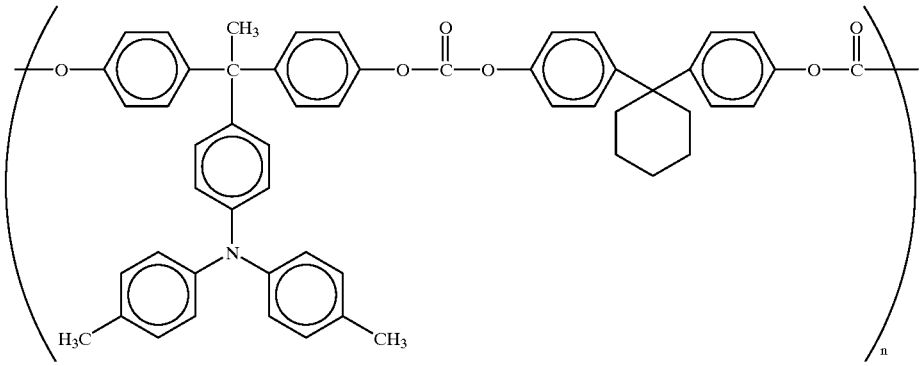

(k)

Z-form polycarbonate

2

Methylene chloride

80

Example 53

The procedures for preparation of the charger and the photoreceptor in Example 39 were repeated except that a protective layer having a thickness of 2 μm was formed on the charge transport layer by coating and drying the following protective layer coating liquid.

Protective Layer Coating Liquid

Charge transport polymer having formula (k)

2

Z-form polycarbonate

2

Titanium oxide

1

Methylene chloride

80

Evaluation Method

Each combination of the photoreceptor and the charger in Examples 39 and 50 to 53 was set in an image forming apparatus having a construction as shown in FIG. 14 in which as shown in FIGS. 19 and 20 a ring member was provided on the rotating shafts of the photoreceptor and the charger to rotate the charger and the photoreceptor at the same speed.

In this case, the photoreceptor and the charger were set such that as shown in FIG. 18 the inside edge GEa (GEb) of the gap forming layer 42*a* (42*b*) is located outside the end PEa (PEb) of the image forming portion 2 of the photoreceptor. The distance t between the inside edge GEa (GEb) of the gap forming layer 42*a* (42*b*) and the end PEa (PEb) of the image forming portion 2 was 1 mm, which is greater than twice the gap g (i.e., the gap was 30 μm in these examples) formed between the photoreceptor and the charger.

A running test in which 40,000 copies were continuously produced was performed using a laser diode emitting light having a wavelength of 780 nm and a polygon mirror. The image qualities of the first and 40,000$^{th}$ images were evaluated. In addition, the abrasion quantity of the surface of the photoreceptor was also measured. The charging conditions are as follows.

DC bias: −870V

AC bias: 2.0 kV (peak to peak voltage)

2 kHz (frequency)

The results are also shown in Table 5.

Example 54

The procedures for preparation and evaluation of the charger and the photoreceptor in Example 39 were repeated except that the ring member fixing the charger and the photoreceptor was not used in the image forming apparatus.

The results are shown in Table 5.

TABLE 5

| | Image qualities (at the beginning of the running test) | Image qualities (at the end of the running test) | Abrasion (μm) |
|---|---|---|---|
| Ex. 39 | Good | Faint black streaks were formed but the image was still acceptable. | 3.7 |
| Ex. 50 | Good | Good | 1.9 |
| Ex. 51 | Good | Good | 1.8 |
| Ex. 52 | Good | Good | 1.4 |
| Ex. 53 | Good | Good | 1.0 |
| Ex. 54 | Good | Slightly uneven density image was formed due to partially uneven charging | 2.0 |

Example 55

Preparation of Charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 50 μm was formed thereon. On both end portions of the charging roller, a Teflon tape was wound to form gap forming materials having a thickness of 50 μm to be contacted with the flanges of the photoreceptor mentioned below. Thus, a charging roller having gap forming layers of 50 μm thick was prepared.

Preparation of Photoreceptor

On an aluminum cylinder, the following undercoat layer coating liquid, charge generation layer coating liquid and charge transport layer coating liquid were coated and dried one by one to overlay an undercoat layer having a thickness of 3.5 μm, a charge generation layer having a thickness of 0.2 μm, and a charge transport layer having a thickness of 28 μm on the aluminum cylinder.

Undercoat Layer Coating Liquid

Titanium oxide powder

400

Melamine resin

65

Alkyd resin

120

2-butanone

400

Charge Generation Layer Coating Liquid

Titanylphthalocayanine

7

Polyvinyl butyral

5

2-butanone

400

Charge Transport Layer Coating Liquid

Polycarbonate

10

Charge transport material having formula (a)

8

Methylene chloride

80

Example 56

The procedures for preparation of the charger and the photoreceptor in Example 55 were repeated except that the thickness of the gap forming materials was changed to 100 μm.

Example 57

The procedures for preparation of the charger and the photoreceptor in Example 55 were repeated except that the thickness of the gap forming materials was changed to 150 μm.

Example 58

The procedures for preparation of the charger and the photoreceptor in Example 55 were repeated except that the thickness of the gap forming materials was changed to 250 μm.

Comparative Example 15

The procedures for preparation of the charger and the photoreceptor in Example 55 were repeated except that the gap forming materials were not formed.

Evaluation Method

Each combination of the charger and the photoreceptor of Example 55 to 58 and Comparative Example 15 was set in a process cartridge having a construction as shown in FIG. 16 in which the gap forming materials of the charger contacted aluminum flanges which were provided on both the end portions of the photoreceptor and which had the same outside diameter as that of the photoreceptor. In addition, gears were provided on the rotating shafts of the charger and the photoreceptor and springs were provided on the rotating shaft of the charger to press the charger toward the photoreceptor to rotate the charger and the photoreceptor at the same speed.

In this case, the photoreceptor and the charger were set such that as shown in FIG. 18 the inside edge GEa (GEb) of the gap forming layer 42*a* (42*b*) is located outside the end PEa (PEb) of the image forming portion 2 of the photoreceptor. The distance t between the inside edge GEa (GEb) of the gap forming layer 42*a* (42*b*) and the end PEa (PEb) of the image forming portion 2 was 2 mm, which is greater than twice the gap g (i.e., the gap was 30 μm in these examples) formed between the photoreceptor and the charger.

A running test in which 22,000 copies were continuously produced was performed using a laser diode emitting light having a wavelength of 780 nm and a polygon mirror. The image qualities of the first and 22,000$^{th}$ images were evaluated. In addition, the abrasion quantity of the surface of the photoreceptor was also measured. The charging conditions are as follows.

DC bias: −900V

AC bias: 2.0 kV (peak to peak voltage)
2 kHz (frequency)

The results are also shown in Table 6.

Example 59

The procedures for preparation and evaluation of the photoreceptor and the charger were repeated except that the springs pressing the charger were not used.

The results are shown in Table 6.

Example 60

The procedures for preparation and evaluation of the photoreceptor and the charger were repeated except that the photoreceptor was frictionally driven by the charger without using gears.

The results are shown in Table 6.

Example 61

The procedures for preparation and evaluation of the photoreceptor and the charger were repeated except that the charger rotated faster than the photoreceptor.

The results are shown in Table 6.

TABLE 6

| | Image qualities (at the beginning of the running test) | Image qualities (at the end of the running test) |
|---|---|---|
| Ex. 55 | Good | good |
| Ex. 56 | Good | good |
| Ex. 57 | Good | good |
| Ex. 58 | Good | Slightly uneven density image was formed due to bad charging. |
| Ex. 59 | Good | Slightly uneven density image was formed due to partially uneven charging. |
| Ex. 60 | Good | It was needed to strongly press the charger and therefore the abrasion quantity of the gap forming layers was large. |
| Ex. 61 | Good | Good, but the abrasion quantity of the gap forming layers was large. |
| Comp. Ex. 15 | Good | Undesired images were observed due to formation of toner film on the charger. |

Combinations of the charger and the photoreceptor in Examples 55 to 61 and Comparative Example 15 were explained while applying them to the process cartridge, however, the combinations can also be used for electrophotographic image forming apparatus other than the process cartridge.

Example 62

The procedures for preparation and evaluation of the charger and the photoreceptor in Example 55 were repeated except that the gap forming material was replaced with an electroconductive label having a resistivity of $5\times10^3$ Ω·cm and a thickness of 70 μm.

As a result of the running test, the image qualities of the image at the beginning of the running test were good but faint undesired images were produced after the 22,000-sheet running test due to bad charging.

Example 63

The procedures for preparation and evaluation of the charger and the photoreceptor in Example 55 were repeated except that the AC bias was not applied when the running test was performed.

As a result of the running test, the image qualities were good at the beginning and end of the running test. When half tone images were produced after the running test, the halftone images had slightly uneven image density due to uneven charging although the half tone images were still acceptable.

Example 64

The procedures for preparation of the charger and the photoreceptor in Example 55 were repeated except that the charge transport layer coating liquid was changed to the following.

Charge Transport Layer Coating Liquid

Charge transport polymer having formula (i)

8

Methylene chloride

80

Example 65

The procedures for preparation of the charger and the photoreceptor in Example 55 were repeated except that the charge transport layer coating liquid was changed to the following.

Charge Transport Layer Coating Liquid

Charge transport polymer having formula (d)

8

Methylene chloride

80

Example 66

The procedures for preparation of the charger and the photoreceptor in Example 55 were repeated except that a protective layer having a thickness of 3 μm was formed on the charge transport layer by coating and drying the following protective layer coating liquid.

Protective Layer Coating Liquid

Charge transport polymer having formula (j)

2

C-form polycarbonate

2

Methylene chloride

80

Example 67

The procedures for preparation of the charger and the photoreceptor in Example 55 were repeated except that a protective layer having a thickness of 2 μm was formed on the charge transport layer by coating and drying the following protective layer coating liquid.

Protective Layer Coating Liquid

Charge transport polymer having formula (j)

2

C-form polycarbonate

2

Titanium oxide

1

Methylene chloride

80

Evaluation Method

Each combination of the photoreceptor and the charger in Examples 55 and 64–67 was set in an image forming apparatus having a construction as shown in FIG. 14 in which a ring member was provided on the rotating shafts of the photoreceptor and the charger to rotate the charger and the photoreceptor at the same speed.

In this case, the photoreceptor and the charger were set such that as shown in FIG. 18 the inside edge GEa (GEb) of the gap forming layer 42*a* (42*b*) is located outside the end PEa (PEb) of the image forming portion 2 of the photoreceptor. The distance t between the inside edge GEa (GEb) of the gap forming layer 42*a* (42*b*) and the end PEa (PEb) of the image forming portion 2 was 2 mm, which is greater than twice the gap g (i.e., the gap was 50 μm in these examples) formed between the photoreceptor and the charger.

A running test in which 40,000 copies were continuously produced was performed using a laser diode emitting light having a wavelength of 780 nm and a polygon mirror. The image qualities of the first and $40{,}000^{th}$ images were evaluated. In addition, the abrasion quantity of the surface of the photoreceptor was also measured. The charging conditions are as follows.

DC bias: −850V

AC bias: 1.9 kV (peak to peak voltage)

2 kHz (frequency)

The results are also shown in Table 7.

Example 68

The procedures for preparation and evaluation of the charger and the photoreceptor in Example 55 were repeated except that the ring member was not used in the image forming apparatus.

The results are shown in Table 7.

TABLE 7

| | Image qualities (at the beginning of the running test) | Image qualities (at the end of the running test) | Abrasion (μm) |
|---|---|---|---|
| Ex. 55 | Good | Faint black streaks were formed but the image was still acceptable. | 3.8 |
| Ex. 64 | Good | Good | 2.0 |
| Ex. 65 | Good | Good | 1.9 |
| Ex. 66 | Good | Good | 1.3 |
| Ex. 67 | Good | Good | 0.9 |
| Ex. 68 | Good | Slightly uneven density image was formed due to partially uneven charging. | 2.2 |

Examples of the Third Embodiment

Example 69

Preparation of charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 75 μm was formed thereon. The central portion of the resistance controlling layer was ground by a grinder by 25 μm. Thus, a charging roller having gap forming layers of 25 μm thick, which are to be contacted with the non-image forming end portions of the photoreceptor, was prepared.

Preparation of Photoreceptor

The following charge generation layer coating liquid and charge transport layer coating liquid were coated on an aluminum layer deposited on a polyethylene terephthalate film (hereinafter referred to as a PET film) and then dried to overlay a charge generation layer having a thickness of 0.3 μm and a charge transport layer having a thickness of 25 μm on the PET film. Even on the both edge portions of the PET film, on which electrostatic latent images are not formed and with which the gap layer of the charger are to be contacted, these layers were formed. Thus, a photoreceptor was prepared.

Charge Generation Layer Coating Liquid

Titanylphthalocyanine

3

Polyvinyl butyral

2 n-butyl acetate

100

Charge Transport Layer Coating Liquid

A-form polycarbonate

10

Charge transport material having formula (a)

8

Methylene chloride

80

Example 70

The procedures for preparation of the charger and the photoreceptor in Example 69 were repeated except that the thickness of the resistance controlling layer was 100 μm and the central portion of the layer was ground by 50 μm by a grinder.

Example 71

The procedures for preparation of the charger and the photoreceptor in Example 69 were repeated except that the thickness of the resistance controlling layer was 125 μm and the central portion of the layer was ground by 75 μm by a grinder.

Example 72

The procedures for preparation of the charger and the photoreceptor in Example 69 were repeated except that the thickness of the resistance controlling layer was 150 μm and the central portion of the layer was ground by 100 μm by a grinder.

Comparative Example 16

The procedures for preparation of the charger and the photoreceptor in Example 69 were repeated except that the thickness of the resistance controlling layer was 50 μm and the central portion of the layer was not ground.

Evaluation Method

Each combination of the charger and the photoreceptor of Examples 69 to 72 and Comparative Example 16 was evaluated as follows.

The both ends of the photoreceptor were joined to form an endless belt photoreceptor to be mounted in an image forming apparatus having a construction as shown in FIG. 15. Then, as shown in FIG. 32, the rotating shaft of a driving roller supporting and driving the endless belt photoreceptor and the rotating shaft of the charger were fixed using a ring member. The endless belt photoreceptor and the gap forming portions of the charger of Examples 69, 70, 71 or 72 contacted only at the non-image end portions of the photoreceptor.

In this case, the photoreceptor and the charger were set such that as shown in FIG. 25 the inside edge GEa (GEb) of the gap forming portion 43*a* (43*b*) is located outside the end PEa (PEb) of the image forming portion 2 of the photoreceptor. The distance t between the inside edge GEa (GEb) of the gap forming portion 4 and the end PEa (PEb) of the image forming portion 2 was 3 mm, which is greater than twice the gap g (i.e., the gap was from 25 to 100 μm in these examples) formed between the photoreceptor and the charger.

With respect to the charger of Comparative Example 16, the entire peripheral surface of the charger of Comparative Example 16 contacted the endless belt photoreceptor.

A running test in which 30,000 copies were continuously produced was performed using a laser diode emitting light having a wavelength of 780 nm and a polygon mirror. The charging conditions are as follows.

DC bias: −900V

AC bias: 2.0 kV (peak to peak voltage)

1.8 kHz (frequency)

The results are shown in Table 8.

Example 73

The procedures for preparation and evaluation of the charger and the photoreceptor in Example 69 were repeated except that the ring member fixing the rotating shafts of the charger and the photoreceptor was not used.

The results are shown in Table 8.

Comparative Example 17

The procedures for preparation and evaluation of the charger and the photoreceptor in Example 69 were repeated except that the distance t was 0 mm.

The results are shown in Table 8.

Example 74

The procedures for preparation and evaluation of the charger and the photoreceptor in Example 69 were repeated except that the distance t was 0.3 mm.

The results are shown in Table 8.

Example 75

The procedures for preparation and evaluation of the charger and the photoreceptor in Example 69 were repeated except that the distance t was 0.5 mm.

The results are shown in Table 8.

TABLE 8

| | Image qualities of the first image | Image qualities of the 30,000th image |
|---|---|---|
| Ex. 69 | Good | Good |
| Ex. 70 | Good | Good |
| Ex. 71 | Good | Good |
| Ex. 72 | Good | Slightly uneven density image was formed due to bad charging. |
| Ex. 73 | Good | Slightly uneven density image was formed due to partially uneven charging. |
| Comp. Ex. 16 | Good | Undesired images were formed due to formation of toner film on the charger. |
| Comp. Ex. 17 | Good | Uneven images were formed on both sides of the copy sheet. In addition, background fouling was observed. |
| Ex. 74 | Good | Good |
| Ex. 75 | Good | Good |

As can be understood from Table 8, when the photoreceptors of Examples 69–71, 74 and 75 are used in combination with the charger of Example 69, good images can be produced even when repeatedly used for a long period of time.

Example 76

The procedures for preparation and evaluation of the charger and the photoreceptor in Example 69 were repeated except that the AC bias was not applied in the image forming operation.

As a result of the running test, the first and 30,000$^{th}$ images were good. However, when half tone images were reproduced after the running test, the half tone images had slightly uneven image density due to uneven charging but the images were still acceptable.

Example 77

Preparation of Charger

An electroconductive roller having a resistance controlling layer having a thickness of 130 μm was prepared according to the method described in Japanese Patent No. 2,632,578, which is mentioned above. In addition, the central portion of the roller was cut by 80 μm by a cutting tool to form projected portions on both end portions of the electroconductive roller.

Thus a charger having gap forming portions having a thickness of 80 μm was prepared.

Preparation of Photoreceptor

On an aluminum cylinder, the following undercoat layer coating liquid, charge generation layer coating liquid and charge transport layer coating liquid were coated and dried one by one to form an undercoat layer having a thickness of 4.0 μm, a charge generation layer having a thickness of 0.2 μm and a charge transport layer having a thickness of 27 μm on the aluminum cylinder.

Thus, a photoreceptor was prepared. In this case, these three layers were formed on the non-image portions of the photoreceptor to be contacted with the gap forming member of the charger.

Undercoat Layer Coating Liquid

Titanium oxide powder
400

Melamine resin
65

Alkyd resin
120

2-butanone
400

Charge Generation Layer Coating Liquid

Trisazo pigment having formula (b)
10

Polyvinyl butyral
4

2-butanone
200

Cyclohexanone
400

Charge Transport Layer Coating Liquid

Polycarbonate
10

Charge transport material having formula (c)
8

Methylene chloride
80

Example 78

The procedures for preparation of the charger and the photoreceptor in Example 77 were repeated except that the charge transport layer coating liquid was changed to the following.

Charge Transport Layer Coating Liquid

Charge transport polymer having formula (d)
8

Methylene chloride
80

Example 79

The procedures for preparation of the charger and the photoreceptor in Example 77 were repeated except that the following protective layer coating liquid was coated on the charge transport layer and dried to form a protective layer having a thickness of 2 μm thereon.

Protective Layer Coating Liquid

Charge transport polymer having formula (d)
4

Z-form polycarbonate
4

Methylene chloride
80

Example 80

The procedures for preparation of the charger and the photoreceptor in Example 77 were repeated except that the following protective layer coating liquid was coated on the charge transport layer and dried to form a charge transport layer having a thickness of 2 μm.

Protective Layer Coating Liquid

Charge transport polymer having formula (d)
4

Z-form polycarbonate
4

Titanium oxide
1

Methylene chloride
80

Comparative Example 18

The procedures for preparation of the charger and the photoreceptor in Example 77 were repeated except that the thickness of the resistance controlling layer was 50 μm and the gap forming portions were not formed on the charger (i.e., the cutting treatment was not performed).

Comparative Example 19

The procedures for preparation of the charger and the photoreceptor in Example 78 were repeated except that the thickness of the resistance controlling layer was 50 μm and the gap forming portions were not formed on the charger (i.e., the cutting treatment was not performed).

Comparative Example 20

The procedures for preparation of the charger and the photoreceptor in Example 79 were repeated except that the thickness of the resistance controlling layer was 50 μm and the gap forming portions were not formed on the charger (i.e., the cutting treatment was not performed).

Comparative Example 21

The procedures for preparation of the charger and the photoreceptor in Example 80 were repeated except that the thickness of the resistance controlling layer was 50 μm and the gap forming portions were not formed on the charger (i.e., the cutting treatment was not performed).

Evaluation Method

Each combination of the charger and the photoreceptor in Examples 77 to 80 and Comparative Examples 18 to 21 was evaluated using an image forming apparatus having a construction as shown in FIG. 14, in which gears were provided on the rotating shafts of the cylindrical photoreceptor and the charger to rotate the charger and the photoreceptor at the same speed and springs were provided on the rotating shaft of the charger to press the charger toward the photoreceptor.

In this case, the photoreceptor and the charger were set such that as shown in FIG. 25 the inside edge GEa (GEb) of the gap forming portion 43*a* (43*b*) is located outside the end PEa (PEb) of the image forming portion 2 of the photoreceptor. The distance t between the inside edge GEa (GEb) of the gap forming portion 43*a* (43*b*) and the end PEa (PEb) of the image forming portion 2 was 2 mm, which is greater than twice the gap g (i.e., 80 μm) formed between the photoreceptor and the charger.

With respect to the chargers of Comparative Examples 18 to 21, the entire peripheral surface of the chargers contacted the photoreceptor.

A running test in which 50,000 images were continuously produced was performed using a laser diode emitting light having a wavelength of 780 nm and a polygon mirror. The image qualities of the first and 50,000$^{th}$ images were evaluated. In addition, the abrasion quantity of the surface of the photoreceptor was also measured. The charging conditions are as follows.

DC bias: −850V

AC bias: 1.8 kV (peak to peak voltage)
2.2 kHz (frequency)

The results are shown in Table 9.

Example 81

The procedures for preparation and evaluation of the charger and the photoreceptor in Example 77 were repeated except that the springs pressing the charger were not used.

The results are shown in Table 9.

Example 82

The procedures for preparation and evaluation of the charger and the photoreceptor in Example 77 were repeated except that the photoreceptor was frictionally driven by the charger without using the gears.

The results are shown in Table 9.

Example 83

The procedures for preparation and evaluation of the charger and the photoreceptor in Example 77 were repeated except that the charger rotated faster than the photoreceptor.

The results are shown in Table 9.

TABLE 9

| | Image qualities of the first image | Image qualities of the 50,000$^{th}$ image | Abrasion quantity (μm) |
|---|---|---|---|
| Ex. 77 | Good | Faint black streaks were formed but the image was still acceptable. | 4.2 |
| Ex. 78 | Good | Good | 1.9 |
| Ex. 79 | Good | Good | 1.5 |
| Ex. 80 | Good | Good | 0.7 |
| Ex. 81 | Good | Slightly uneven density image was formed due to partially uneven charging. | 4.0 |
| Ex. 82 | Good | Good. Since it was needed to enlarge the pressure applied to the charger, the abrasion quantity of the gap layers was large. | 4.6 |
| Ex. 83 | Good | Good. The abrasion quantity of the gap layers was large. | 4.8 |
| Comp. Ex. 18 | Good | Undesired images were produced due to formation of toner film on the charger. | 4.2 |
| Comp. Ex. 19 | Good | Undesired images were produced due to formation of toner film on the charger. | 1.8 |
| Comp. Ex. 20 | Good | Undesired images were produced due to formation of toner film on the charger. | 1.4 |
| Comp. Ex. 21 | Good | Undesired images were produced due to formation of toner film on the charger. | 0.5 |

Example 84

The procedures for preparation and evaluation of the charger and the photoreceptor in Example 77 were repeated except that the AC bias was not applied in the image forming operation.

As a result of the running test, the first and 50,000$^{th}$ images were good. However, when half tone images were reproduced after the running test, the half tone images had slightly uneven image density due to uneven charging but the half tone images were still acceptable.

Example 85

Preparation of Charger

An electroconductive roller was prepared according to the method of Example 4 described in Japanese Laid-Open Patent Publication No. 5-341627, which is mentioned above. The thickness of the surface layer was 100 μm. In addition, the central portion of the surface of the roller was ground by 60 μm by a grinder to form projected portions on both end portions of the electroconductive roller.

Thus a charger having gap forming portions having a thickness of 60 μm was prepared.

Preparation of Photoreceptor

The surface of an aluminum cylinder was anodized and then sealed. On the thus anodized aluminum cylinder, the following charge generation layer coating liquid and charge transport layer coating liquid were coated and dried one by one to form a charge generation layer having a thickness of 0.2 μm and a charge transport layer having a thickness of 23 μm. These layers were formed on the edge portions of the photoreceptor to be contacted with the gap forming portions.

Charge Generation Layer Coating Liquid

Charge generation material having formula (e)
1

Charge generation material having formula (f)
1

Polyvinyl butyral
1

Cyclohexanone

70

Cyclohexane

30

Charge Transport Layer Coating Liquid

Charge transport material having formula (g)

7

Polycarbonate

10

Tetrahydrofuran

100

Example 86

The procedures for preparation of the charger and the photoreceptor in Example 85 were repeated except that the charge transport layer coating liquid was changed to the following.

Charge Transport Layer Coating Liquid

Charge transport polymer having formula (d)

8

Methylene chloride

80

Example 87

The procedures for preparation of the charger and the photoreceptor in Example 85 was repeated except that a protective layer having a thickness of 2 μm was formed on the charge transport layer by coating and drying the following protective layer coating liquid.

Protective Layer Coating Liquid

Charge transport polymer having formula (d)

4

Z-form polycarbonate

4

Methylene chloride

80

Example 88

The procedures for preparation of the charger and the photoreceptor in Example 85 were repeated except that a protective layer having a thickness of 2 μm was formed on the charge transport layer by coating and drying the following protective layer coating liquid.

Protective Layer Coating Liquid

Charge transport polymer having formula (d)

4

Z-form polycarbonate

4

Titanium oxide

1

Methylene chloride

80

Comparative Example 22

The procedures for preparation of the charger and the photoreceptor in Example 85 were repeated except that the thickness of the surface layer was 40 μm and the gap forming portions were not formed (i.e., the grinding treatment was not performed).

Evaluation Method

Each combination of the photoreceptor and the charger in Examples 85 to 88 and Comparative Example 22 was set in a process cartridge having a construction as shown in FIG. 16 in which gears were provided on the rotating shafts of the driving roller supporting the photoreceptor and the charger to rotate the charger and the photoreceptor at the same speed and springs were provided on the rotating shaft of the charger to press the charger toward the photoreceptor.

In this case, the photoreceptor and the charger were set such that as shown in FIG. 25 the inside edge GEa (GEb) of the gap forming portion 43*a* (43*b*) is located outside the end PEa (PEb) of the image forming portion 2 of the photoreceptor. The distance t between the inside edge GEa (GEb) of the gap forming portion 43*a* (43*b*) and the end PEa (PEb) of the image forming portion 2 was 2 mm, which is greater than twice the gap g (i.e., the gap was 60 μm in these examples) formed between the photoreceptor and the charger.

With respect to the chargers of Comparative Example 22, the entire peripheral surface of the chargers contacted the photoreceptor.

A running test in which 20,000 copies were continuously produced was performed using a laser diode emitting light having a wavelength of 780 nm and a polygon mirror. The potential of the non-lighted area of the photoreceptor, which was not exposed to imagewise light, was measured at the beginning and end of the running test with a probe of a surface potential meter set at a position just before the developing section. In addition, at the end of the running test, half tone images were produced to evaluate the image qualities. The charging conditions are as follows.

DC bias: −850V

AC bias: 1.8 kV (peak to peak voltage)

2.2 kHz (frequency)

The results are also shown in Table 10.

Example 89

The procedures for preparation and evaluation of the charger and the photoreceptor in Example 85 were repeated except that the springs pressing the rotating shaft of the charger were not used.

The results are also shown in Table 10.

Example 90

The procedures for preparation and evaluation of the charger and the photoreceptor in Example 85 were repeated except that the photoreceptor was frictionally driven by the charger without using the gears.

The results are also shown in Table 10.

Example 91

The procedures for preparation and evaluation of the charger and the photoreceptor in Example 85 were repeated except that the charger rotated faster than the photoreceptor.

The results are also shown in Table 10.

TABLE 10

| | Potential (At the beginning) (V) | Potential (At the end) (V) | Image qualities of half tone images |
|---|---|---|---|
| Ex. 85 | −852 | −847 | Good |
| Ex. 86 | −850 | −845 | Good |
| Ex. 87 | −845 | −840 | Good |
| Ex. 88 | −850 | −838 | Good |
| Ex. 89 | −853 | −840 | Good |
| Ex. 90 | −850 | −842 | Good |
| Ex. 91 | −852 | −847 | Good |
| Comp. Ex. 12 | −828 | −808 | Uneven density image |

Example 92

The procedures for preparation and evaluation of the charger and the photoreceptor in Example 85 were repeated except that the AC bias was not applied in the image forming operation.

As a result of the running test, the first and 20,000$^{th}$ images were good. However, when half tone images were reproduced after the running test, the half tone images had slightly uneven image density due to uneven charging but the half tone images were still acceptable.

Example 93

Preparation of Charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 75 μm was formed thereon. On the both end portions of the charging roller, projected portions having a thickness of 25 μm to be contacted with the non-image portion of the photoreceptor mentioned below was formed by cutting the central portion of the resistance controlling layer. Thus, a charging roller having gap forming member of 25 μm thick was prepared.

Preparation of Photoreceptor

The following undercoat layer coating liquid, charge generation layer coating liquid and charge transport layer coating liquid were coated on an aluminum cylinder and then dried to overlay an undercoat layer having a thickness of 3.5 μm, a charge generation layer having a thickness of 0.2 μm and a charge transport layer having a thickness of 28 μm on the aluminum cylinder. Thus, a photoreceptor was prepared.

| Undercoat layer coating liquid | | |
|---|---|---|
| Titanium 400 | dioxide | powder |
| Melamine 65 | | resin |
| Alkyd 120 | | resin |
| 2-butanone 400 | | |

Charge Generation Layer Coating Liquid

Charge generation material having formula (e)
1

Charge generation material having formula (f)
1

Polyvinyl butyral
1

Cyclohexanone
70

Cyclohexane
30

Charge Transport Layer Coating Liquid

Polycarbonate
10

Charge transport material having formula (a)
8

Methylene chloride
80

Example 94

The procedures for preparation of the charger and the photoreceptor in Example 93 were repeated except that the thickness of the surface layer was 100 μm and the thickness of the gap forming portions was 50 μm (i.e., the cutting thickness was 50 μm).

Example 95

The procedures for preparation of the charger and the photoreceptor in Example 93 were repeated except that the thickness of the surface layer was 150 μm and the thickness of the gap forming portions was 100 μm (i.e., the cutting thickness was 100 μm).

Example 96

The procedures for preparation of the charger and the photoreceptor in Example 93 were repeated except that the thickness of the surface layer was 300 μm and the thickness of the gap forming portions was 250 μm (i.e., the cutting thickness was 250 μm).

Example 97

The procedures for preparation of the charger and the photoreceptor in Example 93 were repeated except that the thickness of the surface layer was 50 μm and the gap forming portions were not formed (i.e., the cutting treatment was not performed).

Evaluation Method

Each combination of the charger and the photoreceptor of in Examples 93 to 96 and Comparative Example 23 was set in a process cartridge having a construction as shown in FIG. 16 in which as shown in FIG. 26 the gap forming members (gap forming portions) of the charger contact the flanges provided on both end portions of the photoreceptor. In addition, gears were provided on the rotating shafts of the charger and the photoreceptor and springs were provided on the rotating shaft of the charger to press the charger toward the photoreceptor to rotate the charger and the photoreceptor at the same speed.

In this case, the photoreceptor and the charger were set such that as shown in FIG. 27 the inside edge GEa (GEb) of the gap forming portion 44*a* (44*b*) is located outside the end PEa (PEb) of the image forming portion 2 of the photoreceptor. The distance t between the inside edge GEa (GEb) of the gap forming portion 44*a* (44*b*) and the end PEa (PEb) of the image forming portion 2 was 2 mm, which is greater than twice the gap g (i.e., the gap was 50 to 250 pm in these examples) formed between the photoreceptor and the charger.

A running test in which 22,000 copies were continuously produced was performed using a laser diode emitting light having a wavelength of 780 nm and a polygon mirror. The image qualities of the first and 22,000$^{th}$ images were evaluated. In addition, the abrasion quantity of the surface of the photoreceptor was also measured. The charging conditions are as follows.

DC bias: −900V

AC bias: 1.8 kV (peak to peak voltage)
1.8 kHz (frequency)

The results are also shown in Table 11.

Comparative Example 24

The procedures for preparation and evaluation of the photoreceptor and the charger in Example 93 were repeated except that the distance t was 0 mm.

Example 97

The procedures for preparation and evaluation of the photoreceptor and the charger in Example 93 were repeated except that the distance t was 0.3 mm.

Example 98

The procedures for preparation and evaluation of the photoreceptor and the charger in Example 93 were repeated except that the distance t was 0.5 mm.

Example 99

The procedures for preparation and evaluation of the photoreceptor and the charger in Example 93 were repeated except that the springs pressing the charger were not used.

The results are also shown in Table 11.

Example 100

The procedures for preparation and evaluation of the photoreceptor and the charger in Example 93 were repeated except that the photoreceptor was frictionally driven by the charger without using the gears.

The results are also shown in Table 11.

Example 101

The procedures for preparation and evaluation of the photoreceptor and the charger in Example 93 were repeated except that the charger rotated faster than the photoreceptor.

The results are also shown in Table 11.

TABLE 11

| | Image qualities (at the beginning) | Image qualities (at the end) |
|---|---|---|
| Ex. 93 | Good | Good |
| Ex. 94 | Good | Good |
| Ex. 95 | Good | Good |
| Ex. 96 | Good | Slightly uneven density image was formed due to bad charging. |
| Comp. Ex. 24 | Good | Uneven images were observed at both edges of the copy. In addition, background fouling was observed. |
| Ex. 97 | Good | Good |
| Ex. 98 | Good | Good |
| Ex. 99 | Good | Slightly uneven density image was formed due to partially uneven charging |
| Ex. 100 | Good | It was needed to increase the pressure to the charger, and the abrasion quantity of the gap forming portions was large. |
| Ex. 101 | Good | Good. However, the abrasion quantity of the gap forming portions was large. |
| Comp. Ex. 25 | Good | Undesired images were formed due to formation of toner film on the charger. |

Combinations of the chargers and the photoreceptors in Examples 93 to 101 and Comparative Examples 24 and 25 were explained while applying them to the process cartridge, however, the combinations can also be used for electrophotographic image forming apparatus other than the process cartridge.

Example 102

The procedures for preparation and evaluation of the photoreceptor and the charger in Example 93 were repeated except that the flanges were changed to flanges made of stainless steel (i.e., electroconductive flanges).

As a result of the running test, the 22,000$^{th}$ image had faint undesired image due to bad charging although the initial image was good.

Example 103

The procedures for preparation and evaluation of the charger and the photoreceptor in Example 93 were repeated except that the AC bias was not applied in the image forming operation.

As a result, the first and 22,000$^{th}$ images were good. However, when half tone images were reproduced after the running test, the half tone images had slightly uneven image density due to uneven charging although the images were still acceptable.

Example 104

The procedures for preparation of the charging roller and the photoreceptor in Example 93 were repeated except that the charge transport layer coating liquid was changed to the following.

Charge Transport Layer Coating Liquid

Charge transport polymer having formula (k)

8

Methylene chloride

80

Example 105

The procedures for preparation of the charger and the photoreceptor in Example 93 were repeated except that the charge transport layer coating liquid was changed to the following.

Charge Transport Layer Coating Liquid

Charge transport polymer having formula (1)

8

(1)

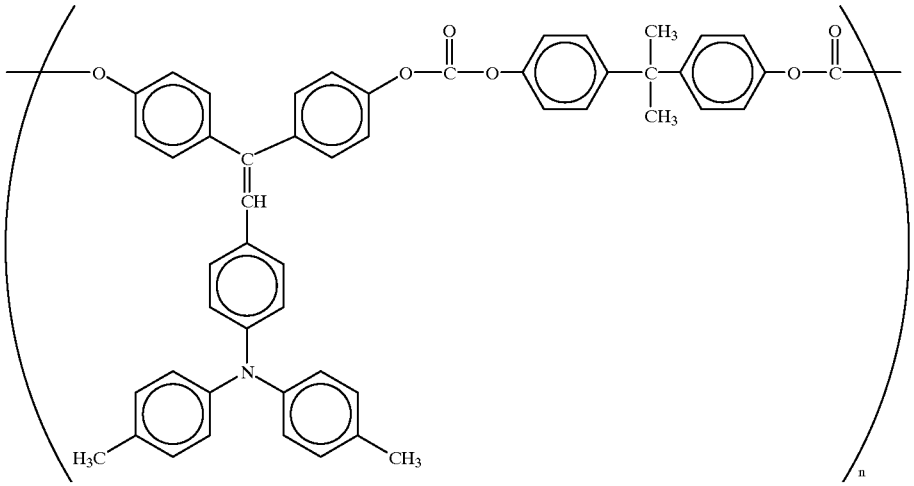

Methylene chloride
80

Example 106

The procedures for preparation of the charger and the photoreceptor in Example 93 were repeated except that a protective layer having a thickness of 3 μm was formed on the charge transport layer by coating the following protective layer coating liquid and then drying the coated liquid.

Protective Layer Coating Liquid

Charge transport polymer having formula (j)
2

C-form polycarbonate
2

Methylene chloride
80

Example 107

The procedures for preparation of the charger and the photoreceptor in Example 93 were repeated except that a protective layer having a thickness of 2 μm was formed on the charge transport layer by coating the following protective layer coating liquid and then drying the coated liquid.

Protective Layer Coating Liquid

Charge transport polymer having formula (j)
2

C-form polycarbonate
2

Titanium oxide
1

Methylene chloride
80

Evaluation Method

Each combination of the photoreceptor and the charger in Examples 93 and 104–107 was set in an image forming apparatus having a construction as shown in FIG. 14 in which as shown in FIG. 26 the gap forming portions of the charger contact the flanges provided on both end portions of the photoreceptor. In addition, a ring member was provided on the rotating shafts of the charger and the photoreceptor to rotate the charger and the photoreceptor at the same speed and springs were provided on the rotating shaft of the charger to press the charger toward the photoreceptor.

In this case, the photoreceptor and the charger were set such that as shown in FIG. 27 the inside edge GEa (GEb) of the gap forming portion 44*a* (44*b*) is located outside the end PEa (PEb) of the image forming portion 2 of the photoreceptor. The distance t between the inside edge GEa (GEb) of the gap forming portion 44*a* (44*b*) and the end PEa (PEb) of the image forming portion 2 was 2 mm, which is greater than twice the gap g (i.e., the gap was 50 μm in these examples) formed between the photoreceptor and the charger.

A running test in which 40,000 copies were continuously produced was performed using a laser diode emitting light having a wavelength of 780 nm and a polygon mirror. The image qualities of the first and 40,000$^{th}$ images were evaluated. In addition, the abrasion quantity of the surface of the photoreceptor was also measured. The charging conditions are as follows.

DC bias: −900 V

AC bias: 1.8 kV (peak to peak voltage)
2 kHz (frequency)

The results are also shown in Table 12.

Example 108

The procedures for preparation and evaluation of the photoreceptor and the charger in Example 93 were repeated except that running test was performed without using the ring member.

The results are shown in Table 12.

TABLE 12

| | Image qualities of the first image | Image qualities of the 40,000$^{th}$ image | Abrasion quantity (μm) |
|---|---|---|---|
| Ex. 93 | Good | Faint black streaks were formed but the image was still acceptable. | 3.9 |
| Ex. 104 | Good | Good | 1.9 |
| Ex. 105 | Good | Good | 1.8 |
| Ex. 106 | Good | Good | 1.3 |
| Ex. 107 | Good | Good | 0.8 |
| Ex. 108 | Good | Slightly uneven density image was formed due to partially uneven charging. | 2.1 |

Example 109

Preparation of Charger

An electroconductive roller was prepared according to the method described in Japanese Patent No. 2,632,578, which is mentioned above. The resistance controlling layer had a thickness of 100 μm. Then the central portion of the resistance controlling layer was cut by 50 μm with a cutting tool such that projected portions having a thickness of 50 μm were formed on both end portions of the electroconductive roller.

Thus a charger having a gap forming member having a thickness of 50 μm was prepared.

Preparation of Photoreceptor

On an aluminum cylinder, the following undercoat layer coating liquid, charge generation layer coating liquid and charge transport layer coating liquid were coated and dried one by one to form an undercoat layer having a thickness of 4.0 μm, a charge generation layer having a thickness of 0.2 μm and a charge transport layer having a thickness of 27 μm on the aluminum cylinder.

Thus, a photoreceptor was prepared.

Undercoat Layer Coating Liquid

Titanium oxide powder
400

Melamine resin
65

Alkyd resin
120

2-butanone
400

Charge Generation Layer Coating Liquid

Titanylphthalocyanine
3

Polyvinyl butyral
2 n-butyl acetate
100

Charge Transport Layer Coating Liquid

A-form polycarbonate
10

Charge transport material having formula (a)
8

Methylene chloride
80

Example 110

The procedures for preparation of the charger and the photoreceptor in Example 109 were repeated except that the thickness of the resistance controlling layer was 120 μm and the thickness of the gap forming portions was 70 μm (i.e., the cutting thickness was 70 μm).

Example 111

The procedures for preparation of the charger and the photoreceptor in Example 109 were repeated except that the thickness of the surface layer was 200 μm and the thickness of the gap forming portion was 150 μm (i.e., the cutting thickness was 150 μm).

Example 112

The procedures for preparation of the charger and the photoreceptor in Example 109 were repeated except that the thickness of the surface layer was 280 μm and the thickness of the gap forming portions was 230 μm (i.e., the cutting thickness was 230 μm).

Comparative Example 26

The procedures for preparation of the charger and the photoreceptor in Example 109 were repeated except that the thickness of the surface layer was 50 μm and the gap forming portions were not formed (i.e., the cutting treatment was not performed).

Evaluation Method

Each combination of the photoreceptor and the charger in Example 109 to 113 and Comparative Example 26 was set in a process cartridge having a construction as shown in FIG. 16 in which as shown in FIG. 26 the gap forming portions of the charger contact the flanges provided on both end portions of the photoreceptor. In addition, gears were provided on the rotating shafts of the charger and the photoreceptor to rotate the charger and the photoreceptor at the same speed and springs were provided on the rotating shaft of the charger to press the charger toward the photoreceptor.

In this case, the photoreceptor and the charger were set such that as shown in FIG. 27 the inside edge GEa (GEb) of the gap forming portion 44*a* (44*b*) is located outside the end PEa (PEb) of the image forming portion 2 of the photoreceptor. The distance t between the inside edge GEa (GEb) of the gap forming portion and the end PEa (PEb) of the image forming portion 2 was 2 mm, which is greater than twice the gap g (i.e., the gap was 50 to 230 μm) formed between the photoreceptor and the charger.

A running test in which 25,000 copies were continuously produced was performed using a laser diode emitting light having a wavelength of 780 nm and a polygon mirror. The image qualities of the first and $25{,}000^{th}$ images were evaluated. In addition, the abrasion quantity of the surface of the photoreceptor was also measured. The charging conditions are as follows.

DC bias: −850 V

AC bias: 2.0 kV (peak to peak voltage)
1.8 kHz (frequency)

The results are also shown in Table 13.

Example 113

The procedures for preparation and evaluation of the photoreceptor and the charger in Example 109 were repeated except that the springs pressing the charger were not used in the image forming apparatus.

The results are also shown in Table 13.

Example 114

The procedures for preparation and evaluation of the photoreceptor and the charger in Example 109 were repeated except that the photoreceptor was frictionally driven by the charger without using the gears.

The results are also shown in Table 13.

Example 115

The procedures for preparation and evaluation of the photoreceptor and the charger in Example 109 were repeated except that the charger rotated faster than the photoreceptor.

The results are also shown in Table 13.

TABLE 13

| | Image qualities (at the beginning) | Image qualities (at the end) |
|---|---|---|
| Ex. 109 | Good | Good |
| Ex. 110 | Good | Good |
| Ex. 111 | Good | Good |
| Ex. 112 | Good | Slightly uneven density image was formed due to bad charging. |
| Ex. 113 | Good | Slightly uneven density image was formed due to partially uneven charging. |
| Ex. 114 | Good | It was needed to increase the pressure to the charger, and therefore the abrasion quantity of the gap forming portions was large. |
| Ex. 115 | Good | Good. However, the abrasion of the gap forming portions was large. |
| Comp. Ex. 26 | Good | Undesired images were formed due to formation of toner film on the charger. |

Combinations of the chargers and the photoreceptors in Examples 109 to 115 and Comparative Example 26 were explained while applying them to the process cartridge, however, the combinations can also be used for electrophotographic image forming apparatus other than the process cartridge.

Example 116

The procedures for preparation and evaluation of the photoreceptor and the charger in Example 109 were repeated except that the flanges were changed to flanges made of stainless steel (i.e., electroconductive flanges).

As a result of the running test, the 25,000$^{th}$ image had slightly undesired image due to bad charging although the initial image was good.

Example 117

The procedures for preparation and evaluation of the charger and the photoreceptor in Example 109 were repeated except that the AC bias was not applied in the image forming operation.

As a result of the running test, the first and 25,000$^{th}$ images were good. However, when half tone images were reproduced after the running test, the half tone images had slightly uneven image density due to uneven charging but the half tone images were still acceptable.

Example 118

The procedures for preparation of the charger and the photoreceptor in Example 109 were repeated except that the charge transport layer coating liquid was changed to the following.

Charge Transport Layer Coating Liquid

Charge transport material having formula (1)

8

Methylene chloride

80

Example 119

The procedures for preparation of the charger and the photoreceptor in Example 109 were repeated except that the charge transport layer coating liquid was changed to the following.

Charge Transport Layer Coating Liquid

Charge transport polymer having formula (j)

8

Methylene chloride

80

Example 120

The procedures for preparation of the charger and the photoreceptor in Example 109 were repeated except that the thickness of the charge transport layer was 24 $\mu$m and a protective layer having a thickness of 3 $\mu$m was formed on the charge transport layer by coating the following protective layer coating liquid and then drying the coated liquid.

Protective Layer Coating Liquid

Charge transport polymer having formula (j)

2

C-form polycarbonate

2

Methylene chloride

80

Example 121

The procedures for preparation of the charger and the photoreceptor in Example 109 were repeated except that the thickness of the charge transport layer was 25 $\mu$m and a protective layer having a thickness of 2 $\mu$m was formed on the charge transport layer by coating the following protective layer coating liquid and then drying the coated liquid.

Protective Layer Coating Liquid

Charge transport polymer having formula (j)

2

C-form polycarbonate

2

Titanium oxide

1

Methylene chloride

80

Evaluation Method

Each combination of the photoreceptor and the charger in Examples 109 and 118–121 was set in an image forming apparatus having a construction as shown in FIG. 14 in which as shown in FIG. 26 the gap forming portions of the charger contact the flanges provided on both end portions of the photoreceptor. In addition, a ring member was provided on the rotating shafts of the charger and the photoreceptor to rotate the charger and the photoreceptor at the same speed and springs were provided on the rotating shaft of the charger to press the charger toward the photoreceptor.

In this case, the photoreceptor and the charger were set such that as shown in FIG. 27 the inside edge GEa (GEb) of the gap forming portion 44*a* (44*b*) is located outside the end PEa (PEb) of the image forming portion 2 of the photoreceptor. The distance t between the inside edge GEa (GEb) of the gap forming portion 44*a* (44*b*) and the end PEa (PEb) of the image forming portion 2 was 2 mm, which is greater than twice the gap g (i.e., the gap was 50 $\mu$m in these examples) formed between the photoreceptor and the charger.

A running test in which 40,000 copies were continuously produced was performed using a laser diode emitting light having a wavelength of 780 nm and a polygon mirror. The image qualities of the first and 40,000$^{th}$ images were evaluated. In addition, the abrasion quantity of the surface of the photoreceptor was also measured. The charging conditions are as follows.

DC bias: −850 V

AC bias: 2.0 kV (peak to peak voltage)
2 kHz (frequency)

The results are also shown in Table 14.

Example 122

The procedures for preparation and evaluation of the photoreceptor and the charger in Example 109 were repeated except that running test was performed without using the ring member.

The results are shown in Table 14.

TABLE 14

| | Image qualities of the first image | Image qualities of the 40,000$^{th}$ image | Abrasion quantity ($\mu$m) |
|---|---|---|---|
| Ex. 109 | Good | Faint black streaks were formed but the image was still acceptable. | 4.3 |
| Ex. 118 | Good | Good | 2.2 |
| Ex. 119 | Good | Good | 2.1 |
| Ex. 120 | Good | Good | 1.5 |
| Ex. 121 | Good | Good | 1.0 |
| Ex. 122 | Good | Slightly uneven density image was formed due to partially uneven charging. | 2.5 |

Examples of the Fifth Embodiment

Example 123

Preparation of Charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 50 $\mu$m was formed thereon. On the both end portions of the charging roller, a gap forming layer having a thickness of 90 $\mu$m to be contacted with the non-image portion of the photoreceptor mentioned below was formed by coating a polycarbonate resin solution, in which an alumina was dispersed, using a spray coating liquid and drying the resin solution. Thus, a charging roller having gap forming layers of 90 $\mu$m thick was prepared.

Preparation of Photoreceptor

The following undercoat layer coating liquid, charge generation layer coating liquid and charge transport layer coating liquid were coated on a nickel seamless belt having a thickness of 30 $\mu$m and then dried to overlay an undercoat layer having a thickness of 2.0 $\mu$m, a charge generation layer having a thickness of 0.2 $\mu$m and a charge transport layer having a thickness of 28 $\mu$m on the nickel belt. Thus, a photoreceptor was prepared.

Undercoat Layer Coating Liquid

Titanium dioxide powder
400

Melamine resin
65

Alkyd resin
120

2-butanone
400

Charge Generation Layer Coating Liquid

Trisazo pigment having formula (b)
6

Bisazo pigment having formula (f)
4

Polyvinyl butyral
5

2-butanone
200

Cyclohexanone
400

Charge Transport Layer Coating Liquid

Polycarbonate
10

Charge transport material having the following formula (m)
8

(m)

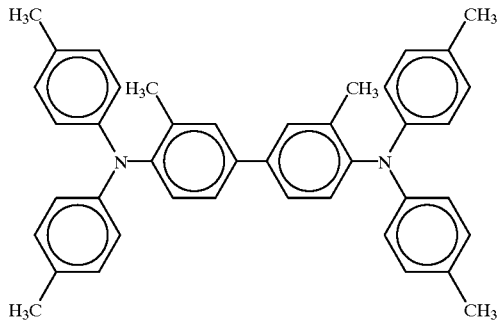

Methylene chloride
80

Example 124

The procedures for preparation of the charger and the photoreceptor in Example 123 were repeated except that the thickness of the gap forming layers was 130 $\mu$m.

Example 125

The procedure for preparation of the charger and the photoreceptor in Example 123 were repeated except that the thickness of the gap forming layers was 180 $\mu$m.

Example 126

The procedures for preparation of the charger and the photoreceptor in Example 123 were repeated except that the thickness of the gap forming layers was 290 $\mu$m.

Comparative Example 27

The procedures for preparation of the charger and the photoreceptor in Example 123 were repeated except that the gap forming layers were not formed.

Evaluation Method

Each combination of the photoreceptor and the charger in Example 123 to 126 and Comparative Example 27 was set in a process cartridge having a construction as shown in FIG.

35 such that the gap forming layers of the charger contacted only the driving roller supporting the photoreceptor. In this case, the difference between the surface of the photoreceptor and the surface of the driving roller was 60 μm.

In this case, the photoreceptor and the charger were set such that as shown in FIG. 30 the inside edge GEa (GEb) of the gap forming layer 45*a* (45*b*) is located outside the end PEa (PEb) of the image forming portion 2 of the photoreceptor. The distance t between the inside edge GEa (GEb) of the gap forming layer 45*a* (45*b*) and the end PEa (PEb) of the image forming portion 2 was 2 mm, which is greater than twice the gap g (i.e., the gap was from 30 to 230 μm in these examples) formed between the photoreceptor and the charger.

With respect to the charger of Comparative Example 27, the entire peripheral surface of the charger of Comparative Example 27 contacted the endless belt photoreceptor.

In addition, as shown in FIG. 34 gears G1 and G2 were provided on the rotating shafts of the charger and the driving roller such that the charger and the photoreceptor rotated at the same speed, and springs Sa and Sb were set on the rotating shaft of the charger to press the charger toward the photoreceptor.

A running test in which 23,000 copies were continuously produced was performed using a laser diode emitting light having a wavelength of 780 nm and a polygon mirror. The charging conditions are mentioned below.

DC bias: −900 V

AC bias: 1.8 kV (peak to peak voltage)
2.2 kHz (frequency)

The results are shown in Table 15.

Comparative Example 28

The procedures for preparation and evaluation of the photoreceptor and the charger in Example 123 were repeated except that the distance t was 0 mm.

Example 127

The procedures for preparation and evaluation of the photoreceptor and the charger in Example 123 were repeated except that the distance t was 0.5 mm.

Example 128

The procedures for preparation and evaluation of the photoreceptor and the charger in Example 123 were repeated except that the distance t was 1.0 mm.

Example 129

The procedures for preparation and evaluation of the photoreceptor and the charger in Example 123 were repeated except that the springs Sa and Sb pressing the charger were not used.

The results are shown in Table 15.

Example 130

The procedures for preparation and evaluation of the photoreceptor and the charger in Example 123 were repeated except that the charger was frictionally driven by the driving roller without using the gear G1.

The results are shown in Table 15.

Example 131

The procedures for preparation and evaluation of the photoreceptor and the charger in Example 123 were repeated except that the charger rotated faster than the photoreceptor.

The results are shown in Table 15.

TABLE 15

| | Image qualities (at the beginning) | Image qualities (at the end) |
|---|---|---|
| Ex. 123 | Good | Good |
| Ex. 124 | Good | Good |
| Ex. 125 | Good | Good |
| Ex. 126 | Good | Slightly uneven density image was formed due to bad charging. |
| Comp. Ex. 27 | Good | Undesired images were formed due to formation of toner film on the surface of the charger. |
| Comp. Ex. 28 | Good | Uneven images were formed on both sides of the images. In addition, background fouling was observed. |
| Ex. 127 | Good | Good |
| Ex. 128 | Good | Good |
| Ex. 129 | Good | Slightly uneven density image was formed due to partially uneven charging. |
| Ex. 130 | Good | It was needed to increase the pressure to the charger, and therefore the abrasion quantity of the gap forming layers was large. |
| Ex. 131 | Good | Good. However, the abrasion quantity of the gap forming layer was large. |

Combinations of the chargers and the photoreceptors in Examples 123 to 131 and Comparative Examples 27 and 28 of the fifth embodiment were explained while applying them to the process cartridge, however, the combinations can also be used for electrophotographic image forming apparatus other than the process cartridge.

Example 132

The procedures for preparation and evaluation of the photoreceptor and the charger in Example 123 were repeated except that the gap forming layers were formed by coating a polycarbonate solution in which an electroconductive carbon black was dispersed.

As a result of the running test, the initial image was good, however the 23,000$^{th}$ image had faint undesired images due to bad charging.

Example 133

The procedures for preparation and evaluation of the charger and the photoreceptor in Example 123 were repeated except that the AC bias was not applied in the image forming operation.

As a result of the running test, the first and 23,000$^{th}$ images were good. However, when half tone images were reproduced after the running test, the half tone images had slightly uneven image density due to uneven charging although the images were still acceptable.

Example 134

The procedures for preparation of the charger and the photoreceptor in Example 123 were repeated except that the charge transport layer coating liquid was changed to the following.

Charge Transport Layer Coating Liquid

Charge transport polymer having formula (j)

8

Compound having the following formula (n)

0.4

(n)

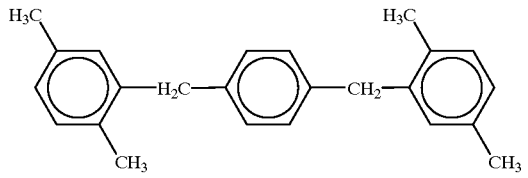

Methylene chloride

80

Example 135

The procedures for preparation of the charger and the photoreceptor in Example 123 were repeated except that the following protective layer coating liquid was coated on the charge transport layer and then dried to form a protective layer having a thickness of 3 μm.

Charge Transport Layer Coating Liquid

Charge transport polymer having formula (j)

2

Compound having formula (n)

0.4

C-form polycarbonate

2

Methylene chloride

80

Example 136

The procedures for preparation of the charger and the photoreceptor in Example 123 were repeated except that the protective layer coating liquid was coated on the charge transport layer and then dried to form a protective layer having a thickness of 3 μm.

Charge Transport Layer Coating Liquid

Charge transport polymer having formula (j)

2

C-form polycarbonate

2

Compound having formula (n)

0.4

Titanium oxide

1

Methylene chloride

80

Evaluation Method

Each combination of the photoreceptor and the charger of Examples 123 and 133–136 was set in an image forming apparatus having a construction as shown in FIG. 15 in which as shown in FIGS. 31 and 32 a ring member was provided on the rotating shaft of the driving roller supporting the photoreceptor and the rotating shaft of the charger to rotate the charger and the photoreceptor at the same speed while only the gap forming layers of the charger contacted the driving roller.

In this case, the photoreceptor and the charger were set such that as shown in FIG. 30 the inside edge GEa (GEb) of the gap forming layer 45*a* (45*b*) is located outside the end PEa (PEb) of the image forming portion 2 of the photoreceptor. The distance t between the inside edge GEa (GEb) of the gap forming layer 45*a* (45*b*) and the end PEa (PEb) of the image forming portion 2 was 2 mm, which is greater than twice the gap g (i.e., the gap was 30 μm in these examples) formed between the photoreceptor and the charger. As mentioned above, the difference between the surface of the driving roller and the surface of the photoreceptor is 60 μm.

A running test in which 45,000 copies were continuously produced was performed using a laser diode emitting light having a wavelength of 780 nm and a polygon mirror. The image qualities of the first and 45,000$^{th}$ images were evaluated. In addition, the abrasion quantity of the surface of the photoreceptor was also measured. The charging conditions are as follows.

DC bias: −900 V

AC bias: 2.0 kV (peak to peak voltage)

2 kHz (frequency)

The results are also shown in Table 16.

Example 137

The procedures for preparation and evaluation of the photoreceptor and the charger in Example 123 were repeated except that the ring member was not used in the image forming apparatus.

The results are also shown in Table 16.

TABLE 16

| | Image qualities of the first image | Image qualities of the 45,000$^{th}$ image | Abrasion quantity (μm) |
|---|---|---|---|
| Ex. 123 | Good | Faint black streaks were formed but the image was still acceptable. | 2.2 |
| Ex. 134 | Good | Good | 1.4 |
| Ex. 135 | Good | Good | 1.0 |
| Ex. 136 | Good | Good | 0.7 |
| Ex. 137 | Good | Slightly uneven density image was formed due to partially uneven charging. | 1.6 |

Example 138

Preparation of Charger

An electroconductive roller was prepared according to the method described in Example 4 of Japanese Laid-Open Patent Publication No. 5-341627, which is mentioned above. A Teflon tape having a thickness of 180 μm was adhered on both edge portions of the electroconductive roller.

Thus a charger having a gap forming material having a thickness of 180 μm was prepared.

Preparation of Photoreceptor

On the surface of an aluminum layer deposited on a polyethyleneterephthalate film having a thickness of 100 μm, the following undercoat layer coating liquid, charge generation layer coating liquid and charge transport layer coating liquid were coated and dried one by one to form an undercoat layer having a thickness of 4.0 μm, a charge generation layer having a thickness of 0.2 μm and a charge transport layer having a thickness of 26 μm.

| Undercoat layer coating liquid | | |
|---|---|---|
| Titanium 400 | dioxide | powder |
| Alcohol-soluble 200 | | nylon |
| Methanol 700 | | |
| Butanol 200 | | |

Charge Generation Layer Coating Liquid

Trisazo pigment having formula (b)
10

Polyvinyl butyral
5

2-butanone
200

Cyclohexanone
400

Charge Transport Layer Coating Liquid

Polycarbonate
10

Charge transport material having formula (a)
8

Methylene chloride
80

Example 139

The procedures for preparation of the charger and the photoreceptor in Example 138 were repeated except that the thickness of the gap forming materials was changed to 230 μm.

Example 140

The procedures for preparation of the charger and the photoreceptor in Example 138 were repeated except that the thickness of the gap forming materials was changed to 280 μm.

Example 141

The procedures for preparation of the charger and the photoreceptor in Example 138 were repeated except that the thickness of the gap forming materials was changed to 380 μm.

Comparative Example 29

The procedures for preparation of the charger and the photoreceptor in Example 138 were repeated except that the gap forming materials were not formed.

Evaluation Method

Each combination of the photoreceptor and the charger in Example 138 to 141 and Comparative Example 29 was set in a process cartridge having a construction as shown in FIG. 35 such that gears were provided on the rotating shaft of the driving roller supporting the photoreceptor and the rotating shaft of the charger to rotate the charger and the photoreceptor at the same speed and springs were provided on the rotating shaft of the charger to press the charger toward the photoreceptor.

In this case, the photoreceptor and the charger were set such that as shown in FIG. 30 the inside edge GEa (GEb) of the gap forming material 45*a* (45*b*) is located outside the end PEa (PEb) of the image forming portion 2 of the photoreceptor. The distance t between the inside edge GEa (GEb) of the gap forming material 45*a* (45*b*) and the end PEa (PEb) of the image forming portion 2 was 2 mm, which is greater than twice the gap g (i.e., the gap was from 30 to 320 μm in these examples) formed between the photoreceptor and the charger.

With respect to the chargers of Comparative Example 29, the entire peripheral surface of the chargers contacted the photoreceptor.

A running test in which 23,000 copies were continuously produced was performed using a laser diode emitting light having a wavelength of 780 nm and a polygon mirror. The potential of the non-lighted area of the photoreceptor, which was not exposed to imagewise light, was measured at the beginning and end of the running test. In addition, at the end of the running test, half tone images were produced to evaluate the image qualities. The charging conditions are as follows.

DC bias: −900 V

AC bias: 2.0 kV (peak to peak voltage)
2 kHz (frequency)

The results are also shown in Table 17.

Example 142

The procedures for preparation and evaluation of the charger and the photoreceptor in Example 138 were repeated except that the springs pressing the rotating shaft of the charger were not used.

The results are also shown in Table 17.

Example 143

The procedures for preparation and evaluation of the charger and the photoreceptor in Example 138 were repeated except that the charger was frictionally driven by the driving roller supporting the photoreceptor without using the gear G1.

The results are also shown in Table 17.

Example 144

The procedures for preparation and evaluation of the charger and the photoreceptor in Example 138 were repeated except that the charger rotated faster than the photoreceptor.

The results are also shown in Table 17.

TABLE 17

| | Image qualities (at the beginning) | Image qualities (at the end) |
|---|---|---|
| Ex. 138 | Good | Good |
| Ex. 139 | Good | Good |
| Ex. 140 | Good | Good |
| Ex. 141 | Good | Slightly uneven density image was formed due to bad charging. |
| Ex. 142 | Good | Slightly uneven density image was formed due to partially uneven charging. |
| Ex. 143 | Good | It was needed to increase the pressure to the charger, and therefore the abrasion quantity of the gap forming materials was large. |

TABLE 17-continued

| | Image qualities (at the beginning) | Image qualities (at the end) |
|---|---|---|
| Ex. 144 | Good | Good. However, the abrasion quantity of the gap forming materials was large. |
| Comp. Ex. 29 | Good | Undesired images were formed due to formation of a toner film on the surface of the charger. |

Combinations of the chargers and the photoreceptors in Examples 138 to 144 and Comparative Example 29 were explained while applying them to the process cartridge, however, the combinations can also be used for electrophotographic image forming apparatus other than the process cartridge.

Example 145

The procedures for preparation and evaluation of the photoreceptor and the charger in Example 138 were repeated except that the gap forming material was changed to a polyester film including a metal filler therein.

As a result of the running test, the 23,300$^{th}$ image had faint undesired images due to bad charging although the initial image was good.

Example 146

The procedures for preparation and evaluation of the photoreceptor and the charger in Example 138 were repeated except that the AC bias was not applied in the image forming operation.

As a result of the running test, the first and 23,000$^{th}$ images were good. However, when half tone images were reproduced after the running test, the half tone images had slightly uneven image density due to uneven charging although the half tone images were still acceptable.

Example 147

The procedures for preparation of the charger and the photoreceptor in Example 138 were repeated except that the charge transport layer coating liquid was changed to the following.

Charge Transport Layer Coating Liquid

Charge transport polymer having formula (d)
8

Compound having formula (n)
0.4

Methylene chloride
80

Example 148

The procedures for preparation of the charger and the photoreceptor in Example 138 were repeated except that a protective layer having a thickness of 3 $\mu$m was formed on the charge transport layer by coating the following protective layer coating liquid and then drying.

Protective Layer Coating Liquid

Charge transport polymer having formula (d)
2

Compound having formula (n)
0.4

Z-form polycarbonate
2

Methylene chloride
80

Example 149

The procedures for preparation of the charger and the photoreceptor in Example 138 were repeated except that a protective layer having a thickness of 2 $\mu$m was formed on the charge transport layer by coating the following protective layer coating liquid and then drying.

Protective Layer Coating Liquid

Charge transport polymer having formula (d)
2

Z-form polycarbonate
2

Compound having formula (n)
0.4

Titanium oxide
1

Methylene chloride
80

Evaluation Method

Each combination of the photoreceptor and the charger in Examples 138 and 147–149 was set in an image forming apparatus having a construction as shown in FIG. 15 in which a ring member was provided on the rotating shaft of the driving roller supporting the photoreceptor and the rotating shaft of the charger to rotate the charger and the photoreceptor at the same speed while only the gap forming layer of the charger contacted the driving roller.

In this case, the photoreceptor and the charger were set such that as shown in FIG. 30 the inside edge GEa (GEb) of the gap forming material 45*a* (45*b*) is located outside the end PEa (PEb) of the image forming portion 2 of the photoreceptor. The distance t between the inside edge GEa (GEb) of the gap forming material and the end PEa (PEb) of the image forming portion 2 was 2 mm, which is greater than twice the gap g (i.e., the gap was 180 $\mu$m in these examples) formed between the photoreceptor and the charger. As mentioned above, the difference between the surface of the driving roller and the surface of the photoreceptor is 60 $\mu$m.

A running test in which 40,000 copies were continuously produced was performed using a laser diode emitting light having a wavelength of 780 nm and a polygon mirror. The image qualities of the first and 40,000$^{th}$ images were evaluated. In addition, the abrasion quantity of the surface of the photoreceptor was also measured. The charging conditions are as follows.

DC bias: −900 V

AC bias: 2.0 kV (peak to peak voltage)
2 kHz (frequency)

The results are also shown in Table 18.

Example 150

The procedures for preparation and evaluation of the photoreceptor and the charger in Example 138 were repeated except that the ring member was not used in the image forming apparatus.

The results are also shown in Table 18.

TABLE 18

| | Image qualities of the first image | Image qualities of the 40,000th image | Abrasion quantity (μm) |
|---|---|---|---|
| Ex. 138 | Good | Faint black streaks were formed but the image was still acceptable. | 2.0 |
| Ex. 147 | Good | Good | 1.42 |
| Ex. 148 | Good | Good | 0.9 |
| Ex. 149 | Good | Good | 0.5 |
| Ex. 150 | Good | Slightly uneven density image was formed due to partially uneven charging. | 1.6 |

Examples of the Sixth Embodiments

Example 151

Preparation of Charger

An electroconductive elastic layer made of an epichlorohydrin rubber and having a resistivity of $2\times10^8$ Ω·cm and a thickness of 3 mm was formed on the periphery of a stainless steel cylinder, and a resistance controlling layer made of a mixture of an epichlorohydrin rubber and a fluorine-containing resin and having a resistivity of $8\times10^8$ Ω·cm and a thickness of 140 μm was formed thereon. On the both end portions of the charging roller, projected portions having a thickness of 90 μm to be contacted with the non-image end portion of the photoreceptor mentioned below was formed by cutting the central portion of the resistance controlling layer by a cutting tool. Thus, a charging roller having gap forming portions of 90 μm thick was prepared.

Preparation of Photoreceptor

The following undercoat layer coating liquid, charge generation layer coating liquid and charge transport layer coating liquid were coated on a seamless nickel belt having a thickness of 30 μm and then dried to overlay an undercoat layer having a thickness of 2.0 μm, a charge generation layer having a thickness of 0.2 μm and a charge transport layer having a thickness of 28 μm on the nickel belt. Thus, a photoreceptor was prepared.

| Undercoat layer coating liquid | | |
|---|---|---|
| Titanium 400 | dioxide | powder |
| Melamine 65 | | resin |
| Alkyd 120 | | resin |
| 2-butanone 400 | | |

Charge Generation Layer Coating Liquid

Titanylphthalocyanine
7

Polyvinyl butyral
5

2-butanone
200

Cyclohexanone
400

Charge Transport Layer Coating Liquid

Polycarbonate
10

Charge transport material having formula (c)
8

Methylene chloride
80

Example 152

The procedures for preparation of the charger and the photoreceptor in Example 151 were repeated except that the thickness of the resistance controlling layer was 170 μm and the thickness of the gap forming portions was 120 μm (i.e., the cutting thickness was 120 μm).

Example 153

The procedures for preparation of the charger and the photoreceptor in Example 151 were repeated except that the thickness of the surface layer was 230 μm and the thickness of the gap forming portions was 180 μm (i.e., the cutting thickness was 180 μm).

Example 154

The procedures for preparation of the charger and the photoreceptor in Example 151 were repeated except that the thickness of the surface layer was 360 μm and the thickness of the gap forming portions was 310 μm (i.e., the cutting thickness was 310 μm).

Comparative Example 30

The procedures for preparation of the charger and the photoreceptor in Example 151 were repeated except that the thickness of the surface layer was 50 μm and the gap forming portions were not formed (i.e., the cutting treatment was not performed).

Evaluation Method

Each combination of the photoreceptor and the charger in Example 151 to 154 and Comparative Example 30 was set in an image forming apparatus having a construction as shown in FIG. 15 in which a ring member was provided on the rotating shaft of the driving roller supporting the photoreceptor and the rotating shaft of a charger to rotate the charger and the photoreceptor at the same speed while only the gap forming portions of the charger contacted the driving roller as shown in FIG. 36.

In this case, the photoreceptor and the charger were set such that as shown in FIG. 37 the inside edge GEa (GEb) of the gap forming portion 46*a* (46*b*) is located outside the end PEa (PEb) of the image forming portion 2 of the photoreceptor. The distance t between the inside edge GEa (GEb) of the gap forming portion 46*a* (46*b*) and the end PEa (PEb) of the image forming portion 2 was 2 mm, which is greater than twice the gap g (i.e., the gap was from 30 to 250 μm in these examples) formed between the photoreceptor and the charger. The surface of the driving roller had an insulating anodized aluminum film. In addition, the diameter of the driving roller was uniform. As mentioned above, the difference between the surface of the driving roller and the surface of the photoreceptor is 60 μm.

A running test in which 20,000 copies were continuously produced was performed using a laser diode emitting light having a wavelength of 780 nm and a polygon mirror. The image qualities of the first and 20,000th images were evaluated. The charging conditions are as follows.

DC bias: −900 V

AC bias: 1.8 kV (peak to peak voltage)

2.2 kHz (frequency)

The results are also shown in Table 19.

Comparative Example 31

The procedures for preparation and evaluation of the photoreceptor and the charger in Example 152 were repeated except that the distance t was 0 mm.

Example 155

The procedures for preparation and evaluation of the photoreceptor and the charger in Example 151 were repeated except that the distance t was 0.5 mm.

Example 156

The procedures for preparation and evaluation of the photoreceptor and the charger in Example 151 were repeated except that the distance t was 1.0 mm.

Example 157

The procedures for preparation and evaluation of the photoreceptor and the charger in Example 151 were repeated except that the charger was frictionally driven by the driving roller without using the ring member.

The results are shown in Table 19.

TABLE 19

| | Image qualities (at the beginning) | Image qualities (at the end) |
|---|---|---|
| Ex. 151 | Good | Good |
| Ex. 152 | Good | Good |
| Ex. 153 | Good | Good |
| Ex. 154 | Good | Slightly uneven density image was formed due to bad charging. |
| Comp. Ex. 30 | Good | Undesired images were formed due to formation of toner film on the surface of the charger |
| Comp. Ex. 31 | Good | Uneven images were formed on both sides of the copy. In addition, background fouling was observed. |
| Ex. 155 | Good | Good |
| Ex. 156 | Good | Good |
| Ex. 157 | Good | Slightly uneven density image was formed due to partially uneven charging. |

Example 158

The procedures for preparation and evaluation of the photoreceptor and the charger in Example 151 were repeated except that the surface of the driving roller did not have an insulating anodized aluminum film.

As a result of the running test, the initial image and the 20,000$^{th}$ image were good. However, the 20,000$^{th}$ image had faint undesired image due to abnormal charging although the image was still acceptable.

Example 159

The procedures for preparation and evaluation of the photoreceptor and the charger in Example 151 were repeated except that the AC bias was not applied in the image forming operation.

As a result of the running test, the first and 20,000$^{th}$ images were good. However, when half tone images were reproduced after the running test, the half tone images had slightly uneven image density due to uneven charging but the images were still acceptable.

Example 160

The procedures for preparation of the charger and the photoreceptor in Example 151 were repeated except that the charge transport layer coating liquid was changed to the following.

Charge Transport Layer Coating Liquid

Charge transport polymer having formula (1)

8

Compound having formula (n)

0.4

Methylene chloride

80

Example 161

The procedures for preparation of the charger and the photoreceptor in Example 151 were repeated except that a protective layer having a thickness of 3 $\mu$m was formed on the charge transport layer by coating the following protective layer coating liquid.

Protective Layer Coating Liquid

Charge transport polymer having formula (1) 2

Compound having formula (n)

0.4

A-form polycarbonate

2

Methylene chloride

80

Example 162

The procedures for preparation of the charger and the photoreceptor in Example 151 was repeated except that a protective layer having a thickness of 2 $\mu$m was formed on the charge transport layer by coating the following protective layer coating liquid.

Protective Layer Coating Liquid

Charge transport polymer having formula (1) 2

A-form polycarbonate

2

Compound having formula (n)

0.4

Titanium oxide

1

Methylene chloride

80

Evaluation Method

Each combination of the photoreceptor and the charger of Examples 151 and 160 to 162 was set in an image forming apparatus having a construction as shown in FIG. 15 in which gears were provided on the rotating shaft of the driving roller supporting the photoreceptor and the rotating shaft of the charger to rotate the charger and the photoreceptor at the same speed while only the gap forming portions of the charger contacted the driving roller. In addition, springs were provided on the rotating shaft of the charger to press the charger toward the driving roller.

In this case, the photoreceptor and the charger were set such that as shown in FIG. 37 the inside edge GEa (GEb) of the gap forming portion 46*a* (46*b*) is located outside the end PEa (PEb) of the image forming portion 2 of the photoreceptor. The distance t between the inside edge GEa (GEb) of the gap forming portion 46*a* (46*b*) and the end PEa (PEb) of the image forming portion 2 was 2 mm, which is greater than twice the gap g (i.e., the gap was from 30 to 250 μm in these examples) formed between the photoreceptor and the charger. The surface of the driving roller had an insulating anodized aluminum film. In addition, the diameter of the driving roller was uniform. As mentioned above, the difference between the surface of the driving roller and the surface of the photoreceptor is 60 μm.

A running test in which 50,000 copies were continuously produced was performed using a laser diode emitting light having a wavelength of 780 nm and a polygon mirror. The image qualities of the first and 50,000$^{th}$ images were evaluated. The charging conditions are as follows.

DC bias: −900 V

AC bias: 2.0 kV (peak to peak voltage)
2 kHz (frequency)

The results are also shown in Table 20.

Example 163

The procedures for preparation and evaluation of the charger and the photoreceptor in Example 151 were repeated except that the springs pressing the rotating shaft of the charger were not used.

The results are also shown in Table 20.

Example 164

The procedures for preparation and evaluation of the charger and the photoreceptor in Example 151 were repeated except that the charger was frictionally driven by the driving roller supporting the photoreceptor without using the gear.

The results are also shown in Table 20.

Example 165

The procedures for preparation and evaluation of the charger and the photoreceptor in Example 151 were repeated except that the charger rotated faster than the photoreceptor.

The results are also shown in Table 20.

TABLE 20

| | Image qualities of the first image | Image qualities of the 50,000$^{th}$ image | Abrasion quantity (μm) |
|---|---|---|---|
| Ex. 151 | Good | Faint black streaks were formed but the image was still acceptable. | 4.3 |
| Ex. 160 | Good | Good | 2.2 |
| Ex. 161 | Good | Good | 1.6 |
| Ex. 162 | Good | Good | 1.2 |
| Ex. 163 | Good | Slightly uneven density image was formed due to partially uneven charging. | 4.0 |
| Ex. 164 | Good | Good. Since it was needed to enlarge the pressure to the charger, the abrasion quantity of the gap forming portions was large. | 4.5 |
| Ex. 165 | Good | Good. The abrasion quantity of the gap forming portions was large. | 4.4 |

Example 166

The procedures for preparation of the charger and the photoreceptor in Example 151 were repeated except that the charge generation layer coating liquid and the charge transport layer coating liquid were changed to the following and the thickness of the charge transport layer was changed to 24 μm.

Charge Generation Layer Coating Liquid

Charge generation material having formula (e)
1

Charge generation material having formula (f)
1

Polyvinyl butyral
1

Cyclohexanone
70

Cyclohexane
30

Charge Transport Layer Coating Liquid

Charge transport material having formula (g)
7

Polycarbonate
10

Tetrahydrofuran
100

Example 167

The procedures for preparation of the charger and the photoreceptor in Example 166 were repeated except that the charge transport layer coating liquid was changed to the following.

Charge Transport Layer Coating Liquid

Charge transport polymer having formula (1)
8

Compound having formula (n)
0.4

Methylene chloride
80

Example 168

The procedures for preparation of the charger and the photoreceptor in Example 166 were repeated except that a protective layer having a thickness of 3 μm was formed on the charge transport layer by coating the following protective layer coating liquid and then drying.

Charge Transport Layer Coating Liquid

Charge transport polymer having formula (1)
2

Compound having formula (n)
0.4

A-form polycarbonate

2

Methylene chloride

80

Example 169

The procedures for preparation of the charger and the photoreceptor in Example 166 were repeated except that a protective layer having a thickness of 2 μm was formed on the charge transport layer by coating the following protective layer coating liquid and then drying.

Charge Transport Layer Coating Liquid

Charge transport polymer having formula (1)

2

A-form polycarbonate

2

Compound having formula (n)

0.4

Titanium oxide

1

Methylene chloride

80

Evaluation Method

Each combination of the photoreceptor and the charger in Examples 166 to 169 were set in a process cartridge having a construction as shown in FIG. 35 in which gears were provided on the rotating shaft of the driving roller supporting the photoreceptor and the rotating shaft of the charger to rotate the charger and the photoreceptor at the same speed while only the gap forming portions of the charger contacted the driving roller. In addition, springs were provided on the rotating shaft of the charger to press the charger toward the driving roller.

In this case, the photoreceptor and the charger were set in a process cartridge having a construction as shown in FIG. 35 such that as shown in FIG. 37 the inside edge GEa (GEb) of the gap forming portion 46*a* (46*b*) is located outside the end PEa (PEb) of the image forming portion 2 of the photoreceptor. The distance t between the inside edge GEa (GEb) of the gap forming portion 46*a* (46*b*) and the end PEa (PEb) of the image forming portion 2 was 2 mm, which is greater than twice the gap g (i.e., the gap was 30 μm in these examples) formed between the photoreceptor and the charger. The surface of the driving roller had an insulating anodized aluminum film. In addition, the diameter of the driving roller was uniform. As mentioned above, the difference between the surface of the driving roller and the surface of the photoreceptor is 60 μm.

A running test in which 25,000 copies were continuously produced was performed using a laser diode emitting light having a wavelength of 780 nm and a polygon mirror. The image qualities of the first and 25,000$^{th}$ images were evaluated. In addition, the abrasion quantity was measured. The charging conditions are as follows.

DC bias: −900 V

AC bias: 2.0 kV (peak to peak voltage)

2 kHz (frequency)

The results are also shown in Table 21.

Example 170

The procedures for preparation and evaluation of the charger and the photoreceptor in Example 166 were repeated except that the springs pressing the rotating shaft of the charger were not used.

The results are also shown in Table 21.

Example 171

The procedures for preparation and evaluation of the charger and the photoreceptor in Example 166 were repeated except that the charger was frictionally driven by the driving roller supporting the photoreceptor without using the gear.

The results are also shown in Table 21.

Example 172

The procedures for preparation and evaluation of the charger and the photoreceptor in Example 166 were repeated except that the charger rotated faster than the photoreceptor.

The results are also shown in Table 21.

Comparative Example 32

The procedures for preparation and evaluation of the photoreceptor and the charger in Example 166 were repeated except that the charger was changed to the charger prepared in Comparative Example 30.

The results are also shown in Table 21.

TABLE 21

| | Image qualities of the first image | Image qualities of the 25,000$^{th}$ image | Abrasion quantity (μm) |
|---|---|---|---|
| Ex. 166 | Good | Faint black streaks were formed but the image was still acceptable. | 2.4 |
| Ex. 167 | Good | Good | 1.5 |
| Ex. 168 | Good | Good | 1.1 |
| Ex. 169 | Good | Good | 0.7 |
| Ex. 170 | Good | Slightly uneven density image was formed due to partially uneven charging. | 1.7 |
| Ex. 171 | Good | Good. Since it was needed to enlarge the pressure to the charger, the abrasion quantity of the gap forming portions was large. | 2.8 |
| Ex. 172 | Good | Good. The abrasion quantity of the gap forming portions was large. | 2.7 |
| Comp. Ex. 32 | | Undesired images were formed due to formation of toner film on the surface of the charger. | 2.5 |

As can be understood from the above description, according to the present invention, an image forming apparatus and a process cartridge capable of stably producing good images without forming a toner film on the charger therein. In addition, by using such an image forming apparatus and process cartridge, the abrasion of the photoreceptor and the charger used can be reduced, and thereby the life of the photoreceptor and the charger can be prolonged. Thus, an image forming apparatus and a process cartridge having good durability can be provided.

Although the charger of the present invention is one of proximity charging devices, an additional device to form and maintain a gap between a photoreceptor and the charger is not needed. Since the charger includes gap forming members which are one part of the surface layer or are fixedly adhered to the surface layer of the charger, the gap forming member stably forms and maintain a gap between the photoreceptor and the charger without being peeled. Therefore, problems such as uneven charging and banding phenomenon, which often occur when non-contact charging is performed, can be avoided, and good images can be stably produced for a long period of time.

This document claims priority and contains subject matter related to Japanese Patent Application No. 2000-264720, filed on Aug. 31, 2000, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing device comprising a photoreceptor comprising an electroconductive substrate, a photosensitive layer located on the electroconductive substrate, and optionally a protective layer located on the photosensitive layer, said photoreceptor rotating in a direction, wherein the photoreceptor has an image forming portion having two ends substantially parallel to the rotating direction;

a charging roller configured to charge the photoreceptor while rotating, wherein the charging roller has a gap forming member on both ends of a periphery surface of the charging roller to form a gap between a surface of the image forming portion of the photoreceptor and the periphery surface of the charging roller, and wherein the gap forming members do not contact the image forming portion of the photoreceptor;

a light irradiator configured to irradiate the photoreceptor with light to form an electrostatic latent image in the image forming portion of the photoreceptor;

an image developer configured to develop the latent image with a toner to form a toner image on the image forming portion of the photoreceptor; and an image transferer configured to transfer the toner image onto a receiving material, wherein the following relationship is satisfied:

$$t \geqq 2g$$

wherein g represents the gap between the surface of the image forming portion of the photoreceptor and the periphery surface of the charging roller and t represents a distance between an inside edge of one of the gap forming members and one of the two ends of the image forming portion of the photoreceptor, said one of the two ends being closer to the inside edge of the one of the gap forming members than the other of the two ends.

2. The image forming apparatus according to claim 1, wherein the photoreceptor has two non-image portions, one of which is located outside one of the two ends of the image forming portion and the other of which is located outside of the other of the two ends of the image forming portion, and wherein each of the gap forming members contacts a surface of the respective non-image portion.

3. The image forming apparatus according to claim 1, wherein the image bearing device further comprises two flanges, one of which is located outside one of the two ends of the image forming portion and the other of which is located outside the other of the two ends of the image forming portion, and wherein each of the gap forming members contacts a surface of the respective flange.

4. The image forming apparatus according to claim 3, wherein the surfaces of the flanges are electrically insulative.

5. The image forming apparatus according to claim 1, wherein the periphery surface of the charging roller has a surface layer, wherein the surface layer has a projected portion on both ends thereof, and wherein the projected portions serve as the gap forming members.

6. The image forming apparatus according to claim 1, further comprising a pressing device configured to press at least one of the charging roller and the photoreceptor to the other.

7. The image forming apparatus according to claim 6, wherein the pressing device comprises a spring.

8. The image forming apparatus according to claim 1, wherein each of the charging roller and the photoreceptor has a rotating shaft, and wherein the rotating shafts are rotatably supported by a ring member.

9. The image forming apparatus according to claim 1, wherein the charging roller and the photoreceptor each have a respective driving device configured to independently drive the charging roller and the photoreceptor.

10. The image forming apparatus according to claim 9, wherein each of the driving devices is, independently, a member selected from the group consisting of gears, couplings and belts.

11. The image forming apparatus according to claim 1, wherein the charging roller and the photoreceptor rotate at a same speed.

12. The image forming apparatus according to claim 1, wherein the image bearing device further comprises a roller and the photoreceptor is a belt photoreceptor, wherein the belt photoreceptor is rotatably supported by the roller, wherein the roller is extended from both ends of the belt photoreceptor, said ends of the belt photoreceptor being substantially parallel to the rotating direction of the belt photoreceptor, and wherein one of the gap forming members contacts a surface of one of the extended portions of the roller and the other of the gap forming members contacts a surface of the other of the extended portions of the roller.

13. The image forming apparatus according to claim 12, further comprising a pressing device configured to press at least one of the charging roller and the roller to the other.

14. The image forming apparatus according to claim 13, wherein the pressing device comprises a spring.

15. The image forming apparatus according to claim 12, wherein each of the charging roller and the roller supporting the belt photoreceptor has a rotating shaft, and wherein the rotating shafts are rotatably supported by a ring member.

16. The image forming apparatus according to claim 12, wherein the charging roller and the roller each have a respective driving device configured to independently drive the charging roller and the roller.

17. The image forming apparatus according to claim 16, wherein each of the driving devices is, independently, a member selected from the group consisting of gears, couplings and belts.

18. The image forming apparatus according to claim 12, wherein the charging roller and the roller rotate at a same speed.

19. The image forming apparatus according to claim 12, wherein the surfaces of the roller contacting the gap forming members are electrically insulative.

20. The image forming apparatus according to claim 12, wherein the electroconductive substrate of the belt photoreceptor is a seamless belt.

21. The image forming apparatus according to claim 1, wherein the gap forming members are electrically insulative.

22. The image forming apparatus according to claim 1, wherein the gap forming members have a thickness of from 10 to 200 $\mu$m.

23. The image forming apparatus according to claim 1, wherein the gap g is from 10 to 200 $\mu$m.

24. The image forming apparatus according to claim 1, wherein the charging roller charges the photoreceptor by applying a DC voltage overlapped with an AC voltage.

25. The image forming apparatus according to claim 1, wherein the photosensitive layer of the photoreceptor comprises a charge generation layer and a charge transport layer.

26. The image forming apparatus according to claim 25, wherein the charge transport layer comprises a polycarbonate having a triarylamine group in at least one of a main chain or a side chain thereof.

27. The image forming apparatus according to claim 1, the photoreceptor including a protective layer, wherein the protective layer comprises a filler.

28. The image forming apparatus according to claim 1, the photoreceptor including a protective layer, wherein the protective layer comprises a charge transport material.

29. The image forming apparatus according to claim 28, wherein the charge transport material is a charge transport polymer.

30. The image forming apparatus according to claim 29, wherein the charge transport polymer comprises a polycarbonate having a triarylamine group in at least one of a main chain or a side chain thereof.

31. A process cartridge comprising:

an image bearing device comprising a photoreceptor comprising an electroconductive substrate, a photosensitive layer located on the electroconductive substrate, and optionally a protective layer located on the photosensitive layer, said photoreceptor rotating in a direction, wherein the photoreceptor has an image forming portion having two ends substantially parallel to the rotating direction; and a charging roller configured to charge the photoreceptor while rotating, wherein the charging roller has a gap forming member on both ends of a periphery surface of the charging roller to form a gap between a surface of the image forming portion of the photoreceptor and the periphery surface of the charging roller, and wherein the gap forming members do not contact the image forming portion of the photoreceptor, wherein the following relationship is satisfied:

$$t \geqq 2g$$

wherein g represents the gap between the surface of the image forming portion of the photoreceptor and periphery surface of the charging roller and t represents a distance between an inside edge of one of the gap forming members and one of the two ends of the image forming portion of the photoreceptor, said one of the two ends being closer to the inside edge of the one of the gap forming members other than the other of the two ends.

32. The process cartridge according to claim 31, wherein the photoreceptor has two non-image portions, one of which is located outside one of the two ends of the image forming portion and the other of which is located outside of the other of the two ends of the image forming portion, and wherein each of the gap forming members contacts the respective non-image portion.

33. The process cartridge according to claim 31, wherein the image bearing device further comprises two flanges, one of which is located outside one of the two ends of the image forming portion and the other of which is located outside of the two ends of the image forming portion, and wherein each of the gap forming members contacts a surface of the respective flange.

34. The process cartridge according to claim 33, wherein the surfaces of the flanges are electrically insulative.

35. The process cartridge according to claim 31, wherein the periphery surface of the charging roller has a surface layer, wherein the surface layer has a projected portion on both ends thereof, and wherein the projected portions serve as the gap forming members.

36. The process cartridge according to claim 31, further comprising a pressing device configured to press at least one of the charging roller and the photoreceptor to the other.

37. The process cartridge according to claim 36, wherein the pressing device comprises a spring.

38. The process cartridge according to claim 31, wherein each of the charging roller and the photoreceptor has a rotating shaft, and wherein the rotating shafts are rotatably supported by a ring member.

39. The process cartridge according to claim 31, wherein the charging roller and the photoreceptor each have a respective driving device configured to independently drive the charging roller and the photoreceptor.

40. The process cartridge according to claim 39, wherein each of the driving devices is, independently, a member selected from the group consisting of gears, couplings and belts.

41. The process cartridge according to claim 31, wherein the charging roller and the photoreceptor rotate at a same speed.

42. The process cartridge according to claim 31, wherein the image bearing device further comprises a roller and the photoreceptor is a belt photoreceptor, wherein the belt photoreceptor is rotatably supported by the roller, wherein the roller is extended from both ends of the belt photoreceptor, said ends of the belt photoreceptor being substantially parallel to the rotating direction of the belt photoreceptor, and wherein one of the gap forming members contacts a surface of one of the extended portions of the roller and the other of the gap forming members contacts a surface of the extended portions of the roller.

43. The process cartridge according to claim 42, further comprising a pressing device configured to press at least one of the charging roller and the roller to the other.

44. The process cartridge according to claim 43, wherein the pressing device comprises a spring.

45. The process cartridge according to claim 42, wherein each of the charging roller and the roller supporting the belt photoreceptor has a rotating shaft, and wherein the rotating shafts are rotatably supported by a ring member.

46. The process cartridge according to claim 42, wherein the charging roller and the roller each have a respective driving device configured to independently drive the charging roller and the roller.

47. The process cartridge according to claim 46, wherein each of the driving devices is, independently, a member selected from the group consisting of gears, couplings and belts.

48. The process cartridge according to claim 42, wherein the charging roller and the roller rotate at a same speed.

49. The process cartridge according to claim 42, wherein the surfaces of the roller contacting the gap forming members are electrically insulative.

50. The process cartridge according to claim 42, wherein the electroconductive substrate of the belt photoreceptor is a seamless belt.

51. The process cartridge according to claim 31, wherein the gap forming members are electrically insulative.

52. The process cartridge according to claim 31, wherein the gap forming members have a thickness of from 10 to 200 $\mu$m.

53. The process cartridge according to claim 31, wherein the gap g is from 10 to 200 $\mu$m.

54. The process cartridge according to claim 31, wherein the charging roller charges the photoreceptor by applying a DC voltage overlapped with an AC voltage.

55. The process cartridge according to claim 31, wherein the photosensitive layer of the photoreceptor comprises a charge generation layer and a charge transport layer.

56. The process cartridge according to claim 55, wherein the charge transport layer comprises a polycarbonate having a triarylamine group in at least one of a main chain or a side chain thereof.

57. The process cartridge according to claim 31, the photoreceptor including a protective layer, wherein the protective layer comprises a filler.

58. The process cartridge according to claim 31, the photoreceptor including a protective layer, wherein the protective layer comprises a charge transport material.

59. The process cartridge according to claim 58, wherein the charge transport material is a charge transport polymer.

60. The process cartridge according to claim 59, wherein the charge transport polymer comprises a polycarbonate having a triarylamine group in at least one of a main chain or a side chain thereof.

* * * * *